US010796525B2

(12) United States Patent
Cire et al.

(10) Patent No.: US 10,796,525 B2
(45) Date of Patent: Oct. 6, 2020

(54) OUTCOME SELECTOR INTERACTIVE WAGERING SYSTEM

(71) Applicant: Gamblit Gaming, LLC, Glendale, CA (US)

(72) Inventors: Bryce Cire, Los Angeles, CA (US); Frank Cire, Pasadena, CA (US); Eric Meyerhofer, Pasadena, CA (US)

(73) Assignee: Gamblit Gaming, LLC, Monrovia, CA (US)

( * ) Notice: Subject to any disclaimer, the term of this patent is extended or adjusted under 35 U.S.C. 154(b) by 0 days.

(21) Appl. No.: 16/129,752

(22) Filed: Sep. 12, 2018

(65) Prior Publication Data

US 2019/0088080 A1 Mar. 21, 2019

Related U.S. Application Data

(60) Provisional application No. 62/683,549, filed on Jun. 11, 2018, provisional application No. 62/576,544, (Continued)

(51) Int. Cl.
*G07F 17/32* (2006.01)

(52) U.S. Cl.
CPC ..... *G07F 17/3225* (2013.01); *G07F 17/3209* (2013.01); *G07F 17/3244* (2013.01); (Continued)

(58) Field of Classification Search
None
See application file for complete search history.

(56) References Cited

U.S. PATENT DOCUMENTS 5,342,049 A 8/1994 Wichinsky et al.
5,413,357 A 5/1995 Schulze et al.
(Continued)

FOREIGN PATENT DOCUMENTS

JP 20040097610 A1 5/2004

OTHER PUBLICATIONS

U.S. Appl. No. 14/205,303 Arnone, et al., filed Mar. 11, 2014.
(Continued)

*Primary Examiner* — Tramar Y Harper
(74) *Attorney, Agent, or Firm* — Frank Cire

(57) ABSTRACT

An outcome selector interactive wagering system is disclosed. The outcome selector interactive wagering system includes an interactive controller that receives an interactive objective for an interactive wagering game from a process controller, generates a player presentation based on the interactive objective, detects player interactions of a player with the player presentation, detects an interactive objective achievement based on the player interactions and the interactive objective, and communicates the interactive objective achievement to the process controller. The process controller operatively connected to the interactive controller, wherein the process controller is constructed to generate a random component using a random number generator, generate an interactive objective of the interactive objective based on the random component, communicate the interactive objective to the interactive controller; and receive an interactive objective achievement for the interactive objective from the interactive controller.

8 Claims, 29 Drawing Sheets

Related U.S. Application Data filed on Oct. 24, 2017, provisional application No. 62/557,599, filed on Sep. 12, 2017.

(52) U.S. Cl.
CPC ..... *G07F 17/3288* (2013.01); *G07F 17/3213* (2013.01); *G07F 17/3239* (2013.01)

(56) References Cited

U.S. PATENT DOCUMENTS 5,718,429 A 2/1998 Keller
5,785,592 A 7/1998 Jacobsen
5,853,324 A 12/1998 Kami et al.
5,963,745 A 10/1999 Collins et al.
6,050,895 A 4/2000 Luciano
6,165,070 A 12/2000 Nolte et al.
6,165,071 A 12/2000 Weiss
6,227,974 B1 5/2001 Eilat
6,267,669 B1 7/2001 Luciano
6,302,791 B1 10/2001 Frohm et al.
6,685,563 B1 2/2004 Meekins et al.
6,712,693 B1 3/2004 Hettinger
6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,931,531 B2 4/2011 Oberberger
7,938,727 B1 5/2011 Konkle
7,950,993 B2 5/2011 Oberberger
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,142,272 B2 3/2012 Walker
8,157,653 B2 4/2012 Buhr
8,167,695 B2 5/2012 Rowe
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,308,544 B2 11/2012 Friedman
8,430,735 B2 4/2013 Oberberger
8,475,266 B2 7/2013 Arnone
8,480,470 B2 7/2013 Napolitano et al.
8,485,893 B2 7/2013 Rowe
8,622,809 B1 1/2014 Arora et al.
8,864,564 B2 10/2014 Oberberger
8,998,694 B2 4/2015 Rowe
9,070,257 B1 6/2015 Scalise
9,092,946 B2 7/2015 Rowe
9,111,412 B2 8/2015 Rowe
9,454,873 B2 9/2016 Rowe
2001/0004609 A1 6/2001 Walker et al.
2001/0019965 A1 9/2001 Ochi
2002/0022509 A1 2/2002 Nicastro et al.
2002/0090990 A1 7/2002 Joshi et al.
2002/0175471 A1 11/2002 Faith
2003/0060286 A1 3/2003 Walker et al.
2003/0119576 A1 6/2003 McClintic et al.
2003/0139214 A1 7/2003 Wolf et al.
2003/0171144 A1 9/2003 Letovsky
2003/0171149 A1 9/2003 Rothschild
2003/0204565 A1 10/2003 Guo et al.
2003/0211879 A1 11/2003 Englman
2004/0092313 A1 5/2004 Saito et al.
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2006/0281528 A1* 12/2006 Hall ..... G07F 17/32 463/20
2007/0026924 A1 2/2007 Taylor
2007/0035548 A1 2/2007 Jung et al.
2007/0038559 A1 2/2007 Jung et al.
2007/0060252 A1* 3/2007 Taylor ..... G07F 17/32 463/16
2007/0064074 A1 3/2007 Silverbrook et al.
2007/0087799 A1 4/2007 Van Luchene
2007/0093299 A1 4/2007 Bergeron
2007/0099696 A1 5/2007 Nguyen et al.
2007/0117641 A1 5/2007 Walker et al.
2007/0129149 A1 6/2007 Walker
2007/0142108 A1 6/2007 Linard
2007/0156509 A1 7/2007 Jung et al.
2007/0167212 A1 7/2007 Nguyen
2007/0167239 A1 7/2007 O'Rourke
2007/0173311 A1 7/2007 Morrow et al.
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0259717 A1 11/2007 Mattice
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0064488 A1 3/2008 Oh
2008/0070659 A1 3/2008 Naicker
2008/0070690 A1 3/2008 Van Luchene
2008/0070702 A1 3/2008 Kaminkow
2008/0076503 A1* 3/2008 Mattice ..... G07F 17/3244 463/16
2008/0096665 A1 4/2008 Cohen

(56) References Cited

U.S. PATENT DOCUMENTS

2008/0108406 A1 5/2008 Oberberger
2008/0108425 A1 5/2008 Oberberger
2008/0113704 A1 5/2008 Jackson
2008/0119283 A1 5/2008 Baerlocher
2008/0146308 A1 6/2008 Okada
2008/0161081 A1 7/2008 Berman
2008/0176619 A1 7/2008 Kelly
2008/0191418 A1 8/2008 Lutnick et al.
2008/0195481 A1 8/2008 Lutnick
2008/0242398 A1* 10/2008 Harris ..... G07F 17/32 463/25
2008/0248850 A1 10/2008 Schugar
2008/0254893 A1 10/2008 Patel
2008/0274796 A1 11/2008 Lube
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0061975 A1 3/2009 Ditchev
2009/0061991 A1 3/2009 Popovich
2009/0061997 A1 3/2009 Popovich
2009/0061998 A1 3/2009 Popovich
2009/0061999 A1 3/2009 Popovich
2009/0082093 A1 3/2009 Okada
2009/0088239 A1 4/2009 Iddings
2009/0098934 A1 4/2009 Amour
2009/0118006 A1 5/2009 Kelly et al.
2009/0124344 A1 5/2009 Mitchell et al.
2009/0131158 A1 5/2009 Brunet De Courssou et al.
2009/0131175 A1 5/2009 Kelly et al.
2009/0143141 A1 6/2009 Wells
2009/0149233 A1 6/2009 Strause et al.
2009/0156297 A1 6/2009 Andersson et al.
2009/0176560 A1 7/2009 Herrmann et al.
2009/0176566 A1 7/2009 Kelly
2009/0181777 A1 7/2009 Christiani
2009/0221355 A1 9/2009 Dunaevsky et al.
2009/0239610 A1 9/2009 Olive
2009/0247272 A1 10/2009 Abe
2009/0247284 A1* 10/2009 Sugiyama ..... G07F 17/32 463/25
2009/0270164 A1 10/2009 Seelig
2009/0275393 A1 11/2009 Kisenwether
2009/0291755 A1 11/2009 Walker et al.
2009/0309305 A1 12/2009 May
2009/0312093 A1 12/2009 Walker et al.
2009/0325686 A1 12/2009 Davis
2010/0004047 A1* 1/2010 Acres ..... G07F 17/3244 463/20
2010/0004058 A1 1/2010 Acres
2010/0016055 A1* 1/2010 Englman ..... G07F 17/3244 463/20
2010/0016056 A1 1/2010 Thomas et al.
2010/0029373 A1 2/2010 Graham et al.
2010/0035674 A1 2/2010 Slomiany
2010/0041461 A1* 2/2010 Demsetz ..... G07F 17/32 463/20
2010/0056247 A1 3/2010 Nicely
2010/0056260 A1 3/2010 Fujimoto
2010/0062836 A1 3/2010 Young
2010/0093420 A1 4/2010 Wright
2010/0093444 A1 4/2010 Biggar et al.
2010/0105454 A1 4/2010 Weber
2010/0120525 A1 5/2010 Baerlocher et al.
2010/0124969 A1* 5/2010 Hughes ..... G07F 17/3265 463/20
2010/0124983 A1 5/2010 Gowin et al.
2010/0137047 A1 6/2010 Englman et al.
2010/0174593 A1 7/2010 Cao
2010/0184509 A1 7/2010 Sylla et al.
2010/0203940 A1 8/2010 Alderucci et al.
2010/0210344 A1 8/2010 Edidin et al.
2010/0227672 A1 9/2010 Amour
2010/0227688 A1 9/2010 Lee
2010/0240436 A1 9/2010 Wilson et al.
2010/0285869 A1 11/2010 Walker
2010/0304825 A1 12/2010 Davis
2010/0304839 A1 12/2010 Johnson
2010/0304842 A1 12/2010 Friedman et al.
2011/0009177 A1 1/2011 Katz
2011/0009178 A1 1/2011 Gerson
2011/0045894 A1* 2/2011 Owen ..... G07F 17/3244 463/25
2011/0045896 A1 2/2011 Sak et al.
2011/0070945 A1 3/2011 Walker
2011/0077087 A1 3/2011 Walker et al.
2011/0082571 A1 4/2011 Murdock et al.
2011/0105206 A1 5/2011 Rowe et al.
2011/0107239 A1 5/2011 Adoni
2011/0109454 A1 5/2011 McSheffrey
2011/0111820 A1 5/2011 Filipour
2011/0111824 A1* 5/2011 Cuddy ..... G07F 17/3239 463/20
2011/0111837 A1 5/2011 Gagner
2011/0111841 A1 5/2011 Tessmer
2011/0118011 A1 5/2011 Filipour et al.
2011/0201413 A1 8/2011 Oberberger
2011/0207523 A1 8/2011 Filipour et al.
2011/0212766 A1 9/2011 Bowers
2011/0212767 A1 9/2011 Barclay
2011/0218028 A1 9/2011 Acres
2011/0218035 A1 9/2011 Thomas
2011/0230258 A1 9/2011 Van Luchene
2011/0230260 A1 9/2011 Morrow et al.
2011/0230267 A1 9/2011 Van Luchene
2011/0244944 A1 10/2011 Baerlocher
2011/0263312 A1 10/2011 De Waal
2011/0269522 A1 11/2011 Nicely et al.
2011/0275440 A1 11/2011 Faktor
2011/0287828 A1 11/2011 Anderson et al.
2011/0287841 A1 11/2011 Watanabe
2011/0312408 A1 12/2011 Okuaki
2011/0319169 A1 12/2011 Lam
2012/0004747 A1 1/2012 Kelly
2012/0028718 A1 2/2012 Barclay et al.
2012/0058814 A1 3/2012 Lutnick
2012/0077569 A1 3/2012 Watkins
2012/0108323 A1 5/2012 Kelly
2012/0115581 A1 5/2012 Englman et al.
2012/0135793 A1 5/2012 Antonopoulos
2012/0202587 A1 8/2012 Allen
2012/0302311 A1 11/2012 Luciano
2012/0322545 A1 12/2012 Arnone et al.
2013/0029760 A1 1/2013 Wickett
2013/0131848 A1 5/2013 Amone et al.
2013/0190074 A1 7/2013 Amone et al.
2013/0225268 A1* 8/2013 Caputo ..... G07F 17/323 463/25
2013/0260869 A1 10/2013 Leandro et al.
2013/0273986 A1 10/2013 Arnone et al.
2013/0274012 A1* 10/2013 Aoki ..... G07F 17/323 463/31
2014/0087801 A1 3/2014 Nicely et al.
2014/0087808 A1* 3/2014 Basallo ..... G07F 17/3262 463/16
2014/0087809 A1 3/2014 Leupp et al.
2014/0357350 A1 12/2014 Weingardt et al.
2015/0348356 A1* 12/2015 Loyed ..... G07F 17/3204 463/31
2016/0019750 A1* 1/2016 Arnone ..... G07F 17/3267 463/42
2016/0125697 A1 5/2016 Oberberger
2016/0253869 A1* 9/2016 Arnone ..... G07F 17/3244 463/25
2016/0284165 A1* 9/2016 Arnone ..... G07F 17/3295
2016/0343211 A1 11/2016 Goldman et al.
2017/0084126 A1* 3/2017 Caputo ..... G07F 17/3267

(56) References Cited

U.S. PATENT DOCUMENTS

2017/0148271 A1 5/2017 Graboyes Goldman et al.
2017/0249803 A1* 8/2017 Arnone ..... G07F 17/3244
2018/0374313 A1* 12/2018 Cire ..... G07F 17/3276

OTHER PUBLICATIONS

U.S. Appl. No. 14/205,306 Arnone, et al., filed Mar. 11, 2014.
U.S. Appl. No. 14/209,485 Arnone, et al., filed Mar. 13, 2014.
U.S. Appl. No. 14/214,310 Arnone, et al., filed Mar. 14, 2014.
U.S. Appl. No. 14/222,520 Arnone, et al., filed Mar. 21, 2014.
U.S. Appl. No. 14/253,813 Arnone, et al., filed Apr. 15, 2014.
U.S. Appl. No. 14/255,253 Arnone, et al., filed Apr. 17, 2014.
U.S. Appl. No. 14/255,919 Arnone, et al. filed Apr. 17, 2014.
U.S. Appl. No. 14/263,988 Arnone, et al. filed Apr. 28, 2014.
U.S. Appl. No. 14/270,335 Arnone, et al. filed May 5, 2014.
U.S. Appl. No. 14/271,360 Arnone, et al. filed May 6, 2014.
U.S. Appl. No. 13/961,849 Arnone, et al. filed Aug. 7, 2013.
U.S. Appl. No. 13/746,850 Arnone, et al. filed Jan. 22, 2013.
U.S. Appl. No. 14/288,169 Arnone, et al. filed May 27, 2014.
U.S. Appl. No. 14/304,027 Arnone, et al. filed Jun. 13, 2014.
U.S. Appl. No. 14/306,187 Arnone, et al. filed Jun. 16, 2014.
U.S. Appl. No. 14/312,623 Arnone, et al. filed Jun. 23, 2014.
U.S. Appl. No. 14/330,249 Arnone, et al. filed Jul. 14, 2014.
U.S. Appl. No. 14/339,142 Arnone, et al. filed Jul. 23, 2014.
U.S. Appl. No. 14/458,206 Arnone, et al. filed Aug. 12, 2014.
U.S. Appl. No. 14/461,344 Arnone, et al. filed Aug. 15, 2014.
U.S. Appl. No. 14/462,516 Arnone, et al. filed Aug. 18, 2014.
U.S. Appl. No. 14/467,646 Meyerhofer, et al. filed Aug. 25, 2014.
U.S. Appl. No. 14/474,023 Arnone, et al. filed Aug. 29, 2014.
U.S. Appl. No. 14/486,895 Arnone, et al. filed Sep. 15, 2014.
U.S. Appl. No. 14/507,206 Arnone, et al. filed Oct. 6, 2014.
U.S. Appl. No. 14/521,338 Arnone, et al. filed Oct. 22, 2014.
U.S. Appl. No. 14/535,808 Arnone, et al. filed Nov. 7, 2014.
U.S. Appl. No. 14/535,816 Arnone, et al. filed Nov. 7, 2014.
U.S. Appl. No. 14/536,231 Arnone, et al. filed Nov. 7, 2014.
U.S. Appl. No. 14/536,280 Arnone, et al. filed Nov. 7, 2014.
U.S. Appl. No. 14/549,137 Arnone, et al. filed Nov. 20, 2014.
U.S. Appl. No. 14/550,802 Arnone, et al. filed Nov. 21, 2014.
U.S. Appl. No. 14/555,401 Arnone, et al. filed Nov. 26, 2014.
U.S. Appl. No. 14/559,840 Arnone, et al. filed Dec. 3, 2014.
U.S. Appl. No. 14/564,834 Arnone, et al. filed Dec. 9, 2014.
U.S. Appl. No. 14/570,746 Arnone, et al. filed Dec. 15, 2014.
U.S. Appl. No. 14/570,857 Arnone, et al. filed Dec. 15, 2014.
U.S. Appl. No. 14/586,626 Arnone, et al. filed Dec. 30, 2014.
U.S. Appl. No. 14/586,639 Arnone, et al. filed Dec. 30, 2014.
U.S. Appl. No. 14/185,847 Arnone, et al., filed Feb. 20, 2014.
U.S. Appl. No. 14/203,459 Arnone, et al., filed Mar. 10, 2014.
U.S. Appl. No. 14/205,272 Arnone, et al., filed Mar. 11, 2014.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
U.S. Appl. No. 13/686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 13/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
U.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.
U.S. Appl. No. 16/108,049 Arnone, et al. filed Aug. 21, 2018.
U.S. Appl. No. 16/108,052 Arnone, et al. filed Aug. 21, 2018.
U.S. Appl. No. 16/108,056 Arnone, et al. filed Aug. 21, 2018.
U.S. Appl. No. 15/651,934 Arnone, et al. filed Jul. 17, 2017.
U.S. Appl. No. 15/657,826 Arnone, et al. filed Jul. 24, 2017.
U.S. Appl. No. 15/657,835 Arnone, et al. filed Jul. 24, 2017.
U.S. Appl. No. 15/664,535 Arnone, et al. filed Jul. 31, 2017.
U.S. Appl. No. 15/667,168 Arnone, et al. filed Aug. 2, 2017.
U.S. Appl. No. 15/670,492 Arnone, filed Aug. 7, 2017.
U.S. Appl. No. 15/681,966 Arnone, et al. filed Aug. 21, 2017.
U.S. Appl. No. 15/681,970 Arnone, et al. filed Aug. 21, 2017.
U.S. Appl. No. 15/681,978 Arnone, et al. filed Aug. 21, 2017.
U.S. Appl. No. 15/687,922 Arnone, et al. filed Aug. 28, 2017.
U.S. Appl. No. 15/687,927 Arnone, et al. filed Aug. 28, 2017.
U.S. Appl. No. 15/694,520 Arnone, et al. filed Sep. 1, 2017.
U.S. Appl. No. 15/694,738 Arnone, et al. filed Sep. 1, 2017.
U.S. Appl. No. 15/700,022 Arnone, et al. filed Sep. 8, 2017.
U.S. Appl. No. 15/713,595 Arnone, et al. filed Sep. 22, 2017.
U.S. Appl. No. 15/714,896 Arnone, et al. filed Sep. 25, 2017.
U.S. Appl. No. 15/714,902 Arnone, et al. filed Sep. 25, 2017.
U.S. Appl. No. 15/715,144 Arnone, et al. filed Sep. 25, 2017.
U.S. Appl. No. 15/716,317 Arnone, et al. filed Sep. 26, 2017.
U.S. Appl. No. 15/716,318 Arnone, et al. filed Sep. 26, 2017.
U.S. Appl. No. 15/728,096 Arnone, et al. filed Oct. 9, 2017.
U.S. Appl. No. 15/784,961 Arnone, et al. filed Oct. 16, 2017.
U.S. Appl. No. 15/790,482 Arnone, et al. filed Oct. 23, 2017.
U.S. Appl. No. 15/794,712 Arnone, et al. filed Oct. 26, 2017.
U.S. Appl. No. 15/797,571 Arnone, et al. filed Oct. 30, 2017.
U.S. Appl. No. 15/804,413 Arnone, et al. filed Nov. 6, 2017.
U.S. Appl. No. 15/811,412 Arnone, et al. filed Nov. 13, 2017.
U.S. Appl. No. 15/811,419 Arnone, et al. filed Nov. 13, 2017.
U.S. Appl. No. 15/815,629 Arnone, et al. filed Nov. 16, 2017.
U.S. Appl. No. 15/822,908 Arnone, et al. filed Nov. 27, 2017.
U.S. Appl. No. 15/822,912 Arnone, et al. filed Nov. 27, 2017.
U.S. Appl. No. 15/830,614 Arnone, et al. filed Dec. 4, 2017.
U.S. Appl. No. 15/834,006 Arnone, et al. filed Dec. 6, 2017.
U.S. Appl. No. 15/837,795 Arnone, et al. filed Dec. 11, 2017.
U.S. Appl. No. 15/845,433 Arnone, et al. filed Dec. 18, 2017.
U.S. Appl. No. 15/858,817 Arnone, et al. filed Dec. 29, 2017.
U.S. Appl. No. 15/858,826 Arnone, et al. filed Dec. 29, 2017.
U.S. Appl. No. 15/862,329 Arnone, et al. filed Jan. 4, 2018.
U.S. Appl. No. 15/864,737 Arnone, et al. filed Jan. 8, 2018.
U.S. Appl. No. 15/882,328 Arnone, et al. filed Jan. 29, 2018.
U.S. Appl. No. 15/882,333 Arnone, et al. filed Jan. 29, 2018.
U.S. Appl. No. 15/882,428 Arnone, et al. filed Jan. 29, 2018.
U.S. Appl. No. 15/882,447 Arnone, et al. filed Jan. 29, 2018.
U.S. Appl. No. 15/882,850 Arnone, et al. filed Jan. 29, 2018.
U.S. Appl. No. 15/882,902 Arnone, et al. filed Jan. 29, 2018.
U.S. Appl. No. 15/888,512 Arnone, et al. filed Feb. 5, 2018.
U.S. Appl. No. 15/894,398 Arnone, et al. filed Feb. 12, 2018.

(56) References Cited

OTHER PUBLICATIONS

U.S. Appl. No. 15/912,019 Arnone, et al. filed Mar. 5, 2018.
U.S. Appl. No. 15/912,026 Arnone, et al. filed Mar. 5, 2018.
U.S. Appl. No. 15/912,529 Arnone, et al. filed Mar. 5, 2018.
U.S. Appl. No. 15/063,365 Arnone, et al. filed Mar. 7, 2016.
U.S. Appl. No. 15/063,496 Arnone, et al. filed Mar. 7, 2016.
U.S. Appl. No. 15/073,602 Arnone, et al. filed Mar. 17, 2016.
U.S. Appl. No. 15/074,999 Arnone, et al. filed Mar. 18, 2016.
U.S. Appl. No. 15/077,574 Arnone, et al. filed Mar. 22, 2016.
U.S. Appl. No. 15/083,284 Arnone, et al. filed Mar. 28, 2016.
U.S. Appl. No. 15/091,395 Arnone, et al. filed Apr. 5, 2016.
U.S. Appl. No. 15/093,685 Arnone, et al. filed Apr. 7, 2016.
U.S. Appl. No. 15/098,287 Arnone, et al. filed Apr. 13, 2016.
U.S. Appl. No. 15/098,313 Arnone, et al. filed Apr. 13, 2016.
U.S. Appl. No. 15/130,101 Arnone, et al. filed Apr. 15, 2016.
U.S. Appl. No. 15/133,624 Arnone, et al. filed Apr. 20, 2016.
U.S. Appl. No. 15/134,852 Arnone, et al. filed Apr. 21, 2016.
U.S. Appl. No. 15/139,148 Arnone, et al. filed Apr. 26, 2016.
U.S. Appl. No. 15/141,784 Arnone, et al. filed Apr. 29, 2016.
U.S. Appl. No. 15/155,107 Arnone, et al. filed May 16, 2016.
U.S. Appl. No. 15/156,222 Arnone, et al. filed May 16, 2016.
U.S. Appl. No. 15/158,530 Arnone, et al. filed May 18, 2016.
U.S. Appl. No. 15/161,174 Arnone, et al. filed May 20, 2016.
U.S. Appl. No. 15/170,773 Arnone, et al. filed Jun. 1, 2016.
U.S. Appl. No. 15/174,995 Arnone, et al. filed Jun. 6, 2016.
U.S. Appl. No. 15/179,940 Arnone, et al. filed Jun. 10, 2016.
U.S. Appl. No. 15/189,797 Arnone, et al. filed Jun. 22, 2016.
U.S. Appl. No. 15/190,745 Arnone, et al. filed Jun. 23, 2016.
U.S. Appl. No. 15/191,050 Arnone, et al. filed Jun. 23, 2016.
U.S. Appl. No. 15/219,257 Arnone, et al. filed Jul. 25, 2016.
U.S. Appl. No. 15/227,881 Arnone, et al. filed Aug. 3, 2016.
U.S. Appl. No. 15/241,683 Arnone, et al. filed Aug. 19, 2016.
U.S. Appl. No. 15/245,040 Arnone, et al. filed Aug. 23, 2016.
U.S. Appl. No. 15/233,294 Arnone, et al. filed Aug. 10, 2016.
U.S. Appl. No. 15/252,190 Arnone, et al. filed Aug. 30, 2016.
U.S. Appl. No. 15/255,789 Arnone, et al. filed Sep. 2, 2016.
U.S. Appl. No. 15/261,858 Arnone, et al. filed Sep. 9, 2016.
U.S. Appl. No. 15/264,521 Arnone, et al. filed Sep. 13, 2016.
U.S. Appl. No. 15/264,557 Arnone, et al. filed Sep. 13, 2016.
U.S. Appl. No. 15/271,214 Arnone, et al. filed Sep. 20, 2016.
U.S. Appl. No. 15/272,318 Arnone, et al. filed Sep. 21, 2016.
U.S. Appl. No. 15/273,260 Arnone, et al. filed Sep. 22, 2016.
U.S. Appl. No. 15/276,469 Arnone, et al. filed Sep. 26, 2016.
U.S. Appl. No. 15/280,255 Arnone, et al. filed Sep. 29, 2016.
U.S. Appl. No. 15/286,922 Arnone, et al. filed Oct. 6, 2016.
U.S. Appl. No. 15/287,129 Arnone, et al. filed Oct. 6, 2016.
U.S. Appl. No. 15/289,648 Arnone, et al. filed Oct. 10, 2016.
U.S. Appl. No. 15/297,019 Arnone, et al. filed Oct. 18, 2016.
U.S. Appl. No. 15/298,533 Arnone, et al. filed Oct. 20, 2016.
U.S. Appl. No. 15/336,696 Arnone, et al. filed Oct. 27, 2016.
U.S. Appl. No. 15/339,898 Arnone, et al. filed Oct. 31, 2016.
U.S. Appl. No. 15/345,451 Arnone, et al. filed Nov. 7, 2016.
U.S. Appl. No. 14/799,481 Arnone, et al. filed Jul. 14, 2015.
U.S. Appl. No. 15/362,214 Arnone, et al. filed Nov. 28, 2016.
U.S. Appl. No. 15/920,374 Arnone, et al. filed Mar. 13, 2018.
U.S. Appl. No. 15/920,380 Arnone, et al. filed Mar. 13, 2018.
U.S. Appl. No. 15/920,388 Arnone, et al. filed Mar. 13, 2018.
U.S. Appl. No. 15/920,390 Arnone, et al. filed Mar. 13, 2018.
U.S. Appl. No. 15/922,816 Arnone, et al. filed Mar. 15, 2018.
U.S. Appl. No. 15/922,905 Arnone, et al. filed Mar. 15, 2018.
U.S. Appl. No. 15/925,268 Arnone, et al. filed Mar. 19, 2018.
U.S. Appl. No. 15/925,751 Arnone, et al. filed Mar. 19, 2018.
U.S. Appl. No. 15/933,319 Arnone, et al. filed Mar. 22, 2018.
U.S. Appl. No. 15/935,956 Arnone, et al. filed Mar. 26, 2018.
U.S. Appl. No. 15/943,207 Arnone, et al. filed Apr. 2, 2018.
U.S. Appl. No. 15/948,607 Arnone, et al. filed Apr. 9, 2018.
U.S. Appl. No. 15/949,812 Arnone, et al. filed Apr. 10, 2018.
U.S. Appl. No. 15/951,155 Arnone, et al. filed Apr. 11, 2018.
U.S. Appl. No. 15/954,094 Arnone, et al. filed Apr. 16, 2018.
U.S. Appl. No. 15/954,136 Arnone, et al. filed Apr. 16, 2018.
U.S. Appl. No. 15/961,375 Arnone, et al. filed Apr. 24, 2018.
U.S. Appl. No. 15/961,382 Arnone, et al. filed Apr. 24, 2018.
U.S. Appl. No. 15/966,590 Arnone, et al. filed Apr. 30, 2018.
U.S. Appl. No. 15/968,723 Arnone, et al. filed May 1, 2018.
U.S. Appl. No. 15/971,288 Arnone, et al. filed May 4, 2018.
U.S. Appl. No. 15/978,087 Arnone, et al. filed May 11, 2018.
U.S. Appl. No. 15/979,391 Arnone, et al. filed May 14, 2018.
U.S. Appl. No. 15/984,168 Arnone, et al. filed May 18, 2018.
U.S. Appl. No. 15/991,576 Arnone, et al. filed May 29, 2018.
U.S. Appl. No. 15/991,594 Arnone, et al. filed May 29, 2018.
U.S. Appl. No. 15/996,906 Arnone, et al. filed Jun. 4, 2018.
U.S. Appl. No. 16/005,017 Arnone, et al. filed Jun. 11, 2018.
U.S. Appl. No. 16/005,108 Arnone, et al. filed Jun. 11, 2018.
U.S. Appl. No. 16/011,110 Arnone, et al. filed Jun. 18, 2018.
U.S. Appl. No. 16/011,116 Arnone, et al. filed Jun. 18, 2018.
U.S. Appl. No. 16/017,976 Arnone, et al. filed Jun. 25, 2018.
U.S. Appl. No. 16/025,380 Arnone, et al. filed Jul. 2, 2018.
U.S. Appl. No. 16/030,289 Arnone, et al. filed Jul. 9, 2018.
U.S. Appl. No. 16/030,294 Arnone, et al. filed Jul. 9, 2018.
U.S. Appl. No. 16/036,269 Arnone, et al. filed Jul. 16, 2018.
U.S. Appl. No. 16/036,388 Arnone, et al. filed Jul. 16, 2018.
U.S. Appl. No. 16/036,393 Arnone, et al. filed Jul. 16, 2018.
U.S. Appl. No. 16/036,925 Arnone, et al. filed Jul. 16, 2018.
U.S. Appl. No. 16/039,322 Arnone, et al. filed Jul. 18, 2018.
U.S. Appl. No. 16/040,485 Arnone, et al. filed Jul. 19, 2018.
U.S. Appl. No. 16/042,488 Arnone, et al. filed Jul. 23, 2018.
U.S. Appl. No. 16/042,493 Arnone, et al. filed Jul. 23, 2018.
U.S. Appl. No. 16/048,893 Arnone, et al. filed Jul. 30, 2018.
U.S. Appl. No. 16/049,029 Arnone, et al. filed Jul. 30, 2018.
U.S. Appl. No. 16/057,400 Arnone, et al. filed Aug. 7, 2018.
U.S. Appl. No. 16/057,403 Arnone, et al. filed Aug. 7, 2018.
U.S. Appl. No. 16/102,003 Arnone, et al. filed Aug. 13, 2018.
U.S. Appl. No. 16/102,010 Arnone, et al. filed Aug. 13, 2018.
U.S. Appl. No. 16/102,044 Arnone, et al. filed Aug. 13, 2018.
U.S. Appl. No. 14/586,645 Arnone, et al. filed Dec. 30, 2014.
U.S. Appl. No. 14/598,151 Arnone, et al. filed Jan. 15, 2015.
U.S. Appl. No. 14/601,063 Arnone, et al. filed Jan. 20, 2015.
U.S. Appl. No. 14/601,108 Arnone, et al. filed Jan. 20, 2015.
U.S. Appl. No. 14/608,000 Arnone, et al. filed Jan. 28, 2015.
U.S. Appl. No. 14/608,087 Arnone, et al. filed Jan. 28, 2015.
U.S. Appl. No. 14/608,093 Arnone, et al. filed Jan. 28, 2015.
U.S. Appl. No. 14/610,897 Arnone, et al. filed Jan. 30, 2015.
U.S. Appl. No. 14/611,077 Arnone, et al. filed Jan. 30, 2015.
U.S. Appl. No. 14/604,629 Arnone, et al. filed Jan. 23, 2015.
U.S. Appl. No. 14/625,475 Arnone, et al. filed Feb. 18, 2015.
U.S. Appl. No. 14/617,852 Arnone, et al. filed Feb. 9, 2015.
U.S. Appl. No. 14/627,428 Arnone, et al. filed Feb. 20, 2015.
U.S. Appl. No. 14/642,427 Arnone, et al. filed Mar. 9, 2015.
U.S. Appl. No. 14/665,991 Arnone, et al. filed Mar. 23, 2015.
U.S. Appl. No. 14/666,010 Arnone, et al. filed Mar. 23, 2015.
U.S. Appl. No. 14/666,022 Arnone, et al. filed Mar. 23, 2015.
U.S. Appl. No. 14/642,623 Arnone, et al. filed Mar. 9, 2015.
U.S. Appl. No. 14/663,337 Arnone, et al. filed Mar. 19, 2015.
U.S. Appl. No. 14/666,284 Arnone, et al. filed Mar. 23, 2015.
U.S. Appl. No. 14/679,885 Arnone, et al. filed Apr. 6, 2015.
U.S. Appl. No. 14/685,378 Arnone, et al. filed Apr. 13, 2015.
U.S. Appl. No. 14/686,675 Arnone, et al. filed Apr. 14, 2015.
U.S. Appl. No. 14/686,678 Arnone, et al. filed Apr. 14, 2015.
U.S. Appl. No. 14/701,430 Arnone, et al. filed Apr. 30, 2015.
U.S. Appl. No. 14/703,721 Arnone, et al. filed May 4, 2015.
U.S. Appl. No. 14/708,138 Arnone, et al. filed May 8, 2015.
U.S. Appl. No. 14/708,141 Arnone, et al. filed May 8, 2015.
U.S. Appl. No. 14/708,160 Arnone, et al. filed May 8, 2015.
U.S. Appl. No. 14/708,161 Arnone, et al. filed May 8, 2015.
U.S. Appl. No. 14/708,162 Arnone, et al. filed May 8, 2015.
U.S. Appl. No. 14/710,483 Arnone, et al. filed May 12, 2015.
U.S. Appl. No. 14/714,084 Arnone, et al. filed May 15, 2015.
U.S. Appl. No. 14/715,463 Arnone, et al. filed May 18, 2015.
U.S. Appl. No. 14/720,620 Arnone, et al. filed May 22, 2015.
U.S. Appl. No. 14/720,624 Arnone, et al. filed May 22, 2015.
U.S. Appl. No. 14/720,626 Arnone, et al. filed May 22, 2015.
U.S. Appl. No. 14/727,726 Arnone, et al. filed Jun. 1, 2015.
U.S. Appl. No. 14/730,183 Arnone, et al. filed Jun. 3, 2015.

(56) References Cited

OTHER PUBLICATIONS

U.S. Appl. No. 14/731,321 Arnone, et al. filed Jun. 4, 2015.
U.S. Appl. No. 14/740,078 Arnone, et al. filed Jun. 15, 2015.
U.S. Appl. No. 14/742,517 Arnone, et al. filed Jun. 17, 2015.
U.S. Appl. No. 14/743,708 Arnone, et al. filed Jun. 18, 2015.
U.S. Appl. No. 14/746,731 Arnone, et al. filed Jun. 22, 2015.
U.S. Appl. No. 14/748,122 Arnone, et al. filed Jun. 23, 2015.
U.S. Appl. No. 14/788,581 Arnone, et al. filed Jun. 30, 2015.
U.S. Appl. No. 14/793,685 Arnone, et al. filed Jul. 7, 2015.
U.S. Appl. No. 14/793,704 Arnone, et al. filed Jul. 7, 2015.
U.S. Appl. No. 14/797,016 Arnone, et al. filed Jul. 10, 2015.
U.S. Appl. No. 14/815,764 Arnone, et al. filed Jul. 31, 2015.
U.S. Appl. No. 14/815,774 Arnone, et al. filed Jul. 31, 2015.
U.S. Appl. No. 14/817,032 Arnone, et al. filed Aug. 3, 2015.
U.S. Appl. No. 14/822,890 Arnone, et al. filed Aug. 10, 2015.
U.S. Appl. No. 14/823,951 Arnone, et al. filed Aug. 11, 2015.
U.S. Appl. No. 14/823,987 Arnone, et al. filed Aug. 11, 2015.
U.S. Appl. No. 14/825,056 Arnone, et al. filed Aug. 12, 2015.
U.S. Appl. No. 14/835,590 Arnone, et al. filed Aug. 25, 2015.
U.S. Appl. No. 14/836,902 Arnone, et al. filed Aug. 26, 2015.
U.S. Appl. No. 14/839,647 Arnone, et al. filed Aug. 28, 2015.
U.S. Appl. No. 14/842,684 Arnone, et al. filed Sep. 1, 2015.
U.S. Appl. No. 14/842,785 Arnone, et al. filed Sep. 1, 2015.
U.S. Appl. No. 14/854,021 Arnone, et al. filed Sep. 14, 2015.
U.S. Appl. No. 14/855,322 Arnone, et al. filed Sep. 15, 2015.
U.S. Appl. No. 14/859,065 Arnone, et al. filed Sep. 18, 2015.
U.S. Appl. No. 14/865,422 Arnone, et al. filed Sep. 25, 2015.
U.S. Appl. No. 14/867,809 Arnone, et al. filed Sep. 28, 2015.
U.S. Appl. No. 14/868,287 Arnone, et al. filed Sep. 28, 2015.
U.S. Appl. No. 14/868,364 Arnone, et al. filed Sep. 28, 2015.
U.S. Appl. No. 14/869,809 Arnone, et al. filed Sep. 29, 2015.
U.S. Appl. No. 14/869,819 Arnone, et al. filed Sep. 29, 2015.
U.S. Appl. No. 14/885,894 Arnone, et al. filed Oct. 16, 2015.
U.S. Appl. No. 14/919,665 Arnone, et al. filed Oct. 21, 2015.
U.S. Appl. No. 14/942,844 Arnone, et al. filed Nov. 16, 2015.
U.S. Appl. No. 14/942,883 Arnone, et al. filed Nov. 16, 2015.
U.S. Appl. No. 14/949,759 Arnone, et al. filed Nov. 23, 2015.
U.S. Appl. No. 14/952,758 Arnone, et al. filed Nov. 25, 2015.
U.S. Appl. No. 14/952,769 Arnone, et al. filed Nov. 25, 2015.
U.S. Appl. No. 14/954,922 Arnone, et al. filed Nov. 30, 2015.
U.S. Appl. No. 14/954,931 Arnone, et al. filed Nov. 30, 2015.
U.S. Appl. No. 14/955,000 Arnone, et al. filed Nov. 30, 2015.
U.S. Appl. No. 14/956,301 Arnone, et al. filed Dec. 1, 2015.
U.S. Appl. No. 14/965,231 Arnone, et al. filed Dec. 10, 2015.
U.S. Appl. No. 14/965,846 Arnone, et al. filed Dec. 10, 2015.
U.S. Appl. No. 14/981,640 Arnone, et al. filed Dec. 28, 2015.
U.S. Appl. No. 14/981,775 Arnone, et al. filed Dec. 28, 2015.
U.S. Appl. No. 14/984,943 Arnone, et al. filed Dec. 30, 2015.
U.S. Appl. No. 14/984,965 Arnone, et al. filed Dec. 30, 2015.
U.S. Appl. No. 14/984,978 Arnone, et al. filed Dec. 30, 2015.
U.S. Appl. No. 14/985,107 Arnone, et al. filed Dec. 30, 2015.
U.S. Appl. No. 14/995,151 Arnone, et al. filed Jan. 13, 2016.
U.S. Appl. No. 14/974,432 Arnone, et al. filed Dec. 18, 2015.
U.S. Appl. No. 14/997,413 Arnone, et al. filed Jan. 15, 2016.
U.S. Appl. No. 15/002,233 Arnone, et al. filed Jan. 20, 2016.
U.S. Appl. No. 15/005,944 Arnone, et al. filed Jan. 25, 2016.
U.S. Appl. No. 15/011,322 Arnone, et al. filed Jan. 29, 2016.
U.S. Appl. No. 15/051,535 Arnone, et al. filed Feb. 23, 2016.
U.S. Appl. No. 15/053,236 Arnone, et al. filed Feb. 25, 2016.
U.S. Appl. No. 15/057,095 Arnone, et al. filed Feb. 29, 2016.
U.S. Appl. No. 15/060,502 Arnone, et al. filed Mar. 3, 2016.
U.S. Appl. No. 15/362,660 Arnone, et al. filed Nov. 28, 2016.
U.S. Appl. No. 15/365,628 Arnone, et al. filed Nov. 30, 2016.
U.S. Appl. No. 15/367,541 Arnone, et al. filed Dec. 2, 2016.
U.S. Appl. No. 15/369,394 Arnone, et al. filed Dec. 5, 2016.
U.S. Appl. No. 15/370,425 Arnone, et al. filed Dec. 6, 2016.
U.S. Appl. No. 15/375,711 Arnone, et al. filed Dec. 12, 2016.
U.S. Appl. No. 15/387,117 Arnone, et al. filed Dec. 21, 2016.
U.S. Appl. No. 15/392,887 Arnone, et al. filed Dec. 28, 2016.
U.S. Appl. No. 15/393,212 Arnone, et al. filed Dec. 28, 2016.
U.S. Appl. No. 15/394,257 Arnone, et al. filed Dec. 29, 2016.
U.S. Appl. No. 15/396,352 Arnone, et al. filed Dec. 30, 2016.
U.S. Appl. No. 15/396,354 Arnone, et al. filed Dec. 30, 2016.
U.S. Appl. No. 15/396,365 Arnone, et al. filed Dec. 30, 2016.
U.S. Appl. No. 15/406,474 Arnone, et al. filed Jan. 13, 2017.
U.S. Appl. No. 15/413,322 Arnone, et al. filed Jan. 23, 2017.
U.S. Appl. No. 15/415,833 Arnone, et al. filed Jan. 25, 2017.
U.S. Appl. No. 15/417,030 Arnone, et al. filed Jan. 26, 2017.
U.S. Appl. No. 15/422,453 Arnone, et al. filed Feb. 1, 2017.
U.S. Appl. No. 15/431,631 Arnone, et al. filed Feb. 13, 2017.
U.S. Appl. No. 15/434,843 Arnone, et al. filed Feb. 16, 2017.
U.S. Appl. No. 15/439,499 Arnone, et al. filed Feb. 22, 2017.
U.S. Appl. No. 15/449,249 Arnone, et al. filed Mar. 3, 2017.
U.S. Appl. No. 15/449,256 Arnone, et al. filed Mar. 3, 2017.
U.S. Appl. No. 15/450,287 Arnone, et al. filed Mar. 6, 2017.
U.S. Appl. No. 15/456,079 Arnone, et al. filed Mar. 10, 2017.
U.S. Appl. No. 15/457,827 Arnone, et al. filed Mar. 13, 2017.
U.S. Appl. No. 15/458,490 Arnone, et al. filed Mar. 14, 2017.
U.S. Appl. No. 15/460,195 Arnone, et al. filed Mar. 15, 2017.
U.S. Appl. No. 15/463,725 Arnone, et al. filed Mar. 20, 2017.
U.S. Appl. No. 15/464,282 Arnone, et al. filed Mar. 20, 2017.
U.S. Appl. No. 15/465,521 Arnone, et al. filed Mar. 21, 2017.
U.S. Appl. No. 15/470,869 Arnone, et al. filed Mar. 27, 2017.
U.S. Appl. No. 15/473,523 Arnone, et al. filed Mar. 29, 2017.
U.S. Appl. No. 15/483,773 Arnone, et al. filed Apr. 10, 2017.
U.S. Appl. No. 15/489,343 Arnone, et al. filed Apr. 17, 2017.
U.S. Appl. No. 15/491,617 Arnone, et al. filed Apr. 19, 2017.
U.S. Appl. No. 15/583,295 Arnone, et al. filed May 1, 2017, 2017.
U.S. Appl. No. 15/589,780 Arnone, et al. filed May 8, 2017.
U.S. Appl. No. 15/597,123 Arnone, et al. filed May 16, 2017.
U.S. Appl. No. 15/597,812 Arnone, et al. filed May 17, 2017.
U.S. Appl. No. 15/599,590 Arnone, et al. filed May 19, 2017.
U.S. Appl. No. 15/605,688 Arnone, et al. filed May 25, 2017.
U.S. Appl. No. 15/605,705 Arnone, et al. filed May 25, 2017.
U.S. Appl. No. 15/626,754 Arnone, et al. filed Jun. 19, 2017.
U.S. Appl. No. 15/631,762 Arnone, et al. filed Jun. 23, 2017.
U.S. Appl. No. 15/632,478 Arnone, et al. filed Jun. 26, 2017.
U.S. Appl. No. 15/632,479 Arnone, et al. filed Jun. 26, 2017.
U.S. Appl. No. 15/632,943 Arnone, et al. filed Jun. 26, 2017.
U.S. Appl. No. 15/632,950 Arnone, et al. filed Jun. 26, 2017.
U.S. Appl. No. 15/641,119 Arnone, et al. filed Jul. 3, 2017.

* cited by examiner

| | | |
|---|---|---|
| *10* | ? | ? |
| ? | 0 | ? |
| 5 | ? | ? |

1406

FIG. 14B

| | | |
|---|---|---|
| *10* | ? | ? |
| ? | 0 | ? |
| 5 | ? | **30** |

1408

1409

FIG. 14C

| | | |
|---|---|---|
| *10* | **0** | **10** |
| **10** | 0 | **5** |
| 5 | **5** | **30** |

1410

FIG. 14D

OUTCOME SELECTOR INTERACTIVE WAGERING SYSTEM

CROSS REFERENCE TO RELATED APPLICATIONS

This application claims the benefit of U.S. Provisional Patent Application No. 62/557,599, filed Sep. 12, 2017, U.S. Provisional Patent Application No. 62/576,544, filed Oct. 24, 2017, and U.S. Provisional Patent Application No. 62/683,549, filed Jun. 11, 2018, the contents of each of which are incorporated by reference herein.

FIELD OF THE INVENTION

Embodiments of the invention are generally related to data processing systems. More particularly, embodiments of the invention relate to data processing systems that implement interactive wagering processes.

BACKGROUND

The gaming industry has traditionally developed data processing systems that implement simple wagering processes. However, more complicated wagering processes need data processing systems that are better suited for implementing these more complicated wagering processes. Various aspects of embodiments of the invention meet such a need.

SUMMARY OF THE INVENTION

Systems and methods in accordance with embodiments of the invention provide a communication and data processing apparatuses constructed for an outcome selector interactive wagering system that implements an outcome selector interactive wagering process.

In an embodiment, an outcome selector wagering electronic gaming machine includes an interactive controller constructed to receive from a process controller, two or more selector interactive objectives wherein each of the two or more selector interactive objectives has an associated chance-based outcome, present to a player the two or more selector interactive objectives, detect the player's selection of one of the chance-based outcomes of the selector interactive objectives, and communicate to the process controller, the player's selection of one of the chance-based outcomes. The process controller is operably connected to the interactive controller and the process controller is constructed to generate an initial set of chance-based outcomes having a specified initial expected value and an initial volatility index, determine a highest valued chance-based outcome of the initial set of chance-based outcomes, generate a subsequent set of chance-based outcomes having expected values based on the highest valued chance-based outcome of the initial set of chance-based outcomes and a subsequent volatility index, generate the two or more selector interactive objectives based on a randomization of an order of the initial set of chance-based outcomes and the one or more subsequent sets of chance-based outcomes, communicate the two or more selector interactive objectives to the interactive controller, receive from the interactive controller the player's selection of one of the chance-based outcomes, and award to the player the selected chance-based outcome as a wagering outcome.

In another embodiment, the interactive controller and the process controller are constructed from the same device.

In another embodiment, the process controller is operatively connected to the interactive controller using a communication link.

In another embodiment, the outcome selector wagering electronic gaming machine further includes a credit processing subcontroller.

In another embodiment, the a credit processing subcontroller, the interactive controller, and the process controller are constructed from the same device.

In another embodiment, the outcome selector wagering electronic gaming machine further includes a credit processing subcontroller, and an enclosure constructed to mount: a user input device operatively connected to the interactive controller, a user output device operatively connected to the interactive controller, a credit input device operatively connected to the credit processing subcontroller, and a credit output device operatively connected to the credit processing subcontroller.

In another embodiment, the process controller is further constructed to: communicate with the credit input device to receive a credit input, credit a credit meter with credits based on the incoming credit data, update the credit meter based on the interactive wagering proposition outcome, and communicate with the credit output device to generate a credit output based on credits transferred off of the credit meter.

In another embodiment, an outcome selector wagering electronic gaming machine includes an enclosure constructed to mount: a user input device, a user output device, a credit input device, a credit output device, at least one processor operatively connected to the user input device, the user output device, the credit input device, and the credit output device, and a memory operatively connected to the at least one processor. The memory stores processor executable instructions that when executed by the processor cause the processor to generate an initial set of chance-based outcomes having a specified initial expected value and an initial volatility index, determine a highest valued chance-based outcome of the initial set of chance-based outcomes, generate a subsequent set of chance-based outcomes having expected values based on the highest valued chance-based outcome of the initial set of chance-based outcomes and a subsequent volatility index, generate two or more selector interactive objectives based on a randomization of an order of the initial set of chance-based outcomes and the one or more subsequent sets of chance-based outcomes, present to a player the two or more selector interactive objectives, detect the player's selection of one of the chance-based outcomes of the two or more selector interactive objectives, determine an interactive wagering outcome using the player's selection of one of the chance-based outcomes of the two or more selector interactive objectives, update the credit meter based on the interactive wagering proposition outcome, and communicate with the credit output device to generate a credit output based on credits transferred off of the credit meter.

In an embodiment, an outcome selector interactive wagering system includes an interactive controller that receives data of an interactive objective for an interactive wagering process from a process controller, generates a presentation based on the interactive objective, presents the presentation to a player using a user interface, detects player interactions of the player with the presentation, generates an interactive objective achievement based on the player interactions and the interactive objective, and communicates the interactive objective achievement to the process controller. The process controller is operatively connected to the interactive controller, wherein the process controller is constructed to generate an interactive objective of the interactive wagering process based on the random component, communicate the interactive objective to the interactive controller, and receive an interactive objective achievement for the interactive objective from the interactive controller.

In some embodiments, the interactive controller and the process controller are constructed from the same device.

In various embodiments, the process controller is operatively connected to the interactive controller using a communication link.

In numerous embodiments, outcome selector wagering electronic gaming machine further includes a credit processing subcontroller, and an enclosure constructed to mount a user input device operatively connected to the interactive controller, a user output device operatively connected to the interactive controller, a credit input device operatively connected to the credit processing subcontroller, and a credit output device operatively connected to the credit processing subcontroller.

In some embodiments, the process controller is further constructed to communicate with the credit input device to receive a credit input, credit a credit meter with credits based on the incoming credit data, update the credit meter based on the interactive objective achievement of the wager, and communicate with the credit output device to generate a credit output based on credits transferred off of the credit meter.

In an embodiment, an outcome selector interactive wagering electronic gaming machine includes an enclosure constructed to mount a user input device, a user output device, a credit input device, a credit output device and at least one processor operatively connected to the user input device, the user output device, the credit input device, and the credit output device. The outcome selector wagering electronic gaming machine further includes a memory operatively connected to the at least one processor, the memory storing processor executable instructions that when executed by the processor cause the processor to communicate with the credit input device to receive a credit input, credit a credit meter with credits based on the credit data, generate a random component using a random number generator, generate an interactive objective of an interactive objective of an interactive wagering game based on the random component, generate a player presentation based on the interactive objective, present the player presentation to a player using the user output device, detect player interactions with the player presentation using the user input device, generate an interactive objective achievement based on the player interactions and the interactive objective, update the credit meter based on the interactive objective achievement, and communicate with the credit output device to generate a credit output based on credits transferred off of the credit meter.

In another embodiment, a process controller operates as an interface between an interactive controller that detects interactive objective achievements and a wagering subcontroller that generates a random component and a chance-based outcome. By virtue of this feature, the wagering subcontroller is isolated from the interactive controller allowing the interactive controller to operate in an unregulated environment while allowing the wagering subcontroller to operate in a regulated environment, thus providing for more efficient management of the operations of such a system.

In another embodiment of the invention, a single process controller may provide services to two or more interactive controllers, thus allowing an outcome selector interactive wagering system to operate more efficiently over a large range of scaling.

In another embodiment of the invention, multiple types of interactive controllers using different operating systems may be interfaced to a single type of process controller without requiring customization of the process controller and/or the wagering subcontroller, thus improving the efficiency of the process controller and/or the wagering subcontroller by reducing complexity associated with maintaining separate process controllers and/or wagering subcontrollers for each type of interactive controller.

In another embodiment of the invention, an interactive controller may be provided as a player device under control of a player while maintaining the process controller in an environment under the control of a regulated operator of wagering systems, thus providing for a more economical system as the regulated operator need not expend capital to purchase interactive controllers.

In another embodiment of the invention, data communicated between the controllers may be encrypted to increase security of the outcome selector interactive wagering system.

In another embodiment of the invention, an interactive application may require extensive processing resources from an interactive controller leaving few processing resources for the functions performed by a process controller and/or a wagering subcontroller. By virtue of an architecture of some embodiments of the invention, processing loads may be distributed across multiple devices such that operations of the interactive controller may be dedicated to an interactive application and the processes of the process controller and/or wagering subcontroller are not burdened by the requirements of the interactive application.

In another embodiment of the invention, an outcome selector interactive wagering system operates with its components being distributed across multiple devices. These devices can be connected by communication channels including, but not limited to, local area networks, wide area networks, local communication buses, and/or the like. The devices may communicate using various types of protocols, including but not limited to, networking protocols, device-to-device communications protocols, and the like. In many such embodiments, one or more components of an outcome selector interactive wagering system are distributed in close proximity to each other and communicate using a local area network and/or a communication bus. In several embodiments, an interactive controller and a process controller of an outcome selector interactive wagering system are in a common location. In some embodiments, a process controller communicates with an external interactive controller. In various embodiments, these multiple controllers and subcontrollers can be constructed from or configured using a single device or a plurality of devices such that an outcome selector interactive wagering system is executed as a system in a virtualized space such as, but not limited to, where a wagering subcontroller and a process controller are large scale centralized servers and are operatively connected to distributed interactive controllers via a wide area network such as the Internet or a local area network. In such embodiments, the components of an outcome selector interactive wagering system may communicate using a networking protocol or other type of device-to-device communications protocol.

In another embodiment of the invention, an interactive controller is an interactive server acting as a host for managing head-to-head player interactions over a network of interactive subcontrollers connected to the interactive server using a communication link. The interactive server provides an environment where players or players can compete directly with one another and interact with other players or players.

BRIEF DESCRIPTION OF THE DRAWINGS

FIGS. 14A to 14D illustrate a user interface of an outcome selector of an outcome selector interactive wagering system having multiple volatility indexes in accordance with various embodiments of the invention.

DETAILED DESCRIPTION

Figure 1:
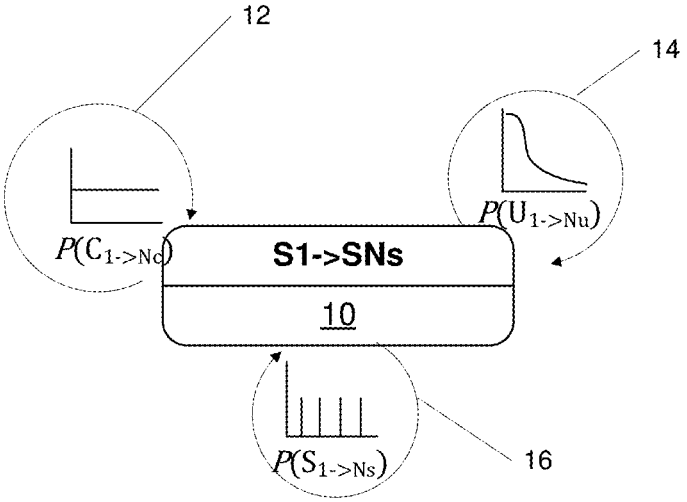
FIG. 1 is a state diagram of an outcome selector interactive wagering system in accordance with various embodiments of the invention.

A wagering game can be modeled using a multidimensional game space or manifold where each random element of the wagering game corresponds to a dimension of the manifold. The wagering game has multiple game states within the game space with a set of wager outcome game states being subset of all of the possible game states within the game space. An example embodiment of a simple wagering game is a mechanical 3 reel slot machine having 22 possible positions on each reel. Such a wagering game can be modeled within a three dimensional game space, that is, where each reel corresponds to a dimension of the three dimensional game space. If there are 22 possible unique values in each dimension, there are 22^3, or 10,648, possible wager outcome game states. Each time the slot machine is played, a single wager outcome game state is determined from a single independent random event, namely the spinning of the mechanical reels.

If such a 3 reel slot machine is implemented on a conventional electronic gaming machine having virtual video reels, each possible wager outcome game state is explicitly enumerated in a paytable that is used to determine a wager outcome state as well as generate an animation of the video virtual reels. Such a paytable will have at least 10,648 locations, one position for each possible combination of the 3 reels, with each location representing a wager outcome game state including both a representation of the stopped position of the 3 reels and an amount of credit to be awarded a player of the wagering game. If digital storage of each wager outcome game state requires 8 bytes of storage, such a paytable can be stored in approximately 83 kilobytes of digital memory (8 bytes for wager outcome game state data×10,648 possible wager outcome game states/1024 Bytes per kilobyte). The digital memory may be either random access memory (RAM) of an internal memory device or virtual memory stored on an external memory device. In operation, a single random number is determined, and that random number is used as an index into the paytable to select a single wager outcome game state from the 10,648 possible wager outcome game states. The wager outcome game state is used to both determine a display of the animated movement of the 3 virtual slot machine reels and a prize in credits to be awarded to a player. Accordingly, approximately 83 kilobytes of memory is needed to store the enumerated wager outcome game states of a simple wagering game having approximately 10 thousand game states on a conventional electronic gaming machine.

In contrast to such simple wagering games, complex wagering games implemented with interactive wagering processes as described herein have sets of wager outcome game states that are many orders of magnitude larger than the sets of wager outcome game states of simple wagering games. In an example embodiment, a complex wagering game has a game feature where chance-based outcomes are displayed to a player as a subset of the possible wager outcome game states where the display includes 9 locations with each location having twenty-two possible chance-based outcomes. Such a complex wagering game feature has 1,207,269,217,792, or over 1.2 trillion, possible wager outcome game states. If 8 bytes of digital memory are used to store each wager outcome game state, then a complete enumeration of all of wager outcome game states would require 9.6 terabytes of memory storage. However, utilization of interactive wagering processes as described herein reduces storage memory requirements for such a complex wagering game feature to less than a 100 kilobytes. Such a reduction in memory requirements reduces the amount of physical and/or virtual memory needed to implement the complex wagering game, and also may reduce an amount of time needed to generate a complex wagering game feature as described herein.

Furthermore, complex wagering games having interactive wagering processes as described herein have intermediate game states as well as wager outcome game states. In an example embodiment, a complex wagering game has a game space with 17 dimensions and approximately 1,576,418,005, 371,090,000,000, or over 1.5 sextillion, possible game states. Enumeration and storage of such a set of game states for implementation of the complex wagering game on a conventional electronic gaming machine would require over 12.6 zettabytes of addressable memory storage. Such complex wagering games are simply not implementable using conventional electronic gaming machines. However, such complex wagering games may be implemented on various embodiments of an outcome selector interactive wagering system as described herein.

An outcome selector interactive wagering system allows for the management of an interactive wagering process for one or more players where the interactive wagering process has one or more interactive objectives. In some embodiments, one or more interactive objectives are generated in accordance with a random component. In some embodiments of an outcome selector interactive wagering system, an interactive application executed by an interactive controller provides interactive objectives of the outcome selector interactive wagering system. The interactive controller is operatively connected to a process controller that manages and configures the interactive controller and the interactive application, and generates interactive objectives by a wagering subcontroller. Achievement of the interactive objectives as detected by the interactive controller based on player interactions are used to resolve the interactive wagering process.

In some embodiments, the interactive controller also provides a wagering user interface that is used to receive commands and display data for a wagering process and a wagering outcome generated from one ore more interactive objective achievements in accordance with an interactive wagering process. The content of the wagering user interface is controlled by the process controller and includes content provided by the wagering subcontroller and the interactive controller.

Many different types of interactive applications may be utilized with the outcome selector interactive wagering system. In some embodiments, the interactive application reacts to the physical activity of a player. In these embodiments, the interactive application senses player interactions with the interactive application through one or more sensors that monitor the player's physical activities. Such sensors may include, but are not limited to, physiological sensors that monitor the physiology of the player, environmental sensors that monitor the physical environment of the interactive controller, accelerometers that monitor changes in motion of the interactive controller, and location sensors that monitor the location of the interactive controller such as global positioning sensors.

In some embodiments, the interactive application implements an interactive wagering game and interacts with a player by sensing the player's interactions with an interactive user interface generated by the interactive application.

In many embodiments, the interactive application generates various types of interactive elements in an interactive application environment. In some embodiments, these interactive elements are interactive application resources utilized within the interactive application environment to provide an interactive experience for a player.

In accordance with some embodiments, a random component of an interactive objective can influence interactive elements in the interactive application environment such as, but not limited to, automatically providing one or more new interactive elements, automatically restoring one or more consumed interactive elements, automatically causing the loss of one or more interactive elements, and automatic restoration or placement of one or more fixed interactive elements.

In various embodiments, wagers in accordance with an interactive wagering process may be made using one or more types of credits.

In some embodiments, credits can be one or more credits that are purchased using, and redeemed in, a real world currency having a real world value.

In many embodiments, credits can be one or more credits in a virtual currency. Virtual currency is an alternate currency that can be acquired, purchased or transferred by or to a player, but does not necessarily directly correlate to a real world currency. In many such embodiments, credits in a virtual currency are allowed to be purchased using a real world currency but are prevented from being redeemed in a real world currency having a real world value.

In several embodiments, in response to a player's interaction with the interactive elements of the interactive application, application credits can be optionally consumed and/or accrued within the interactive application as a result of interaction with the interactive elements. Application credits can be in the form of, but not limited to, application environment credits, experience points, and points generally.

In various embodiments, application credits are awarded on the basis of interactions with the interactive elements of an interactive application. The interactive application can have one or more scoring criteria, embedded within a process controller and/or an interactive controller that provides the interactive application, that can be used to detect player performance against one or more goals of the interactive application in accordance with an interactive objective.

In many embodiments, application credits can be used to purchase in-application items, including but not limited to, application interactive elements that have particular properties, power ups for existing items, and other item enhancements.

In some embodiments, application credits may be used to earn entrance into a sweepstakes drawing, to earn entrance in a tournament with prizes, to score in the tournament, and/or to participate and/or score in any other game event.

In several embodiments, application credits can be stored on a player-tracking card, voucher or in a network-based player tracking system where the application credits are attributed to a specific player.

In various embodiments, an interactive wagering process includes a wager of credits for an award of credits in accordance with a player's achievement of one or more interactive objectives of the interactive wagering process.

In many embodiments, an interactive wagering process includes a wager of application credits for an award of application credits, interactive application elements, and/or interactive application objects in accordance with a player's achievement of one or more interactive objectives of the interactive wagering process.

In a number of embodiments, a wager of an amount of credits results in an award of application credits, interactive elements, and/or interactive application objects that have a credit value if cashed out.

In some embodiments, interactive application objects include in-application objects that may be utilized to enhance player interactions with the interactive application. Such in-application objects include, but are not limited to, power-ups, enhanced in-application items, and the like. In some embodiments, interactive application objects include objects that are detrimental to player interactions with the interactive application such as, but not limited to, obstructions in the interactive application space, a temporary handicap, an enhanced opponent, or the like.

In numerous embodiments, an interactive application command is an instruction by a process controller to an interactive controller and/or an interactive application of the interactive controller to modify a state of an interactive application or modify one or more interactive application resources, interactive application resources, or interactive elements of the interactive application. In some embodiments, the interactive application commands may be automatically generated by the process controller using one or more of a random component and/or application environment variables. An interactive application command can be used by a process controller to control processes of an interactive application, such as, but not limited to, an causing an addition of a period of time available for a current interactive application session for the interactive application, an addition of a period of time available for a future outcome selector interactive wagering system interactive application session or any other modification to the interactive application interactive elements that can be utilized during an interactive application session.

In some embodiments, asynchronous communications provided for by an outcome selector interactive wagering system may reduce an amount of idle waiting time by an interactive controller of the outcome selector interactive wagering system, thus increasing an amount of processing resources that the interactive controller may provide to an interactive application or other processes of the interactive controller. In many embodiments, asynchronous communications provided for by an outcome selector interactive wagering system reduces an amount of idle waiting time by a process controller, thus increasing an amount of processing resources that the process controller may provide to generate random components, and other processes provided by the process controller.

In some embodiments, a wagering subcontroller of an outcome selector interactive wagering system may be operatively connected to a plurality of interactive controllers through a process controller and the asynchronous communications provided for by the process controllers allows the wagering subcontroller to operate more efficiently by providing random components to a larger number of interactive controllers than would be achievable without the process controller of the outcome selector interactive wagering system.

In some embodiments, an outcome selector interactive wagering system including a process controller operatively connected to a wagering subcontroller and operatively connected to an interactive controller wherein the process controller provides for simplified communication protocols for communications of the interactive controller as the interactive controller may communicate interactions with an interactive application provided by the interactive controller to the process controller without regard to a nature of an interactive wagering process.

In some embodiments, an outcome selector interactive wagering system including a process controller operatively connecting a wagering subcontroller to an interactive controller may provide for reduced processing requirement for the interactive controller by offloading the execution of a random number generator from the interactive controller to the process controller. In various such embodiments, additional processing resources may be made available to graphics processing or other processing intensive operations by the interactive controller because of the offloaded random number processing.

In various embodiments, an outcome selector interactive wagering system including a process controller operatively connecting a wagering subcontroller to an interactive controller provides for operation of the interactive controller in an unsecure location or manner, while providing for operation of the wagering subcontroller in a secure location or manner.

In some embodiments, an outcome selector interactive wagering system including a process controller operatively connecting a wagering subcontroller to an interactive controller allows the outcome selector interactive wagering system to have regulated components coupled to unregulated components in a heterogeneous regulated environment. For example, in several such embodiments, the interactive controller may be a device that is not regulated by a wagering regulatory agency whereas the wagering subcontroller is regulated by the wagering regulatory agency. A process controller of an outcome selector interactive wagering system may provide for isolation of the processing of the interactive controller from the processing of the wagering subcontroller. In such a heterogeneous regulatory environment, the process controller may or may not be itself a regulated by the wagering regulatory authority. In addition, components of an interactive application executed by the interactive controller may be either regulated or unregulated by the wagering regulatory agency.

FIG. 1 is a state diagram of an interactive wagering process in accordance with various embodiments of the invention. An interactive wagering process can be described using a state diagram having an arbitrary number of states, herein described as state S1 to state SN 10.

An interactive wagering process may have different kinds and different combinations of non-deterministic transition events that cause transitions between the various states of the wagering process. In some embodiments, one or more non-deterministic transition events may be random in nature as indicated by random-based transition 12. In many embodiments, a random-based transition is independent of any player interaction with the interactive wagering process. In many such embodiments, a random-based transition is selected by an outcome selector interactive wagering system using a non-deterministic random number generator and a look-up table having stored parameters. The random number generator is used to generate a random number and that random number is used to generate an index into the look-up table to select a parameter. The parameter defines a random component of an interactive wagering process and causes a transition to a next state of the interactive wagering process. In an example embodiment, the random number generator generates random numbers having a uniform distribution. As the random number generation process is non-deterministic, random-based transitions from one state to a next state are non-deterministic events within the interactive wagering process.

In some embodiments, one or more non-deterministic transition events may be skill-based transitions as indicated by skill-based transition 14. A skill-based transition is based upon detection by the outcome selector interactive wagering system of a skillful interaction by a player with an interactive component of an interactive wagering process of the outcome selector interactive wagering system. In some embodiments, a distribution of a probability that a particular skill-based transition will be detected by the outcome selector wagering system can be detected from detecting a plurality of skillful interactions of a plurality of players with an interactive wagering process during testing.

In some embodiments, one or more non-deterministic transition events may be based on detecting player selections between two or more interactive elements of an interactive wagering process as indicated by player selection-based transition 16.

Figure 2:
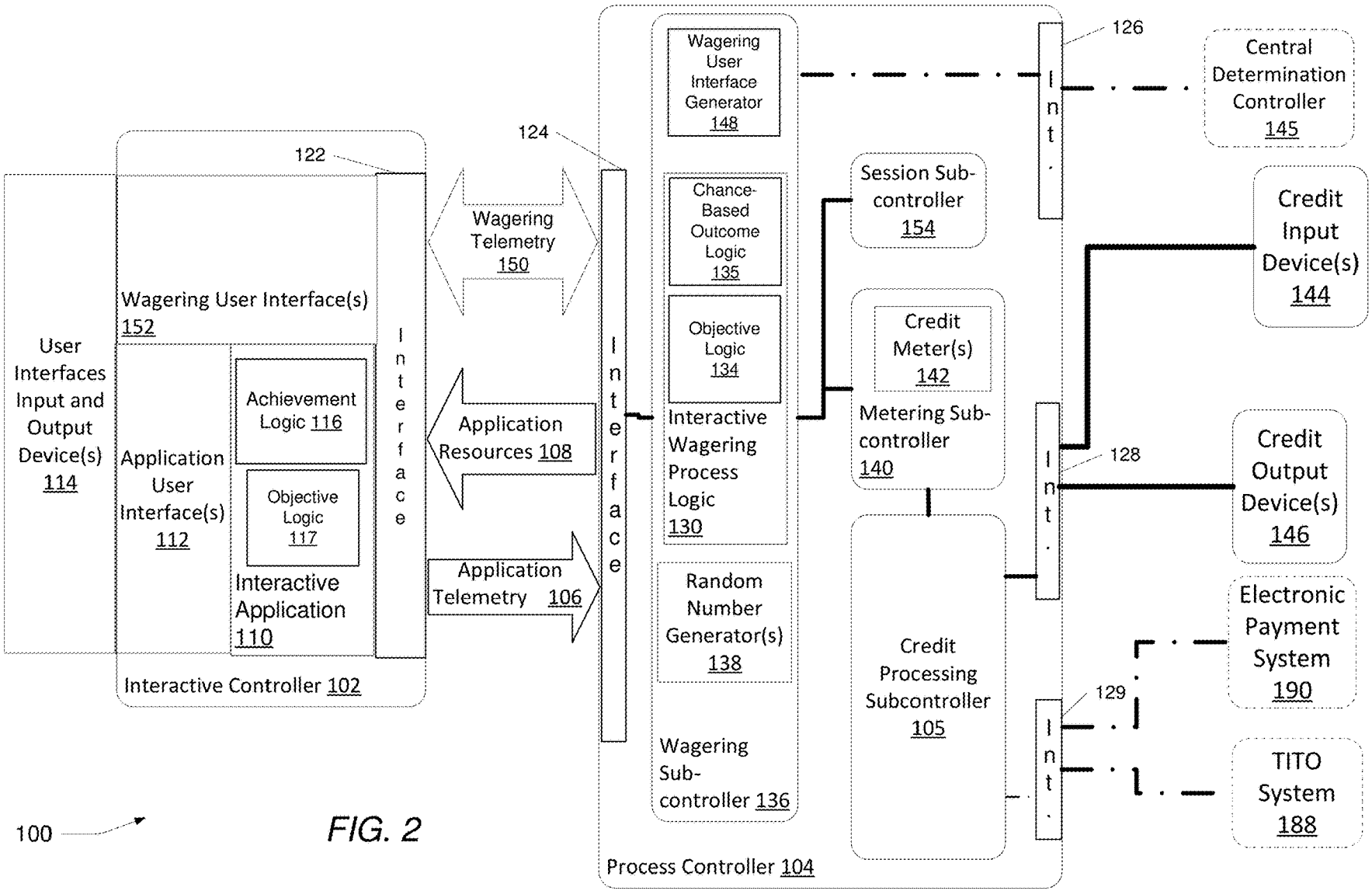
FIG. 2 is a diagram of a structure of an outcome selector interactive wagering system in accordance with various embodiments of the invention.

FIG. 2 is a diagram of an architecture of an outcome selector interactive wagering system in accordance with various embodiments of the invention. The outcome selector interactive wagering system is designed to implement an interactive wagering process through the generation, detection and processing of non-deterministic transition events. The outcome selector interactive wagering system 100 includes an interactive controller 102, a process controller 104, and a credit processing subcontroller 105. The interactive controller 102 is operatively connected to, and communicates with, the process controller 104. The process controller 104 is also operatively connected to, and communicates with, the credit processing subcontroller 105.

In various embodiments, the interactive controller 102 detects player interactions with an interactive wagering process implemented by an outcome selector interactive wagering system. The interactive controller 102 executes an interactive application 110 and provides one or more user interface input and output devices 114 so that one or more players can interact with the interactive application 110. In various embodiments, user interface input devices include, but are not limited to: buttons or keys; keyboards; keypads; game controllers; joysticks; computer mice; track balls; track buttons; touch pads; touch screens; accelerometers; motion sensors; video input devices; microphones; and the like. In various embodiments, user interface output devices include, but are not limited to: audio output devices such as speakers, headphones, earbuds, and the like; visual output devices such as lights, video displays and the like; and tactile devices such as rumble pads, hepatic touch screens, buttons, keys and the like. The interactive controller 102 provides for player interactions with the interactive application 110 by executing the interactive application 110 that generates an application user interface 112 that utilizes the user interface input devices to detect player interactions with interactive elements of the interactive application 110 of the interactive controller 102 and generates an interactive user interface that is presented to the player utilizing the user interface output devices.

In some embodiments, one or more components of an interactive controller are housed in an enclosure such as a housing, cabinet, casing or the like. The enclosure further includes one or more player accessible openings or surfaces constructed to mount the user interface input devices and/or the user interface output devices.

The interactive controller 102 is operatively connected to, and communicates with, the process controller 104. The interactive controller 102 receives application command and resource data 108 including, but not limited to, interactive objective data, application command data, and resource data, from the process controller 104. Via the communication of the application command and resource data 108, the process controller 104 can control the operation of the interactive controller 102 by communicating control parameters to the interactive application 110 during the interactive application's execution by the interactive controller 102.

In some embodiments, during execution of the interactive application 110 by the interactive controller 102, the interactive controller 102 communicates, as application telemetry data 106, detected player interactions with one or more interactive elements of the application user interfaces 112 of the interactive application to the process controller 104. The application telemetry data 106 may include, but is not limited to, application environment variables that indicate the state of the interactive application 110, interactive controller data indicating a state of the interactive controller 102, detected player actions and interactions between one or more players and the interactive application 110 provided by the interactive controller 102, achievement of interactive objectives based on the detected player interactions and achievement logic 116, and utilization of interactive elements in the interactive application 110 by one or more players.

In some embodiments, the application telemetry data 106 includes an interactive objective achievement associated with an interactive objective as detected by the interactive application 110 using interactive objective achievement logic 116, the application command and resource data 108, and detected player interactions with one or more application user interfaces 112 of the interactive application.

In some embodiments, the interactive application 110 is a skill-based interactive application, such as but not limited to a skill-based game. In such embodiments, execution of the skill-based interactive application 110 by the interactive controller 102 is based on one or more players' skillful interaction with the interactive application 110, such as, but not limited to, the players' utilization of the interactive elements of the interactive application during the players' skillful interaction with the skill-based interactive application. In such an embodiment, the process controller 104 communicates with the interactive controller 102 in order to allow the coupling of the skill-based interactive application to skill-based interactive objectives generated in accordance with an interactive wagering process implemented by the process controller 104 and/or the interactive controller 102.

In many embodiments, the interactive application 110 includes interactive objective logic 117 that is utilized by the interactive application to generate an interactive objective and present the interactive objective to one or more players in accordance with interactive objective data received from the process controller 104. In some embodiments, the interactive objective logic utilizes a random component received from the process controller 104 to select an interactive objective that is presented to the one or more players by the interactive controller 102. In various embodiments, the interactive objective logic 117 receives a selection of the interactive objective to be presented from the process controller 104.

In some embodiments, the interactive application 110 uses interactive objective data, interactive application command data, and/or resource data included in the application commands and resources 108 to present an interactive objective to one or more players as one or more application user interfaces 112 using one or more output devices of user interface and output device(s) 114. The one or more players skillfully interact with the one or more application user interfaces 112 using one or more of input devices of the user interface input and output devices 114. The interactive application 110 detects an interactive objective achievement based on detection of the skillful interactions of the one or more players and communicates data of the detected interactive objective achievement to the process controller 104 as part of the application telemetry 106. In some embodiments, the interactive application 110 also communicates as part of the application telemetry data 106, data encoding the one or more players' interactions with the interactive application 110.

In some embodiments, the interactive objective achievement logic 116 and the interactive objective data included in the application commands and resources 108 are for an interactive objective for one or more players. The interactive application 110 detects interactive objective achievements based on the interactive objective and detection of the one or more players' skillful interactions with the interactive application. The interactive objective achievements are communicated by the interactive controller 102 to the process controller 104 included in the application telemetry 106.

In some embodiments, the interactive controller 102 includes one or more sensors that sense various aspects of the physical environment of the interactive controller 102. Examples of sensors include, but are not limited to: global positioning sensors (GPSs) for sensing communications from a GPS system to detect a position or location of the interactive controller; temperature sensors; accelerometers; pressure sensors; and the like. Sensor telemetry data detected from the one or more sensors are communicated by the interactive controller to the process controller 104 as part of the application telemetry data 106. The process controller 104 receives the sensor telemetry data and uses the sensor telemetry data along with interactive objective logic and/or random component logic to generate interactive objectives and/or random components of an interactive wagering process as described herein.

In many embodiments, the interactive controller 102 includes one or more wagering user interfaces 152 used to display wagering data, via one or more of the user interface input and output devices 114, to one or more players. The on more wagering user interfaces include a presentation to one or more players of various wagering data that may include, but is not limited to, an amount of credits committed to a wager, a denomination of a wager, an amount of credits won as the result of a successful wager, and an amount of credits in a credit meter associated with the one or more players.

In various embodiments, an application control interface 122 resident in the interactive controller 102 provides an interface between the interactive controller 102 and the process controller 104.

In some embodiments, the application control interface 122 implements an interactive controller to process controller communication protocol employing an interprocess communication protocol so that an interactive controller and a process controller may be implemented on the same device. In operation, the application control interface 122 provides application programming interfaces (APIs) that are used by an interactive application of the interactive controller to communicate outgoing data and receive incoming data by passing parameter data to another process or application.

In some embodiments, the application control interface 122 implements an interactive controller to process controller communication protocol employing an interdevice communication protocol so that an interactive controller and a process controller may be implemented on different devices. The interdevice protocol may utilize a wired communication bus or wireless network as a physical layer.

In various embodiments, the application control interface 122 implements an interactive controller to process controller communication protocol employing a networking protocol so that an interactive controller and a process controller may be implemented on different devices connected by a network. The networking protocol may utilize a wired communication bus or wireless network as a physical layer. In many such embodiments, the network includes a cellular telephone network or the like and the interactive controller is a mobile device such as a smartphone, tablet computer or other device capable of using the telephone network. During operation, the application control interface 122 communicates outgoing data to an external device by encoding the data into a signal and transmitting the signal to an external device. The application control interface receives incoming data from an external device by receiving a signal transmitted by the external device and decoding the signal to obtain the incoming data.

In various embodiments, the process controller 104 includes a wagering subcontroller 136 having a rule-based decision engine that receives application telemetry data 106 from the interactive controller 102. In some embodiments, the rule-based decision engine includes interactive wagering process logic 130 including interactive objective logic 134 and chance-based outcome logic 135. The decision engine uses the application telemetry data 106, along with interactive objective logic 134, to generate an interactive objective of an interactive wagering process. In some embodiments, the decision engine also uses a random component generated by one or more random number generators (RNGs) 138 to generate an interactive objective.

In many embodiments, the interactive objective logic 134 of the process controller 104 works in association with interactive objective logic 117 of the interactive application 110. In an example embodiment, the interactive objective logic 134 of the processor controller 104 provides a random component used by the interactive objective logic 117 to generate an interactive objective. In other example embodiments, the interactive objective logic of the process controller provides a selection of an interactive objective that is implemented by the interactive objective logic 117 of the interactive application.

In some embodiments, the chance-based outcome logic 135 of the process controller 104 to generate one or more chance-based outcomes. In an example embodiment, a chance-based outcome is generated by the process controller by executing chance-based outcome generation commands included in the chance-based outcome logic 135 to use a random component generated using the one or more random number generators 138 and use the random component as an index into a lookup table having stored data of a plurality of chance-based outcomes.

In an embodiment, the application telemetry data 106 used by the decision engine encodes data about the operation of the interactive application 110 executed by the interactive controller 102.

In some embodiments, the application telemetry data 106 encodes interactions of a player, such as a player's interaction with an interactive element of the interactive application 110.

In many embodiments, the application telemetry data 106 includes a state of the interactive application 110, such as values of variables that change as the interactive application 110 executes.

In several embodiments, the decision engine includes one or more rules as part of interactive objective logic 134 used by a decision engine to determine how an interactive objective should generated. Each rule includes one or more variable values constituting a pattern that is to be matched by the wagering subcontroller 136 using the decision engine to one or more variable values encoded in the application telemetry data 106. Each rule also includes one or more actions that are to be taken if the pattern is matched. Actions can include automatically generating the interactive objective in accordance with the interactive objective logic 134 and a random component generated by one or more random number generators 138. During operation, the decision engine process controller 104 receives application telemetry data 106 from the interactive controller 102 via interface 160. The decision engine performs a matching process of matching the variable values encoded in the application telemetry data 106 to one or more variable patterns of one or more rules. If a match between the variable values and a pattern of a rule is detected, then the wagering subcontroller 136 performs the action of the matched rule.

In some embodiments, the wagering subcontroller 136 uses an interactive objective in conjunction with the application telemetry data 106 and interactive objective logic 134, to automatically generate application command and resource data 108 including interactive objective data of an interactive objective that the process controller 104 communicates to the interactive controller 102 via interfaces 124 and 122.

In some embodiments, the decision engine includes one or more rules as part of interactive objective logic 134 used by the decision engine to automatically generate the application command and resource data 108 that is then communicated to the interactive controller 102. Each rule includes one or more variable values constituting a pattern that is to be matched to one or more variable values encoded in the application telemetry data 106 and the interactive objective. Each rule also includes one or more actions that are to be automatically taken by the wagering subcontroller 136 if the pattern is matched. Actions can include automatically generating interactive objective data, interactive application command data, and/or resource data 108 and using the interactive objective data, interactive application command data, and/or resource data 108 to control the interactive controller 102 to affect execution of the interactive application 110 as described herein. In operation, wagering subcontroller 104 uses the decision engine 122 to match the variable values encoded in the in the interactive objective data to one or more patterns of one or more rules of the interactive objective logic 134. If a match between the variable values and a pattern of a rule is found, then the process controller automatically performs the action of the matched rule. In some embodiments, the process controller 104 uses the application telemetry data 106 received from the interactive controller 102 in conjunction with the interactive objective to generate the interactive objective data, interactive application command data, and/or resource data 108.

The interactive controller receives the interactive objective data, interactive application command data, and resource data 108 and automatically uses the interactive objective data, interactive application command data, and/or resource data 108 to configure and command the processes of the interactive application 110.

In some embodiments, the interactive application 110 operates utilizing a scripting language. The interactive application 110 parses scripts written in the scripting language and executes commands encoded in the scripts and sets variable values as defined in the scripts. In operation of such embodiments, the process controller 104 automatically generates interactive objective data, interactive application command data, and/or resource data 108 in the form of scripts written in the scripting language that are communicated to the interactive controller 102 during execution of the interactive application 110. The interactive controller 102 receives the scripts and passes them to the interactive application 110. The interactive application 110 receives the scripts, parses the scripts and automatically executes the commands and sets the variable values as encoded in the scripts.

In many embodiments, the interactive application 110 automatically performs processes as instructed by commands communicated from the process controller 104. The commands command the interactive application 110 to perform specified operations such as executing specified commands and/or setting the values of variables utilized by the interactive application 110. In operation of such embodiments, the process controller 104 automatically generates commands that are encoded into the interactive objective data, interactive application command data, and/or resource data 108 that are communicated to the interactive controller 102. The interactive controller 102 passes the interactive objective data, interactive application command data, and/or resource data 108 to the interactive application 110. The interactive application parses the interactive objective data, interactive application command data, and/or resource data and automatically performs operations in accordance with the commands encoded in the interactive objective data, interactive application command data, and/or resource data 108.

In many embodiments, the process controller 104 includes a random number generator used to generate random components that are used by the decision engine to generate portions of the interactive objective data, interactive application command data, and/or resource data 108.

In various embodiments, the process controller 104 includes one or more interfaces, such as interface 124, that operatively connect the process controller 104 to one or more interactive controllers, such as interactive controller 102.

In many embodiments, the process controller 104 includes one or more interfaces, such as interface 126, that operatively connect the process controller 104 to one or more to one or more external devices used to generate chance-based outcomes, such as central determination controller 145. In operation, when a wagering subcontroller 136 of the process controller 104 needs to generate a chance-based outcome, the wagering subcontroller communicates a request to the central determination controller 145 for the chance-based outcome. The central determination controller 145 receives the chance-based outcome request and generates a chance-based outcome in response to the chance-based outcome request. The central determination controller communicates data of the chance-based outcome to the process controller 104. The process controller 104 receives the data of the chance-based outcome and utilizes the chance-based outcome as described herein. In some embodiments, the chance-based outcome is drawn from a pool of pre-generated chance-based outcomes.

In various embodiments, the central determination controller 145 is a progressive controller that operatively connected to a plurality of outcome selector interactive wagering systems (not shown). The progressive controller provides services for the collection and provision of credits used by the process controller 104 to provide chance-based outcomes that have a progressive or pooling component.

In some embodiments, the process controller 104 includes one or more interfaces, such as interface 128, that operatively connect the process controller 104 to one or more to one or more credit input devices, such as credit input devices 144, and to one or more credit output devices, such as credit output devices 146. In various embodiments, the process controller 104 includes one or more interfaces, such as interface 129, that operatively connect the process controller 104 to one or more ticket-in-ticket-out systems 188 and/or one or more electronic payment systems 190.

In some embodiments, one or more of the process controller interfaces implement a process controller to device or server communication protocol employing an interprocess communication protocol so that a process controller and one or more of a credit processing subcontroller, an interactive controller, a wagering subcontroller, a metering subcontroller, and/or a session subcontroller may be implemented on the same device. In operation, the process controller interfaces provide application programming interfaces or the like that are used by the process controller to communicate outgoing data and receive incoming data by passing parameter data to another process or application running on the same device.

In some embodiments, one or more of the process controller interfaces implement a process controller communication protocol employing an interdevice communication protocol so that a process controller may be implemented on a device separate from a credit processing subcontroller, an interactive controller, a session subcontroller, a metering subcontroller, and/or a wagering subcontroller. The interdevice protocol may utilize a wired communication bus or wireless network as a physical layer. In various embodiments, one or more of the process controller interfaces implement a process controller communication protocol employing a networking protocol so that the process controller may be operatively connected to one or more of a credit processing subcontroller, an interactive controller, a session subcontroller, a metering subcontroller, and/or a wagering subcontroller by a network. The networking protocol may utilize a wired communication bus or wireless network as a physical layer. In many such embodiments, the network includes a cellular telephone network or the like and the one or more interactive controllers include a mobile device such as a smartphone, tablet computer or other device capable of using the telephone network. During operation, the one or more process controller interfaces communicate outgoing data to an external device or server by encoding the data into a signal and transmitting the signal to the external device or server. The one or more process controller interfaces receive incoming data from an external device or server by receiving a signal transmitted by the external device or server and decoding the signal to obtain the incoming data.

In several embodiments, the wagering subcontroller 136 is a controller for providing one or more wagers in accordance with one or more interactive wagering processes implemented by the outcome selector interactive wagering system 100. Types of value committed to a wager can be one or more of several different types. In various embodiments, types of value of a wager can include, but are not limited to, a wager of an amount of credits corresponding to a real currency or a virtual currency, a wager of an amount of application credits earned through interaction with an interactive application, a wager of an amount of interactive elements of an interactive application, and a wager of an amount of objects used in an interactive application. An interactive objective achievement detected for a wager in accordance with an interactive objective can increase or decrease an amount of the type of value used in the wager, such as, but not limited to, increasing or decreasing an amount of credits for a wager of credits. In various embodiments, an interactive objective achievement detected for a wager in accordance with an interactive objective can increase or decrease an amount of a type of value that is different than a type of value of the wager, such as, but not limited to, increasing an amount of an object of an interactive application for a wager of credits.

In many embodiments, the process controller 104 includes one or more random number generators (RNGs) 138 for generating random components. In some embodiments, the wagering subcontroller uses the one or more random components along with the interactive wagering process logic 130 to generate one or more interactive objectives of an interactive wagering process. In various embodiments, the wagering subcontroller uses the one or more random components along with the interactive wagering process logic 130 to generate one or more chance-based outcomes of an interactive wagering process.

In several embodiments, the process controller 104 includes a metering subcontroller 140. The metering subcontroller 140 communicates with the credit processing subcontroller 105 to receive incoming credit data from the credit processing subcontroller 105. The metering subcontroller 140 uses the incoming credit data to transfer credits into the outcome selector interactive wagering system and onto one or more credit meters 142 associated with one or more players. The metering subcontroller 140 communicates outgoing credit data to the credit processing subcontroller 105 to transfer credits off of the one or more credit meters 142 and out of the outcome selector interactive wagering system.

In several embodiments, during operation, the metering subcontroller 140 communicates with the credit processing subcontroller 105 to receive incoming credit data from the credit processing subcontroller 105 and adds credits onto the one or more credit meters 110 at least partially on the basis of the incoming credit data. The one or more random number generators 138 execute processes that generate one or more random components. The wagering subcontroller 136 uses the interactive wagering process logic 130 and the random components to generate one or more interactive objectives and/or one or more chance-based outcomes of an interactive wagering process. Data of the one or more interactive objectives and/or the one or more chance-based outcomes is communicated by the process controller 104 as part of the application command and resource data 108 to the interactive controller 102. The interactive application 110 uses the interactive objective data along with the interactive objective achievement logic 116 to generate a presentation for the user including the one or more application user interfaces 112. One or more players interact with the one or more application user interfaces 112 through the one or more user interface input and output devices 114. The interactive application 110 detects the player interactions and detects an interactive objective achievement based on the detected interactions of the one or more players and communicates data of the interactive objective achievement as part of the application telemetry data 106 to the process controller 104. The wagering sub controller 136 receives the interactive objective achievement data and instructs the metering subcontroller 140 to add credits to, or deduct credits from, the one or more credit meters 110 based in part on the interactive objective achievement data. For example, in some embodiments, the metering subcontroller is instructed to add an amount of credits to a credit meter of the one or more credit meters 110 when the interactive objective achievement indicates a win for a player associated with the credit meter. In various embodiments, the metering subcontroller is instructed to deduct an amount of credits from the credit meter when the interactive objective achievement indicates a loss for the player. At an end of a wagering session, the metering subcontroller 140 transfers credits off of the one or more credit meters 110 and out of the outcome selector interactive wagering system by communicating outgoing credit data to the credit processing subcontroller 105.

In many embodiments, the one or more random number generators 138 generate random numbers by continuously generating pseudo random numbers using one or more pseudo random number generators. A most current pseudo random number is stored in a buffer thus constantly refreshing the buffer. In many embodiments, the buffer is refreshed at a rate exceeding 100 times per second. When the wagering subcontroller 136 requests a random component, the wagering subcontroller 136 receives the stored most current pseudo random number from the buffer. As timing between requests for a random component is non-deterministic, the resulting output from the buffer is a non-deterministic random component such as a random number.

In some embodiments, a wagering subcontroller generates an interactive objective by executing interactive objective generation commands included in interactive objective logic that define processes of an interactive wagering process where the interactive objective generation commands are formatted in a scripting language. In operation, a decision engine of a process controller generates the interactive objective generation commands in the form of a script written in the scripting language. The script includes the interactive objective generation commands that describe how the wagering subcontroller is to generate an interactive objective. The wagering subcontroller parses the script encoded in the interactive objective generation command data and executes the commands included in the script to generate the interactive objective.

In various embodiments, the process controller 104 uses a rule-based decision engine to automatically generate an amount of application credits to award to a player based at least in part on the application telemetry data 106 including interactive objective achievement data and player interaction data with the interactive application 110 of the outcome selector interactive wagering system. In numerous embodiments, the interactive application 110 is a skill-based interactive application and the application credits are awarded for a player's skillful interaction with the interactive application 110.

In some embodiments, the wagering subcontroller 136 uses a wagering user interface generator 148 to automatically generate wagering telemetry data 150 on the basis of amounts of credits on the one or more credit meters 142. The wagering telemetry data 150 is used by the process controller 104 to command the interactive controller 102 to automatically generate one or more wagering user interfaces 152 describing a state of wagered credit accumulation and loss for the outcome selector interactive wagering system. When a player interacts with the one or more wagering user interfaces 152, wagering user interface telemetry data 150 is generated by the one or more wagering user interfaces 152 and communicated by the interactive controller 102 to the process controller 104 using interfaces 122 and 124.

In some embodiments, the wagering telemetry data 150 may include, but is not limited to, amounts of application credits and interactive elements earned, lost or accumulated through interaction with the interactive application 110, and credits, application credits and interactive elements amounts won, lost or accumulated.

In some embodiments, the interactive objective data, interactive application command data, and/or resource data 108 are communicated to the wagering user interface generator 148 and used as a partial basis for generation of the wagering telemetry data 150 communicated to the interactive controller 102.

In various embodiments, the wagering user interface generator 148 also receives interactive objective data that is used as a partial basis for generation of the wagering telemetry data 150 communicated to the interactive controller 102. In some embodiments, the interactive objective data also includes data about one or more states of a wager of the interactive objective as generated by the wagering subcontroller 136. In various such embodiments, the wagering user interface generator 148 generates an interactive objective generation process display and/or interactive objective state display using the one or more states of the interactive objective. The interactive objective generation process display and/or interactive objective state display is included in the wagering telemetry data 150 that is communicated to the interactive controller 102. The wagering process display and/or wagering state display is automatically displayed by the interactive controller 102 using the one or more wagering user interfaces 152. In other such embodiments, the one or more states of the interactive objective are communicated to the interactive controller 102 and the interactive controller 102 is instructed to automatically generate the interactive objective generation process display and/or interactive objective state display of the one or more wagering user interfaces 152 using the one or more states of the interactive objective for display.

In some embodiments, the interactive objective includes state data about execution of an interactive objective of the interactive objective logic 134, including but not limited to a final state, intermediate state and/or beginning state of the interactive wagering process. For example, in an interactive wagering process that is based on slot machine math, the final state of the interactive wagering process may be reel positions, in an interactive wagering process that is based on roulette wheel math, the final state may be a pocket where a ball may have come to rest, in an interactive wagering process that is a based on card math, the beginning, intermediate and final states may represent a sequence of cards being drawn from a deck of cards, etc.

In some embodiments, an interactive controller generates a wagering user interface by executing commands that define processes of the wagering user interface where the commands are formatted in a scripting language. In operation, a wagering user interface generator of a process controller generates commands in the form of a script written in the scripting language. The script includes commands that describe how the interactive controller is to display wagering outcome data. The completed script is encoded as wagering telemetry data and communicated to the interactive controller by the process controller. The interactive controller receives the wagering telemetry data and parses the script encoded in the wagering telemetry data and executes the commands included in the script to generate the wagering user interface.

In many embodiments, an interactive controller generates a wagering user interface based on a document written in a document markup language that includes commands that define processes of the wagering user interface. In operation, a wagering user interface generator of a process controller generates a document composed in the document markup language. The document includes commands that describe how the interactive controller is to display wagering outcome data. The completed document is encoded as wagering telemetry data and communicated to the interactive controller by the process controller. The interactive controller receives the wagering telemetry data and parses the document encoded in the wagering telemetry data and executes the commands encoded into the document to generate the wagering user interface.

In some embodiments, an interactive controller generates a wagering user interface by executing commands that define processes of the wagering user interface. In operation, a wagering user interface generator of a process controller generates the commands and encodes the commands into wagering telemetry data that is communicated to the interactive controller by the process controller. The interactive controller receives the wagering telemetry data and executes the commands encoded in the wagering telemetry data to generate the wagering user interface.

In various embodiments, an interactive controller includes a data store of graphic and audio display resources that the interactive controller uses to generate a wagering user interface as described herein.

In many embodiments, a process controller communicates graphic and audio display resources as part of wagering telemetry data to an interactive controller. The interactive controller uses the graphic and audio display resources to generate a wagering user interface as described herein.

In many embodiments, the process controller 104 may additionally include various audit logs and activity meters.

The process controller 104 can further operatively connect to a metering subcontroller to determine an amount of credit or interactive elements available and other wagering metrics of an interactive wagering process. Thus, the process controller 104 may potentially affect an amount of credits in play for participation in the wagering events of the interactive wagering process provided by the wagering subcontroller. In some embodiments, the process controller 104 can also couple to a centralized server for exchanging various data related to players or players and the activities of the players or players during utilization of an outcome selector interactive wagering system.

In many embodiments, two or more players or players can be engaged in using the interactive application 110 executed by the interactive controller 102. In various embodiments, an outcome selector interactive wagering system can include an interactive application 110 that provides an interactive application that includes player versus player (PvP) competitive play between a single player and a computing device, between two or more players or players against one another, or multiple players or players playing against a computer device and/or each other. In some embodiments, the interactive application 110 can be a skill-based interactive application where the player is not skillfully playing against the computer or any other player such as skill-based interactive applications where the player is effectively skillfully playing against himself or herself.

In some embodiments, the process controller 104 utilizes the one or more wagering user interfaces 152 to communicate certain interactive application data to the player, including but not limited to, club points, player status, control of the selection of choices, and messages which a player can find useful in order to adjust the interactive application experience or understand the wagering status of the player.

In some embodiments, the process controller 104 utilizes the one or more wagering user interfaces 152 to communicate aspects of an interactive wagering process to a player including, but not limited to, amount of credits, application credits, interactive elements, or objects in play, and amounts of credits, application credits, interactive elements, or objects available.

In a number of embodiments, the wagering subcontroller 136 can accept interactive wagering process factors including, but not limited to, modifications in the amount of credits, application credits, interactive elements, or objects wagered on each individual wagering event, entrance into a bonus round, and other factors. In several embodiments, the process controller 104 can communicate a number of factors back and forth to the wagering subcontroller, such that an increase/decrease in a wagered amount can be related to the change in player profile of the player in the interactive application. In this manner, a player can control a wager amount per wagering event in accordance with the interactive wagering process with the change mapping to a parameter or component that is applicable to the interactive application experience.

In some embodiments, the process controller 104 includes a session subcontroller 154 is used to regulate an outcome selector interactive wagering system session.

In various embodiments, the session subcontroller 154 includes one or more session subcontroller interfaces that operatively connect the session subcontroller 154 to one or more wagering subcontrollers, metering subcontrollers and pooled bet subcontrollers through their respective interfaces.

In some embodiments, one or more of the session subcontroller interfaces implement a session subcontroller to device or server communication protocol employing an interprocess communication protocol so that the session subcontroller and one or more of an interactive controller, a wagering subcontroller, and/or a process controller may be implemented on the same device. In operation, the session subcontroller interfaces provide application programming interfaces or the like that are used by the session subcontroller to communicate outgoing data and receive incoming data by passing parameter data to another process or application running on the same device.

In some embodiments, one or more of the session subcontroller interfaces implement a session subcontroller communication protocol employing an interdevice communication protocol so that the session subcontroller may be implemented on a device separate from the one or more interactive controllers, the one or more process controllers and/or the one or more wagering subcontrollers. The interdevice protocol may utilize a wired communication bus or wireless network as a physical layer. In various embodiments, one or more of the session subcontroller interfaces implement a session subcontroller communication protocol employing a networking protocol so that the process session subcontroller may be operatively connected to the one or more interactive controllers, the one or more process controllers, and/or the one or more wagering subcontrollers by a network. The networking protocol may utilize a wired communication bus or wireless network as a physical layer. In many such embodiments, the network includes a cellular telephone network or the like and the one or more interactive controllers include a mobile device such as a smartphone or other device capable of using the telephone network. During operation, the one or more session subcontroller interfaces communicate outgoing data to an external device or server by encoding the data into a signal and transmitting the signal to the external device or server. The one or more session subcontroller interfaces receive incoming data from an external device or server by receiving a signal transmitted by the external device or server and decoding the signal to obtain the incoming data.

In various embodiments, components of the process controller 104 communicate session data to the session subcontroller. The session data may include, but is not limited to, player data, interactive controller data, pooled bet and side bet data, process controller data and wagering subcontroller data used by the session subcontroller to regulate an outcome selector interactive wagering system session.

In some embodiments, the session subcontroller 154 may also assert control of an outcome selector interactive wagering system session by communicating session control data to components of the process controller 104. Such control may include, but is not limited to, commanding the process controller 104 to end an outcome selector interactive wagering system session, initiating wagering in an outcome selector interactive wagering system session, ending wagering in an outcome selector interactive wagering system session but not ending a player's use of the interactive application portion of the outcome selector interactive wagering system, and changing from real credit wagering in an outcome selector interactive wagering system to virtual credit wagering, or vice versa.

In many embodiments, the session subcontroller 154 manages player profiles for a plurality of players or players. The session subcontroller 154 stores and manages data about players or players in order to provide authentication and authorization of players or players of the outcome selector interactive wagering system 100. In some embodiments, the session subcontroller 154 also manages geolocation information to ensure that the outcome selector interactive wagering system 100 is only used by players or players in jurisdictions were wagering is approved. In various embodiments, the session subcontroller 154 stores application credits that are associated with the player's use of the interactive application of the outcome selector interactive wagering system 100.

In some embodiments, the session subcontroller 154 communicates player and session management data to the player using a management user interface (not shown) of the interactive controller. The player interacts with the management user interface and the management user interface generates management telemetry data that is communicated to the session subcontroller 154 via interfaces 122 and 124.

In some embodiments, the wagering subcontroller 136 communicates wagering session data to the session subcontroller 154. In various embodiments, the session subcontroller communicates wagering session control data to the wagering subcontroller 136.

In some embodiments, a process controller operates as an interface between an interactive controller and a wagering subcontroller. By virtue of this construction, the wagering subcontroller is isolated from the interactive controller allowing the interactive controller to operate in an unregulated environment while allowing the wagering subcontroller to operate in a regulated environment.

In some embodiments, a single wagering subcontroller may provide services to two or more interactive controllers and/or two or more process controllers, thus allowing an outcome selector interactive wagering system to operate over a large range of scaling.

In various embodiments, multiple types of interactive controllers using different operating systems may be interfaced to a single type of process controller and/or wagering subcontroller without requiring customization of the process controller and/or the wagering subcontroller.

In many embodiments, an interactive controller may be provided as a player device under control of a player while maintaining the wagering subcontroller in an environment under the control of a regulated operator of wagering equipment.

In several embodiments, data communicated between the controllers may be encrypted to increase security of the outcome selector interactive wagering system.

In some embodiments, a process controller isolates interactive objective logic and interactive objective logic as unregulated logic from a regulated wagering subcontroller, thus allowing errors in the interactive objective logic and/or interactive objective logic to be corrected, new interactive objective logic and/or interactive objective logic to be used, or modifications to be made to the interactive objective logic and/or interactive objective logic without a need for regulatory approval.

In various embodiments, an interactive application may require extensive processing resources from an interactive controller leaving few processing resources for the functions performed by a process controller and/or a wagering subcontroller. By virtue of the architecture described herein, processing loads may be distributed across multiple devices such that operations of the interactive controller may be dedicated to the interactive application and the processes of the process controller and/or wagering subcontroller are not burdened by the requirements of the interactive application.

In many embodiments, an outcome selector interactive wagering system operates with its components being distributed across multiple devices. These devices can be connected by communication channels including, but not limited to, local area networks, wide area networks, local communication buses, and/or the like. The devices may communicate using various types of protocols, including but not limited to, networking protocols, device-to-device communications protocols, and the like.

In some embodiments, one or more components of an outcome selector interactive wagering system are distributed in close proximity to each other and communicate using a local area network and/or a communication bus. In several embodiments, an interactive controller and a process controller of an outcome selector interactive wagering system are in a common location and communicate with an external wagering subcontroller. In some embodiments, a process controller and a wagering subcontroller of an outcome selector interactive wagering system are in a common location and communicate with an external interactive controller. In many embodiments, an interactive controller, a process controller, and a wagering subcontroller of an outcome selector interactive wagering system are located in a common location. In some embodiments, a session subcontroller is located in a common location with a process controller and/or a wagering subcontroller.

In various embodiments, these multiple devices can be constructed from or configured using a single device or a plurality of devices such that an outcome selector interactive wagering system is executed as a system in a virtualized space such as, but not limited to, where a wagering subcontroller and a process controller are large scale centralized servers in the cloud operatively connected to widely distributed interactive controllers via a wide area network such as the Internet or a local area network. In such embodiments, the components of an outcome selector interactive wagering system may communicate using a networking protocol or other type of device-to-device communications protocol.

In some embodiments, an outcome selector interactive wagering system is deployed over a local area network or a wide area network in an interactive configuration. An interactive configuration of an outcome selector interactive wagering system includes an interactive controller operatively connected by a network to a process controller and a wagering subcontroller.

In some embodiments, an outcome selector interactive wagering system is deployed over a local area network or a wide area network in a mobile configuration. A mobile configuration of an outcome selector interactive wagering system is useful for deployment over wireless communication network, such as a wireless local area network or a wireless telecommunications network. A mobile configuration of an outcome selector interactive wagering system includes an interactive controller operatively connected by a wireless network to a process controller and a wagering subcontroller.

In several embodiments, a centralized process controller is operatively connected to one or more interactive controllers and one or more wagering subcontrollers using a communication link. The centralized process controller can perform the functionality of a process controller across various outcome selector interactive wagering systems.

In numerous embodiments, an interactive application server provides a host for managing head-to-head play operating over a network of interactive controllers connected to the interactive application server using a communication link. The interactive application server provides an environment where players or players can compete directly with one another and interact with other players or players.

In many embodiments, the credit processing subcontroller 105 operatively connects to one or more credit input devices for generating incoming credit data from a credit input. Credit inputs can include, but are not limited to, credit items used to transfer credits. The incoming credit data are communicated by the credit processing subcontroller 105 to the metering subcontroller 140. In various embodiments, the one or more credit input devices and their corresponding credit items include, but are not limited to: card readers for reading cards having magnetic stripes, RFID chips, smart chips, and the like; scanners for reading various types of printed indicia printed on to various types of media such as vouchers, coupons, TITO tickets, rewritable cards, or the like; and bill validator and/or coin validators that receive and validate paper and/or coin currency or tokens.

In various embodiments, the credit processing subcontroller 105 includes one or more credit output devices 146 for generating a credit output based on outgoing credit data 192 communicated from the wagering subcontroller. Credit outputs can include, but are not limited to, credit items used to transfer credits. Types of credit output devices and their corresponding credit items may include, but are not limited to: writing devices that are used to write to cards having magnetic stripes, smart chips or the like; printers for printing various types of printed indicia onto vouchers, coupons, TITO tickets, vouchers, rewritable cards or the like; and bill and/or coin dispensers that output paper and/or coin currency or tokens.

In some embodiments, the credit processing subcontroller 105 is operatively connected to, and communicates with, a TITO system 188 or the like to determine incoming credit data representing amounts of credits to be transferred into the outcome selector interactive wagering system and to determine outgoing credit data representing amounts of credits to be transferred out of the outcome selector interactive wagering system. In operation, the credit processing subcontroller 105 communicates with a connected credit input device, such as a bill validator/ticket scanner, used to scan a credit input in the form of a TITO ticket having indicia of credit account data of a credit account of the TITO system. The credit processing subcontroller 105 communicates the credit account data to the TITO system. The TITO system uses the credit account data to determine an amount of credits to transfer to the credit processing subcontroller 105, and thus to the metering subcontroller 140 of the process controller 104. The TITO system communicates the amount of credits to the credit processing subcontroller 105. The credit processing subcontroller 105 communicates the amount of credits as incoming credit data to the metering subcontroller 140 and the metering subcontroller 140 credits one or more credit meters 142 with the amount of credits so that the credits can be used when a player makes wagers using the outcome selector interactive wagering system 100.

In many embodiments, the credit processing subcontroller 105 is operatively connected to a bill validator/ticket scanner as one of the one or more credit input devices 144. The credit processing subcontroller 105 communicates with the bill validator/ticket scanner to scan currency used as a credit input to determine an amount of credits as incoming credit data to transfer credit to one or more credit meters 110 associated with one or more players. The skill metering subcontroller 140 credits the one or more credit meters 110 with the amount of credits so that the credits can be used when a player makes wagers using the outcome selector interactive wagering system 100.

In some embodiments, the credit processing subcontroller 105 can use a TITO system along with a ticket or voucher printer as one of the one or more credit output devices 146 to generate a TITO ticket as a credit output for a player. In operation, the credit processing subcontroller 105 communicates, as outgoing credit data, data of an amount of credits to be credited to a credit account on the TITO system. The TITO system receives the amount of credits and creates the credit account and credits the credit account with the amount of credits. The TITO system generates credit account data for the credit account and communicates the credit account data to the credit processing subcontroller 105. The credit processing subcontroller 105 uses the ticket or voucher printer to print indicia of the credit account data onto a TITO ticket or voucher as a credit output.

In various embodiments, a credit processing interface 156 resident in the credit processing subcontroller 105 provides an interface between the credit processing subcontroller 156 and the process controller 104.

In some embodiments, the credit processing interface 156 implements a credit processing subcontroller to process controller communication protocol employing an interprocess communication protocol so that the process controller 104 and the credit processing subcontroller 105 may be implemented on the same device. In operation, the credit processing interface 156 provides application programming interfaces that are used by the credit processing subcontroller 105 to communicate outgoing data and receive incoming data by passing parameter data to another process or application.

In some embodiments, the credit processing interface 156 implements process controller to credit processing subcontroller communication protocol employing an interdevice communication protocol so that the process controller and the credit processing subcontroller may be implemented on different devices. The interdevice protocol may utilize a wired communication bus or wireless network as a physical layer.

In various embodiments, the credit processing interface 156 implements a process controller to credit processing subcontroller communication protocol employing a networking protocol so that the process controller 104 and the credit processing subcontroller 105 may be implemented on different devices connected by a network. The networking protocol may utilize a wired communication bus or wireless network as a physical layer. During operation, the credit processing interface 156 communicates outgoing data to an external device by encoding the data into a signal and transmitting the signal to an external device. The application control interface receives incoming data from an external device by receiving a signal transmitted by the external device and decoding the signal to obtain the incoming data.

In various embodiments, the credit processing subcontroller 105 provides an interface to an electronic payment management system 190 such as an electronic wallet or the like. The electronic payment system provides credit account data that is used for generating incoming credit data as a credit input and outgoing credit data as a credit output.

Figure 3A:
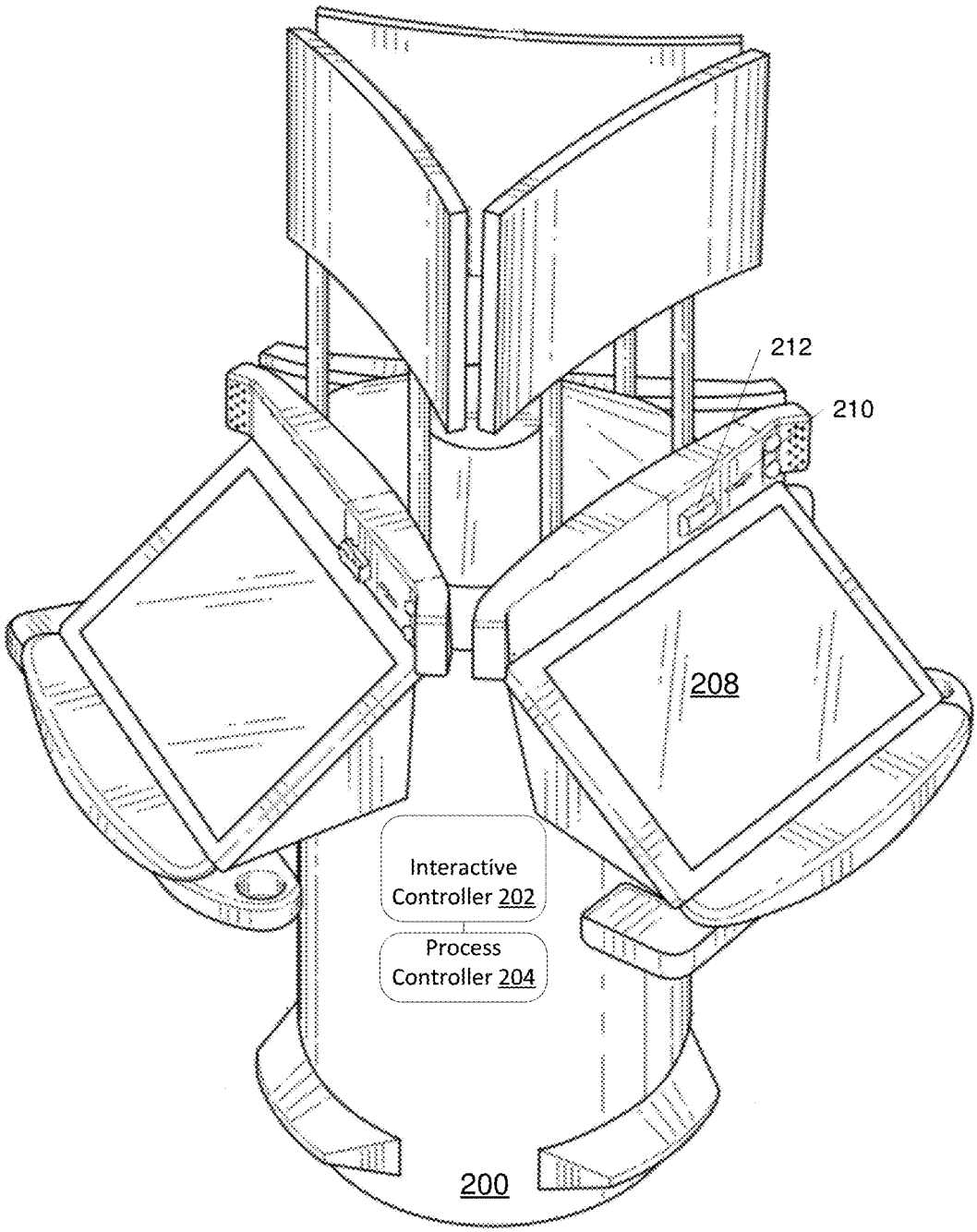
FIG. 3A is a diagram of an electronic gaming machine configuration of an outcome selector interactive wagering system in accordance with various embodiments of the invention.

FIG. 3A is a diagram of an electronic gaming machine configuration of an outcome selector interactive wagering system in accordance with various embodiments of the invention. Electronic gaming machine configurations of an outcome selector interactive wagering system include, but are not limited to, electronic gaming machines such as slot machines, table games, video arcade consoles and the like. An electronic gaming machine configuration of an outcome selector interactive wagering system 200 includes an interactive controller 202 as described herein and a process controller 204 as described herein contained in an enclosure such as a housing, cabinet, casing or the like. The enclosure may further include one or more player accessible openings or surfaces that may be used to mount one or more player accessible user input devices and user output devices 208 as described herein, one or more player accessible credit input devices 210 and one or more player accessible credit output devices 212 as described herein. The interactive controller 202 communicates with the user input devices to detect player interactions with the outcome selector interactive wagering system and commands and controls the user output devices to provide a user interface to one or more players of the outcome selector interactive wagering system as described herein. The process controller 204 communicates using a credit processing subcontroller to one or more player credit processing devices, such as credit input device 210 and credit output device 212 to transfer credits into and out of the outcome selector interactive wagering system as described herein.

In various embodiments, the process controller 204 uses a credit processing subcontroller operatively connected to one or more credit input devices 210 for generating incoming credit data from a credit input as described herein.

In various embodiments, the credit processing subcontroller is operatively connected to the one or more credit output devices 212 for generating a credit output based on outgoing credit data communicated from the process controller 204 as described herein.

In some embodiments, the credit processing subcontroller is operatively connected to, and communicates with, a TITO system (not shown) or the like to determine incoming credit data representing amounts of credits to be transferred into the outcome selector interactive wagering system 200 and to determine outgoing credit data representing amounts of credits to be transferred out of the outcome selector interactive wagering system 200 as described herein.

In various embodiments, the credit processing subcontroller provides an interface to an electronic payment system (not shown) such an electronic wallet or the like. The electronic payment system provides credit account data that is used for generating incoming credit data as a credit input and outgoing credit data as a credit output as described herein.

In some embodiments, the process controller 204 is operatively connected to a central determination controller (not shown) as described herein.

In various embodiments, the wagering process controller 204 may be operatively connected to a progressive controller along (not shown) with one or more other process controllers of one or more other outcome selector interactive wagering systems as described herein.

Figure 3B:
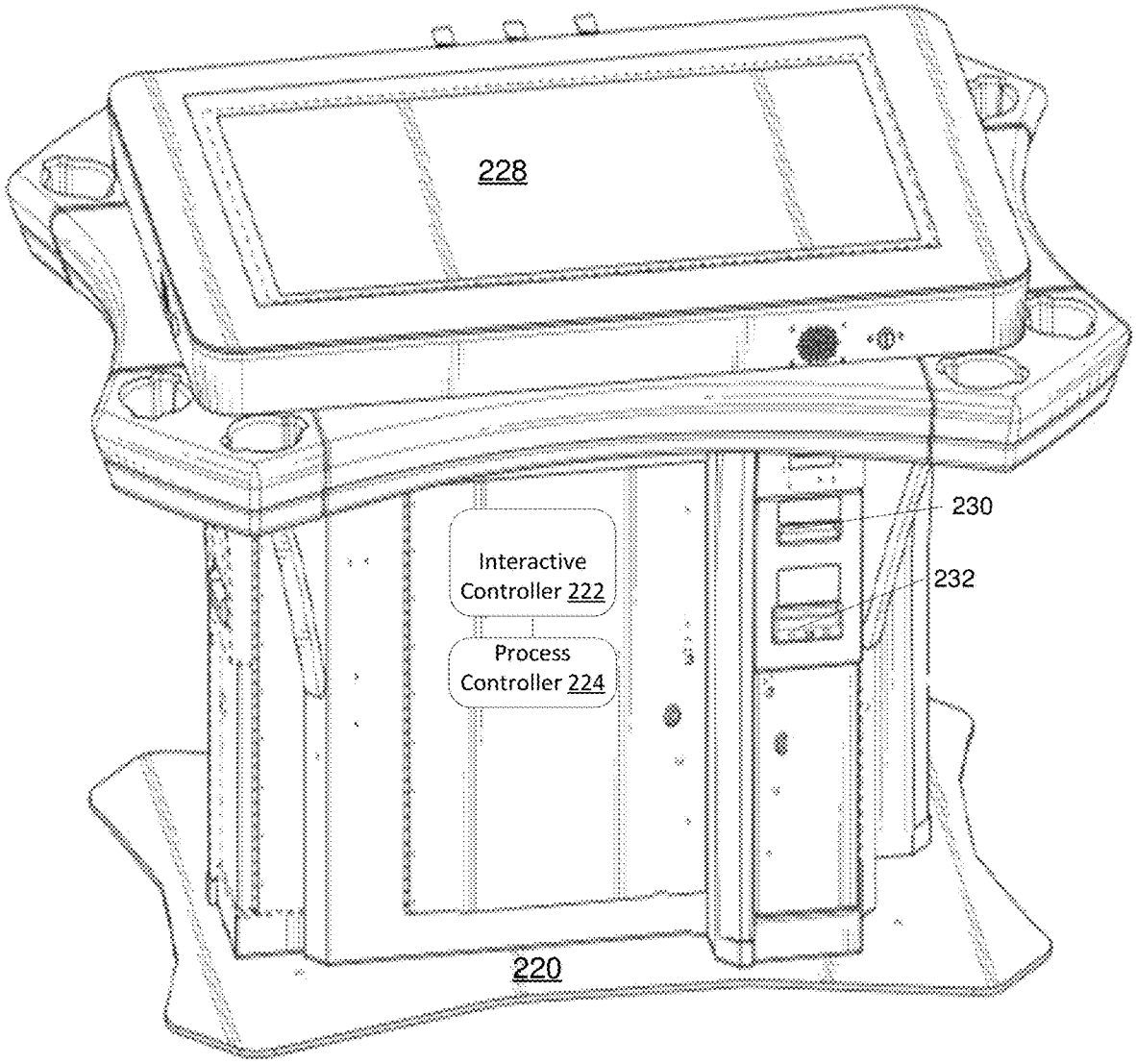
FIG. 3B is a diagram of a table electronic gaming machine configuration of an outcome selector interactive wagering system in accordance with various embodiments of the invention.

FIG. 3B is a diagram of multiplayer or multiplayer electronic gaming machine configuration of an outcome selector interactive wagering system in accordance with various embodiments of the invention. Types of a multiplayer or multiplayer electronic gaming machine configuration an outcome selector interactive wagering system include, but are not limited to, multiplayer or multiplayer electronic gaming machines, multiplayer or multiplayer slot machines, multiplayer or multiplayer table gaming devices, multiplayer or multiplayer video arcade consoles and the like. A multiplayer or multiplayer electronic gaming machine configuration of an outcome selector interactive wagering system 220 includes an interactive controller 222 as described herein and a process controller 224 as described herein contained in an enclosure such as a housing, cabinet, casing or the like. The enclosure may further include one or more player accessible openings or surfaces that may be used to mount one or more player accessible user input devices and user output devices 228 as described herein, one or more player accessible credit input devices 230 as described herein and one or more player accessible credit output devices 232 as described herein.

In some embodiments, two or more sets of credit input devices and credit output devices are provided so that each player of the multiplayer or multiplayer electronic gaming machine configuration of an outcome selector interactive wagering system 220 can have an associated set of credit input devices and credit output devices.

The interactive controller 222 communicates with the user input devices to detect player interactions with the outcome selector interactive wagering system and commands and controls the user output devices to provide a user interface to one or more players of the outcome selector interactive wagering system as described herein. The process controller 224 communicates with the credit processing subcontroller 226 or player credit processing devices 230 and 232 to transfer credits into and out of the outcome selector interactive wagering system as described herein.

In various embodiments, the process controller 224 uses a credit processing subcontroller operatively connected to one or more credit input devices 230 for generating incoming credit data from a credit input as described herein.

In various embodiments, the credit processing subcontroller is operatively connected to the one or more credit output devices 232 for generating a credit output based on outgoing credit data communicated from the process controller 224 as described herein.

In some embodiments, the credit processing subcontroller is operatively connected to, and communicates with, a TITO system (not shown) or the like to determine incoming credit data representing amounts of credits to be transferred into the outcome selector interactive wagering system 220 and to determine outgoing credit data representing amounts of credits to be transferred out of the outcome selector interactive wagering system 220 as described herein.

In various embodiments, the credit processing subcontroller provides an interface to an electronic payment system (not shown) such an electronic wallet or the like. The electronic payment system provides credit account data that is used for generating incoming credit data as a credit input and outgoing credit data as a credit output as described herein.

In some embodiments, the process controller 224 is operatively connected to a central determination controller (not shown) as described herein.

In various embodiments, the wagering process controller 224 may be operatively connected to a progressive controller along (not shown) with one or more other process controllers of one or more other outcome selector interactive wagering systems as described herein.

Figure 3C:
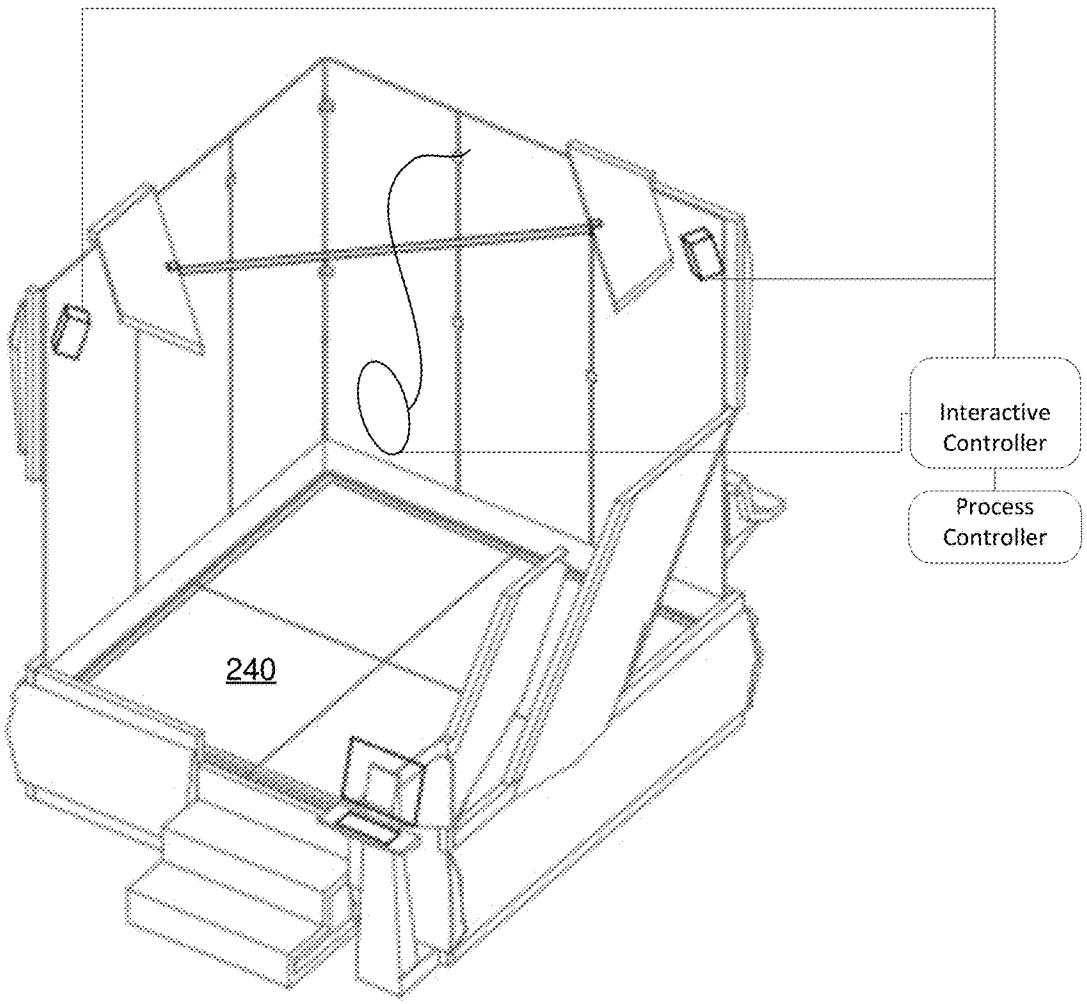
FIG. 3C is a diagram of a virtual reality gaming machine configuration of an outcome selector interactive wagering system in accordance with various embodiments of the invention.

FIG. 3C is a diagram of virtual reality gaming machine configuration of an outcome selector interactive wagering system in accordance with various embodiments of the invention. Types of a virtual reality gaming machine configuration of an outcome selector interactive wagering system include, but are not limited to, virtual reality gaming machines, virtual reality slot machines, virtual reality gaming devices, virtual reality arcade consoles and the like. A virtual reality gaming machine 240 configuration of an outcome selector interactive wagering system includes an interactive controller, a process controller and a credit processing subcontroller contained in an enclosure such as a housing, cabinet, casing or the like. The enclosure may further include one or more player accessible openings or surfaces that may be used to mount one or more player accessible user input devices and user output devices, one or more player accessible credit input devices and one or more player accessible credit output devices.

A virtual reality gaming machine configuration of an outcome selector interactive wagering system further includes a player area having virtual reality sensors for sensing player interactions and/or player movements within the player area, a player headset having a stereoscopic visual display for presentation of a stereoscopic presentation to a player, headphones for presenting a stereophonic sound presentation to a player, and one or more subwoofers for providing a hepatic or low frequency auditory presentation to the player.

The interactive controller communicates with the user input devices to detect player interactions with the virtual reality outcome selector interactive wagering system and commands and controls the user output devices to provide a user interface to one or more players of the virtual reality outcome selector interactive wagering system as described herein. The process controller communicates with the credit processing subcontroller or player credit processing devices and to transfer credits into and out of the outcome selector interactive wagering system as described herein.

In many embodiments, the process controller is further connected to one or more side betting terminals that enable spectators of a player using the virtual reality outcome selector interactive wagering system to make side bets based on the performance of the player.

In various embodiments, the process controller 224 uses a credit processing subcontroller operatively connected to one or more credit input devices 230 for generating incoming credit data from a credit input as described herein.

In various embodiments, the credit processing subcontroller is operatively connected to the one or more credit output devices 232 for generating a credit output based on outgoing credit data communicated from the process controller 224 as described herein.

In some embodiments, the credit processing subcontroller is operatively connected to, and communicates with, a TITO system (not shown) or the like to determine incoming credit data representing amounts of credits to be transferred into the outcome selector interactive wagering system 220 and to determine outgoing credit data representing amounts of credits to be transferred out of the outcome selector interactive wagering system 220 as described herein.

In various embodiments, the credit processing subcontroller provides an interface to an electronic payment system (not shown) such an electronic wallet or the like. The electronic payment system provides credit account data that is used for generating incoming credit data as a credit input and outgoing credit data as a credit output as described herein.

In some embodiments, the process controller 224 is operatively connected to a central determination controller (not shown) as described herein.

In various embodiments, the wagering process controller 224 may be operatively connected to a progressive controller along (not shown) with one or more other process controllers of one or more other outcome selector interactive wagering systems as described herein.

Figure 4:
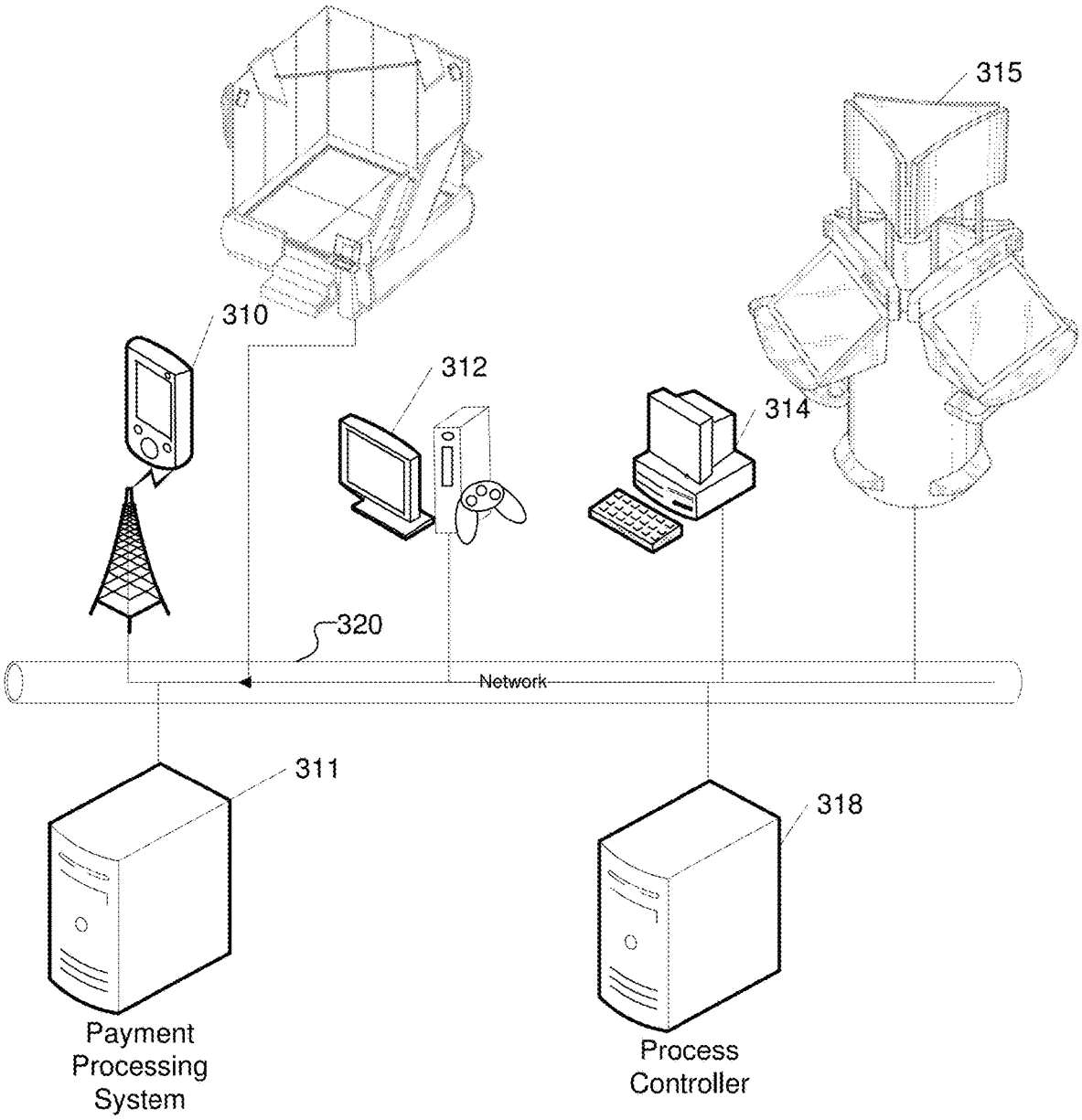
FIG. 4 is a diagram of distributed outcome selector interactive wagering systems in accordance with various embodiments of the invention.

FIG. 4 is a diagram of distributed outcome selector interactive wagering systems in accordance with various embodiments of the invention. An interactive controller, such as interactive controller 102 of FIG. 1, may be constructed from or configured using one or more processing devices that perform the operations of the interactive controller. An interactive controller in a distributed outcome selector interactive wagering system may be constructed from or configured using any processing device having sufficient processing and communication capabilities to perform the processes of an interactive controller in accordance with various embodiments of the invention. In some embodiments, the construction or configuration of the interactive controller may be achieved through the use of an application control interface, such as application control interface 122 of FIG. 1, and/or through the use of an interactive application, such as interactive application 110 of FIG. 1.

In some embodiments, an interactive controller may be constructed from or configured using an electronic gaming machine 315, such as a slot machine or the like. The electronic gaming machine 315 may be physically located in various types of gaming establishments.

In many embodiments, an interactive controller may be constructed from or configured using a portable device 310. The portable device 310 is a device that may wirelessly connect to a network. Examples of portable devices include, but are not limited to, a tablet computer, a personal digital assistant, and a smartphone.

In some embodiments, an interactive controller may be constructed from or configured using a gaming console 312.

In various embodiments, an interactive controller may be constructed from or configured using a personal computer 314.

In some embodiments, one or more processing devices, such as devices 310, 312, 314, 315 and a virtual reality gaming machine may be used to construct a complete outcome selector interactive wagering system and may be operatively connected using a communication link to a session and/or management controller.

Some outcome selector interactive wagering systems in accordance with many embodiments of the invention can be distributed across a plurality of devices in various configurations. One or more interactive controllers of a distributed outcome selector interactive wagering system, such as but not limited to, a mobile or wireless device 310, a gaming console 312, a personal computer 314, an electronic gaming machine 315, and a virtual reality gaming machine are operatively connected with a process controller 318 of a distributed outcome selector interactive wagering system using a communication link 320. Communication link 320 is a communications link that allows processing systems to communicate with each other and to share data. Embodiments of a communication link include, but are not limited to: a wired or wireless interdevice communication link; a serial or parallel interdevice communication bus; a wired or wireless network such as a Local Area Network (LAN), a Wide Area Network (WAN), or the link; or a wired or wireless communication network such as a wireless telecommunications network or plain old telephone system (POTS). In some embodiments, one or more processes of an interactive controller and a process controller as described herein are executed on the individual interactive controllers 310, 312, 314, 315 and a virtual reality gaming machine while one or more processes of a process controller as described herein can be executed by the process controller 318.

In many embodiments, a distributed outcome selector interactive wagering system and may be operatively connected using a communication link to a session controller (not shown), that performs the processes of a session controller as described herein.

In several embodiments, a distributed outcome selector interactive wagering system and may be operatively connected using a communication link to credit processing system 311, that performs the processes of one or more credit processing systems as described herein.

Figure 5A:
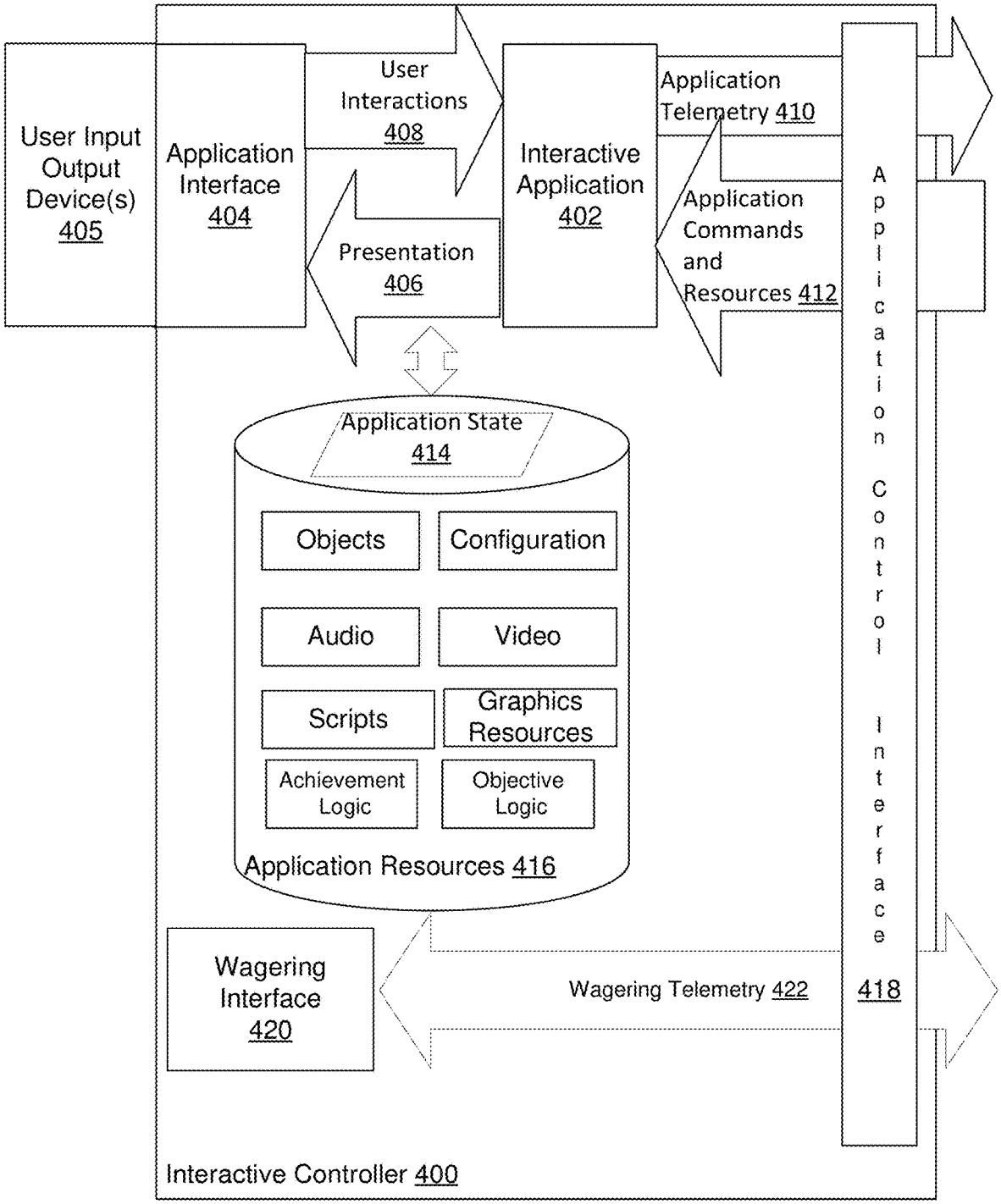
FIGS. 5A and 5B are diagrams of a structure of an interactive controller of an outcome selector interactive wagering system in accordance with various embodiments of the invention.
Figure 5B:
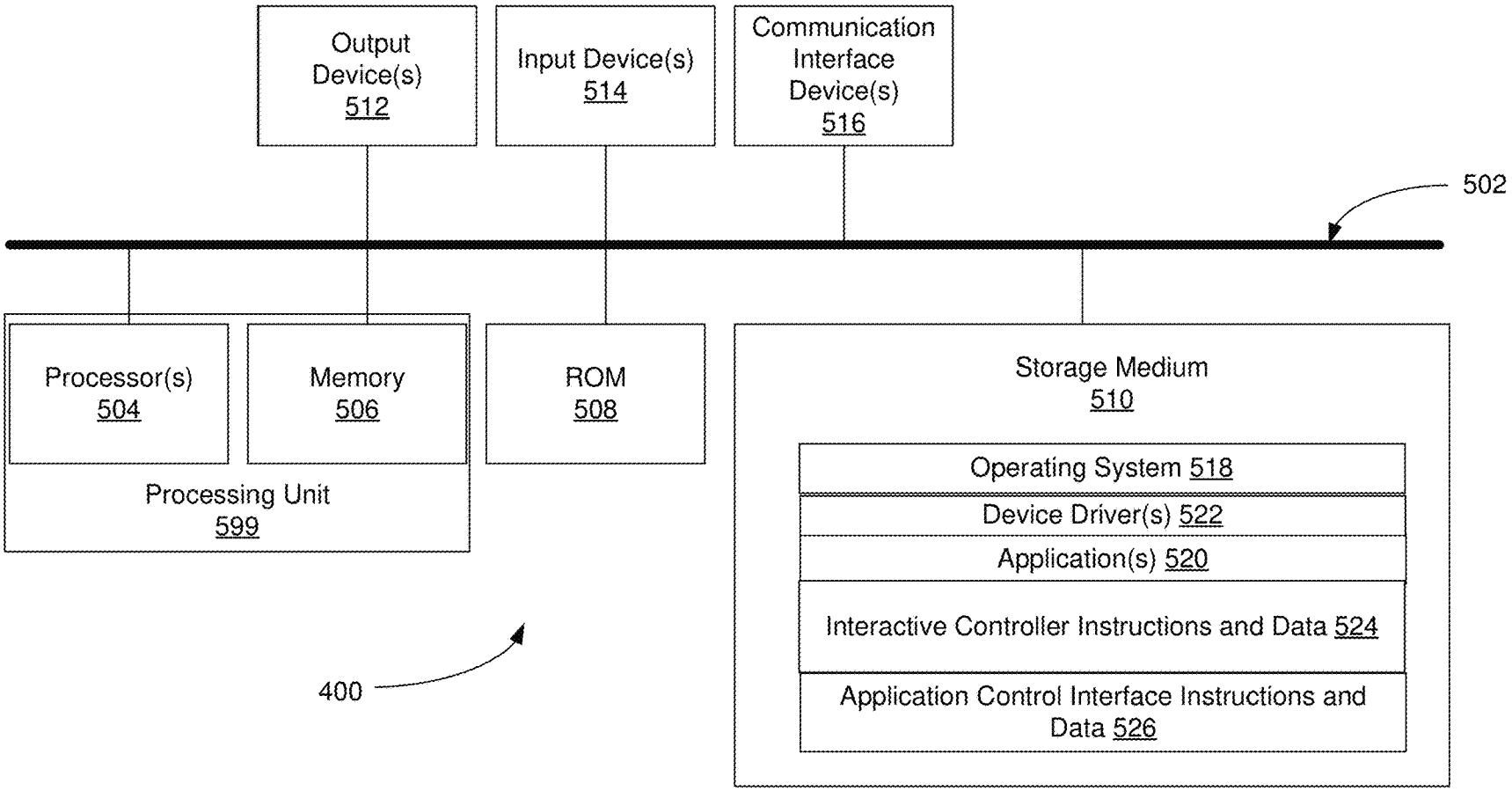

FIGS. 5A and 5B are architecture diagrams of an interactive controller in accordance with various embodiments of the invention. Referring now to FIG. 5A, an interactive controller 400, suitable for use as interactive controller 102 of FIG. 1, provides an execution environment for an interactive application 402 of an outcome selector interactive wagering system. In several embodiments, an interactive controller 400 of an outcome selector interactive wagering system provides an interactive application 402 that generates an application interface 404 for interaction with by a player. The interactive application 402 generates a player presentation 406 that is presented to the player through the application interface 404 using one or more user input and output devices 405. The player presentation 406 may include audio features, visual features or tactile features, or any combination of these features. In various embodiments, the application interface 404 utilizes one or more user interface input and output devices 405 so that a player can interact with the player presentation 406. In various embodiments, user interface input devices include, but are not limited to: buttons or keys; keyboards; keypads; game controllers; joysticks; computer mice; track balls; track buttons; touch pads; touch screens; accelerometers; motion sensors; video input devices; microphones; and the like. In various embodiments, user interface output devices include, but are not limited to: audio output devices such as speakers, headphones, earbuds, and the like; visual output devices such as lights, video displays and the like; and tactile devices such as rumble pads, hepatic touch screens, buttons, keys and the like. The player's interactions 408 are included by the interactive application 402 in application telemetry data 410 that is communicated by interactive controller 400 to various other components of an outcome selector interactive wagering system as described herein. The interactive application 402 receives application commands and resources 412 communicated from various other components of an outcome selector interactive wagering system as described herein. In some embodiments, the application telemetry data 410 may include player interactions with objects of the interactive application and an interactive objective achievement for an interactive objective presented to the player by the interactive application 402.

In some embodiments, various components of the interactive application 402 can read data from an application state 414 in order to provide one or more features of the interactive application. In various embodiments, components of the interactive application 402 can include, but are not limited to: a physics engine; a rules engine; an audio engine; a graphics engine and the like. The physics engine is used to simulate physical interactions between virtual objects in the interactive application 402. The rules engine implements the rules of the interactive application and a random number generator that may be used for influencing or determining certain variables and/or outcomes to provide a randomizing influence on the operations of the interactive application. The graphics engine is used to generate a visual representation of the interactive application state to the player. The audio engine is used to generate an audio representation of the interactive application state to the player.

During operation, the interactive application reads and writes application resources 416 stored on a data store of the interactive controller host. The application resources 416 may include objects having graphics and/or control logic used to provide application environment objects of the interactive application. In various embodiments, the resources may also include, but are not limited to, video files that are used to generate a portion of the player presentation 406; audio files used to generate music, sound effects, etc. within the interactive application; configuration files used to configure the features of the interactive application; scripts or other types of control code used to provide various features of the interactive application; graphics resources such as textures, objects, etc. that are used by a graphics engine to render objects displayed in an interactive application; interactive objective achievement logic used to detect an interactive objective achievement of an interactive objective using player interactions with the player presentation; and interactive objective logic used by the interactive application 402 to generate one or more interactive objectives.

In operation, components of the interactive application 402 read portions of the application state 414 and generate the player presentation 406 for the player that is presented to the player using the user interface 404. The player perceives the player presentation and provides player interactions 408 using the user input devices. The corresponding player interactions are received as player actions or inputs by various components of the interactive application 402. The interactive application 402 translates the player actions into interactions with the virtual objects of the application environment stored in the application state 414. Components of the interactive application use the player interactions with the virtual objects of the interactive application and the interactive application state 414 to update the application state 414 and update the player presentation 406 presented to the player. The process loops continuously while the player interacts with the interactive application of the outcome selector interactive wagering system.

The interactive controller 400 provides one or more interfaces 418 between the interactive controller 400 and other components of an outcome selector interactive wagering system, such as, but not limited to, a process controller. The interactive controller 400 and the other outcome selector interactive wagering system components communicate with each other using the interface. The interface may be used to pass various types of data, and to communicate and receive messages, status data, commands and the like. In certain embodiments, the interactive controller 400 and a process controller communicate application commands and resources 412 and application telemetry data 410. In some embodiments, the communications include requests by the process controller that the interactive controller 400 update the application state 414 using data provided by the process controller.

In many embodiments, communications between a process controller and the interactive controller 400 includes a request that the interactive controller 400 update one or more resources 416 using data provided by the process controller. In a number of embodiments, the interactive controller 400 provides all or a portion of the application state to the process controller. In some embodiments, the interactive controller 400 may also provide data about one or more of the application resources 416 to the process controller. In some embodiments, the communication includes player interactions that the interactive controller 400 communicates to the process controller. The player interactions may be low level player interactions with the user interface 404, such as manipulation of an input device, or may be high level player interactions with game world objects as detected by the interactive application. The player interactions may also include resultant actions such as modifications to the application state 414 or game resources 416 resulting from the player's interactions taken in the outcome selector interactive wagering system interactive application. In some embodiments, player interactions include, but are not limited to, actions taken by entities such as non-player characters (NPCs) of the interactive application that act on behalf of or under the control of the player.

In various embodiments, the application commands and resources 412 include interactive objective application commands and/or resources used by the interactive application to generate a presentation of an interactive objective presented to a player and to detect an interactive objective achievement based on the player's skillful interaction with the presentation of the interactive objective.

In some embodiments, the interactive controller 400 includes a wagering user interface 420 used to provide outcome selector interactive wagering system telemetry data 422 to and from the player. The outcome selector interactive wagering system telemetry data 422 from the outcome selector interactive wagering system includes, but is not limited to, data used by the player to configure credit, application credit and interactive element wagers, and data about the interactive wagering process credits, application credits and interactive element wagers such as, but not limited to, credit, application credit and interactive element balances and credit, application credit and interactive element amounts wagered.

In some embodiments, the interactive controller includes one or more sensors (not shown). Such sensors may include, but are not limited to, physiological sensors that monitor the physiology of the player, environmental sensors that monitor the physical environment of the interactive controller, accelerometers that monitor changes in motion of the interactive controller, and location sensors that monitor the location of the interactive controller such as global positioning sensors (GPSs). The interactive controller 400 communicates sensor telemetry data to one or more components of the outcome selector interactive wagering system.

Referring now to FIG. 5B, interactive controller 400 includes a bus 502 that provides an interface for one or more processors 504, random access memory (RAM) 506, read only memory (ROM) 508, machine-readable storage medium 510, one or more user output devices 512, one or more user input devices 514, and one or more communication interface devices 516.

The one or more processors 504 may take many forms, such as, but not limited to: a central processing unit (CPU); a multi-processor unit (MPU); an ARM processor; a controller; a programmable logic device; or the like.

In the example embodiment, the one or more processors 504 and the random access memory (RAM) 506 form an interactive controller processing unit 599. In some embodiments, the interactive controller processing unit includes one or more processors operatively connected to one or more of a RAM, ROM, and machine-readable storage medium; the one or more processors of the interactive controller processing unit receive instructions stored by the one or more of a RAM, ROM, and machine-readable storage medium via a bus; and the one or more processors execute the received instructions. In some embodiments, the interactive controller processing unit is an ASIC (Application-Specific Integrated Circuit). In some embodiments, the interactive controller processing unit is a SoC (System-on-Chip).

Examples of output devices 512 include, but are not limited to, display screens; light panels; and/or lighted displays. In accordance with particular embodiments, the one or more processors 504 are operatively connected to audio output devices such as, but not limited to: speakers; and/or sound amplifiers. In accordance with many of these embodiments, the one or more processors 504 are operatively connected to tactile output devices like vibrators, and/or manipulators.

Examples of user input devices 514 include, but are not limited to: tactile devices including but not limited to, keyboards, keypads, foot pads, touch screens, and/or trackballs; non-contact devices such as audio input devices; motion sensors and motion capture devices that the interactive controller can use to receive inputs from a player when the player interacts with the interactive controller; physiological sensors that monitor the physiology of the player; environmental sensors that monitor the physical environment of the interactive controller; accelerometers that monitor changes in motion of the interactive controller; and location sensors that monitor the location of the interactive controller such as global positioning sensors.

The one or more communication interface devices 516 provide one or more wired or wireless interfaces for communicating data and commands between the interactive controller 400 and other devices that may be included in an outcome selector interactive wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a plain old telephone system (POTS) interface, a cellular or satellite telephone network interface; and the like.

The machine-readable storage medium 510 stores machine-executable instructions for various components of the interactive controller, such as but not limited to: an operating system 518; one or more device drivers 522; one or more application programs 520 including but not limited to an interactive application; and outcome selector interactive wagering system interactive controller instructions and data 524 for use by the one or more processors 504 to provide the features of an interactive controller as described herein. In some embodiments, the machine-executable instructions further include application control interface/application control interface instructions and data 526 for use by the one or more processors 504 to provide the features of an application control interface/application control interface as described herein.

In various embodiments, the machine-readable storage medium 510 is one of a (or a combination of two or more of) a hard drive, a flash drive, a DVD, a CD, a flash storage, a solid state drive, a ROM, an EIEPROM, and the like.

In operation, the machine-executable instructions are loaded into memory 506 from the machine-readable storage medium 510, the ROM 508 or any other storage location. The respective machine-executable instructions are accessed by the one or more processors 504 via the bus 502, and then executed by the one or more processors 504. Data used by the one or more processors 504 are also stored in memory 506, and the one or more processors 504 access such data during execution of the machine-executable instructions. Execution of the machine-executable instructions causes the one or more processors 504 to control the interactive controller 400 to provide the features of an outcome selector interactive wagering system interactive controller as described herein Although the interactive controller is described herein as being constructed from or configured using one or more processors and instructions stored and executed by hardware components, the interactive controller can be constructed from or configured using only hardware components in accordance with other embodiments. In addition, although the storage medium 510 is described as being operatively connected to the one or more processors through a bus, those skilled in the art of interactive controllers will understand that the storage medium can include removable media such as, but not limited to, a USB memory device, an optical CD ROM, magnetic media such as tape and disks. In some embodiments, the storage medium 510 can be accessed by the one or more processors 504 through one of the communication interface devices 516 or using a communication link. Furthermore, any of the user input devices or user output devices can be operatively connected to the one or more processors 504 via one of the communication interface devices 516 or using a communication link.

In some embodiments, the interactive controller 400 can be distributed across a plurality of different devices. In many such embodiments, an interactive controller of an outcome selector interactive wagering system includes an interactive application server operatively connected to an interactive client using a communication link. The interactive application server and interactive application client cooperate to provide the features of an interactive controller as described herein.

In various embodiments, the interactive controller 400 may be used to construct other components of an outcome selector interactive wagering system as described herein.

Figure 6:
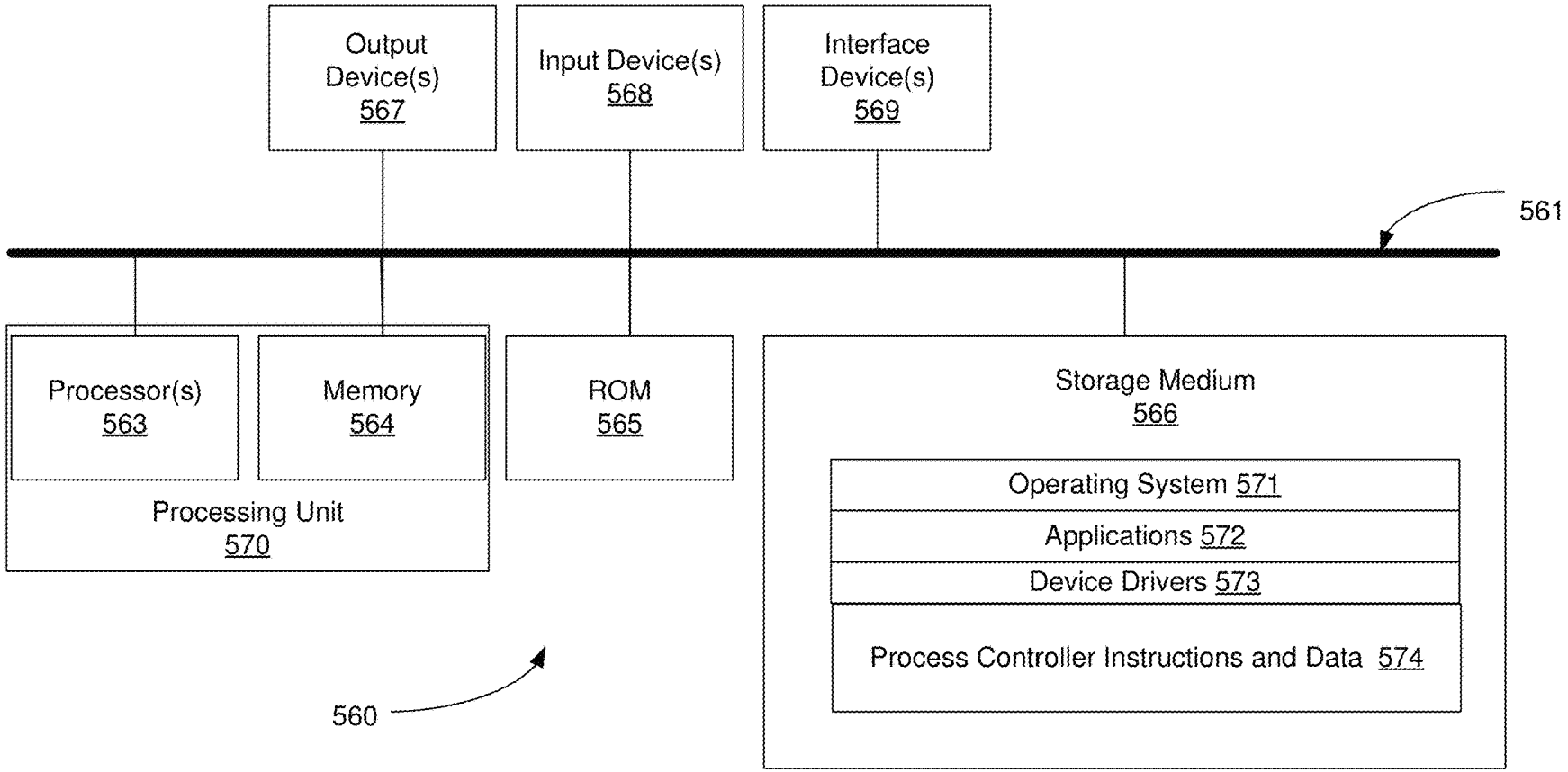
FIG. 6 is a diagram of a structure of a process controller of an outcome selector interactive wagering system in accordance with various embodiments of the invention.

FIG. 6 is an architecture diagram of a process controller, suitable for use as process controller 104 of FIG. 1, of an outcome selector interactive wagering system in accordance with various embodiments of the invention. A process controller may be constructed from or configured using one or more processing devices that perform the operations of the process controller. In many embodiments, a process controller can be constructed from or configured using various types of processing devices including, but not limited to, a mobile device such as a smartphone, a personal digital assistant, a wireless device such as a tablet computer or the like, an electronic gaming machine such as a slot machine, a personal computer, a gaming console, a set-top box, a computing device, a controller, a server, or the like.

Process controller 560 includes a bus 561 providing an interface for one or more processors 563, random access memory (RAM) 564, read only memory (ROM) 565, machine-readable storage medium 566, one or more user output devices 567, one or more user input devices 568, and one or more communication interface and/or network interface devices 569.

The one or more processors 563 may take many forms, such as, but not limited to: a central processing unit (CPU); a multi-processor unit (MPU); an ARM processor; a programmable logic device; or the like.

Examples of output devices 567 include, include, but are not limited to: display screens; light panels; and/or lighted displays. In accordance with particular embodiments, the one or more processors 563 are operatively connected to audio output devices such as, but not limited to: speakers; and/or sound amplifiers. In accordance with many of these embodiments, the one or more processors 563 are operatively connected to tactile output devices like vibrators, and/or manipulators.

In the example embodiment, the one or more processors 563 and the random access memory (RAM) 564 form a process controller processing unit 570. In some embodiments, the process controller processing unit includes one or more processors operatively connected to one or more of a RAM, ROM, and machine-readable storage medium; the one or more processors of the process controller processing unit receive instructions stored by the one or more of a RAM, ROM, and machine-readable storage medium via a bus; and the one or more processors execute the received instructions. In some embodiments, the process controller processing unit is an ASIC (Application-Specific Integrated Circuit). In some embodiments, the process controller processing unit is a SoC (System-on-Chip).

Examples of user input devices 568 include, but are not limited to: tactile devices including but not limited to, keyboards, keypads, foot pads, touch screens, and/or trackballs; non-contact devices such as audio input devices; motion sensors and motion capture devices that the process controller can use to receive inputs from a player when the player interacts with the process controller 560.

The one or more communication interface and/or network interface devices 569 provide one or more wired or wireless interfaces for exchanging data and commands between the process controller 560 and other devices that may be included in an outcome selector interactive wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a plain old telephone system (POTS), cellular, or satellite telephone network interface; and the like.

The machine-readable storage medium 566 stores machine-executable instructions for various components of the process controller 560 such as, but not limited to: an operating system 571; one or more applications 572; one or more device drivers 573; and outcome selector interactive wagering system process controller instructions and data 574 for use by the one or more processors 563 to provide the features of a process controller as described herein.

In various embodiments, the machine-readable storage medium 566 is one of a (or a combination of two or more of) a hard drive, a flash drive, a DVD, a CD, a flash storage, a solid state drive, a ROM, an EIEPROM, and the like.

In operation, the machine-executable instructions are loaded into memory 564 from the machine-readable storage medium 566, the ROM 565 or any other storage location. The respective machine-executable instructions are accessed by the one or more processors 563 via the bus 561, and then executed by the one or more processors 563. Data used by the one or more processors 563 are also stored in memory 564, and the one or more processors 563 access such data during execution of the machine-executable instructions. Execution of the machine-executable instructions causes the one or more processors 563 to control the process controller 560 to provide the features of an outcome selector interactive wagering system process controller as described herein.

Although the process controller 560 is described herein as being constructed from or configured using one or more processors and instructions stored and executed by hardware components, the process controller can be composed of only hardware components in accordance with other embodiments. In addition, although the storage medium 566 is described as being operatively connected to the one or more processors through a bus, those skilled in the art of process controllers will understand that the storage medium can include removable media such as, but not limited to, a USB memory device, an optical CD ROM, magnetic media such as tape and disks. Also, in some embodiments, the storage medium 566 may be accessed by processor 563 through one of the interfaces or using a communication link. Furthermore, any of the user input devices or user output devices may be operatively connected to the one or more processors 563 via one of the interfaces or using a communication link.

In various embodiments, the process controller 560 may be used to construct other components of an outcome selector interactive wagering system as described herein.

Figure 7:
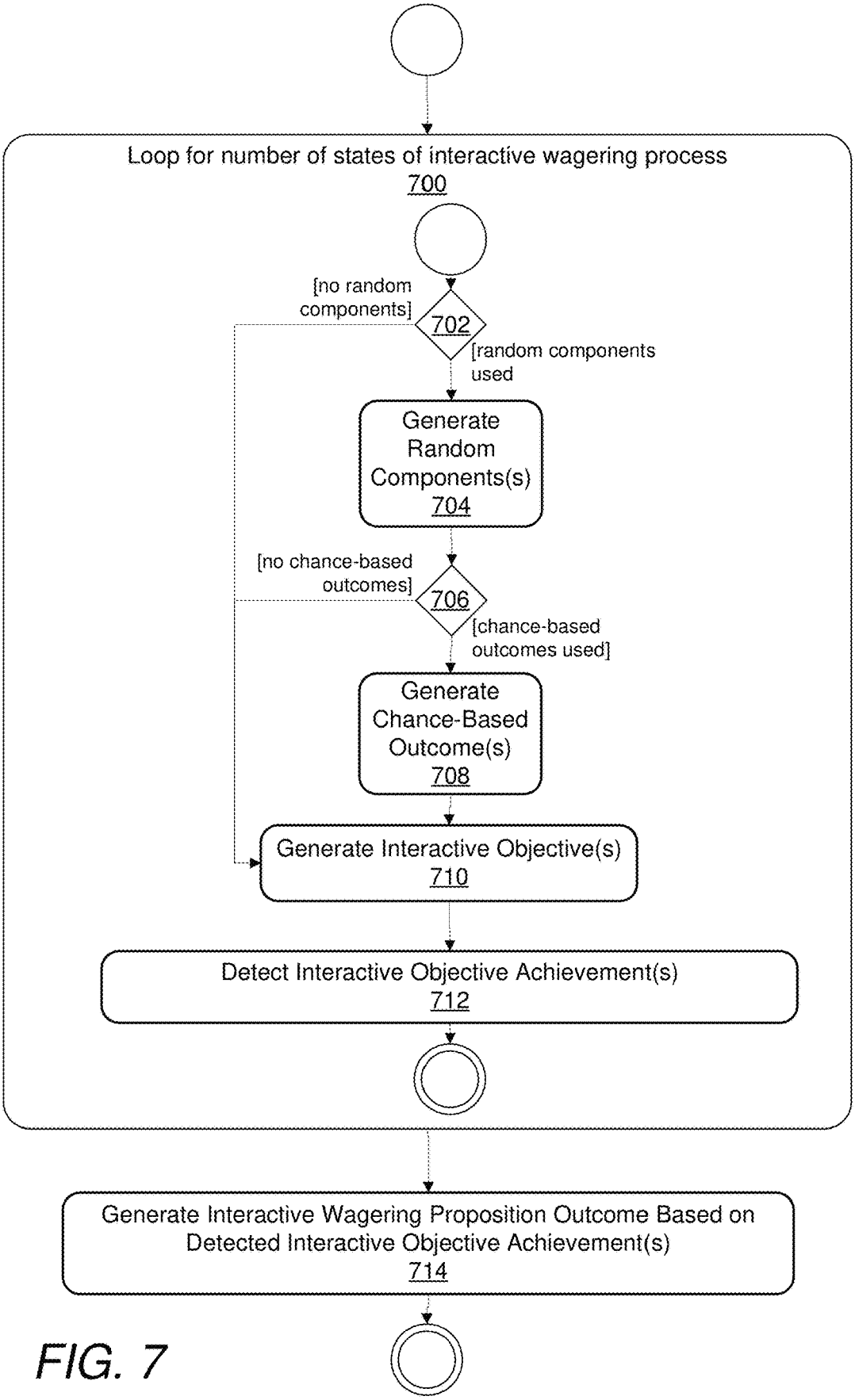
FIG. 7 is an activity diagram of a process of an outcome selector interactive wagering system in accordance with various embodiments of the invention.

FIG. 7 is an activity diagram of interactive wagering process of an outcome selector interactive wagering system during a wagering session in accordance with various embodiments of the invention. In many embodiments, an outcome selector interactive wagering system resolves an interactive wagering proposition by executing one or more iterations of an interactive wagering process where the outcome selector interactive wagering system generates interactive objectives and then detects achievement of the interactive objectives. In an example embodiment, an interactive wagering process loops 700 for a number of states of the interactive wagering process. For each loop, the outcome selector interactive wagering system determines 702 if random components are used to generate one or more interactive objectives the achievement of which will cause the outcome selector interactive wagering system to transition to a new state of the interactive wagering process. If random components are not used, then the outcome selector interactive wagering system generates 710 the one or more interactive objectives. If random components are needed, then the outcome selector interactive wagering system generates 704 one or more random components of the one or more interactive objectives as described herein. The outcome selector interactive wagering system determines 706 if one or more chance-based outcome(s) are used to generate the one or more interactive objectives. If one or more chance-based outcomes are not used, the outcome selector interactive wagering system generates 710 the one or more interactive objectives using the one or more random components as described herein. If one or more chance-based outcome(s) are used, the outcome selector interactive wagering system uses the random components to generate 708 one or more chance-based outcomes. The outcome selector interactive wagering system uses the chance-based outcomes to generate 710 the one or more interactive objectives. The outcome selector interactive wagering system detects one or more interactive objective achievements of the one or more interactive objectives as described herein. The outcome selector interactive wagering system uses the interactive objective achievements to generate 714 an interactive wagering proposition outcome of the interactive wagering process.

Figure 8:
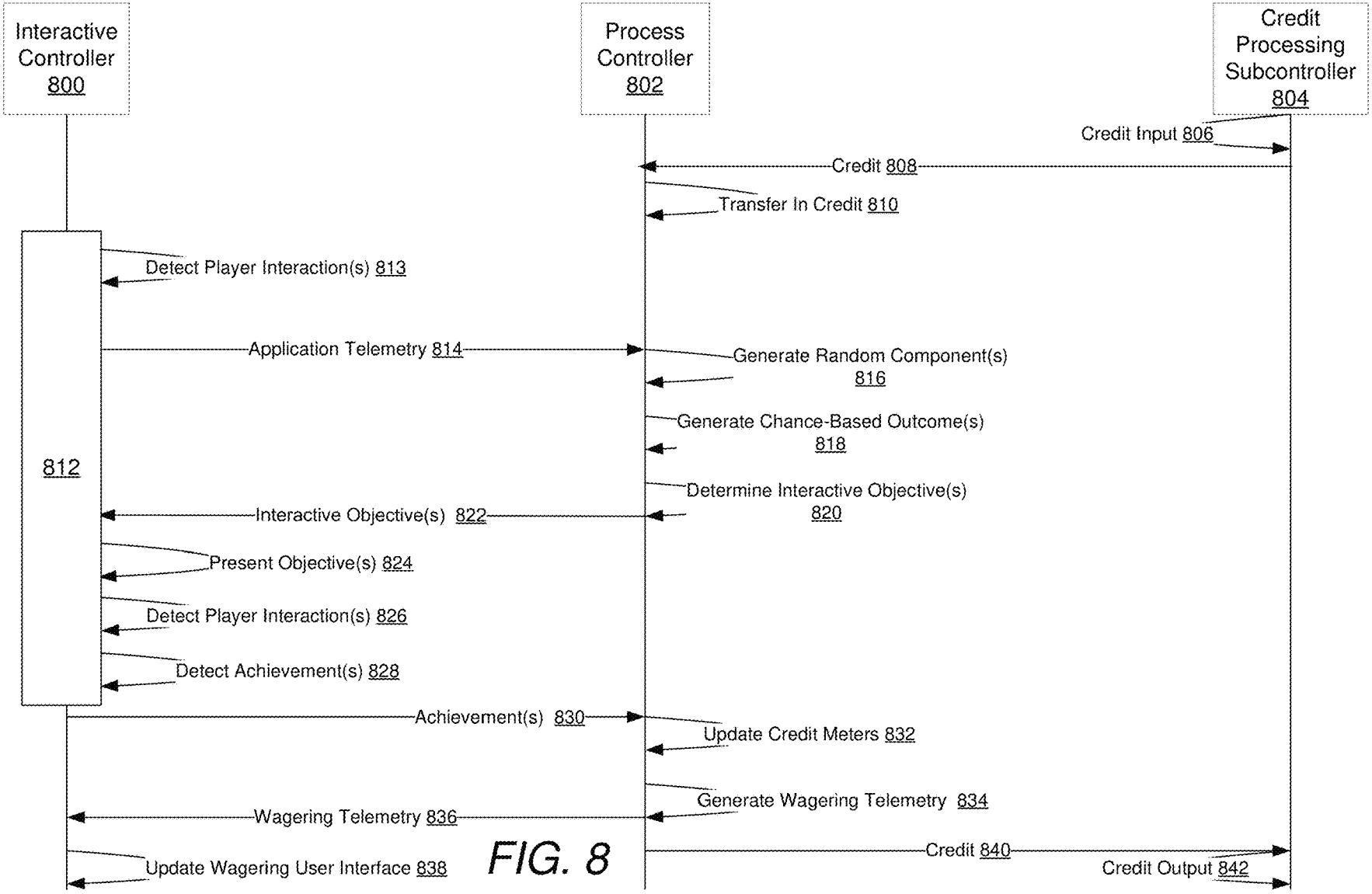
FIG. 8 is a sequence diagram of interactions between components of an outcome selector interactive wagering system in accordance with various embodiments of the invention.

FIG. 8 is a sequence diagram of interactions between components of an outcome selector interactive wagering system during a wagering session in accordance with various embodiments of the invention. In some embodiments, at a beginning of the wagering session, the process includes a credit input 806 to the outcome selector interactive wagering system with a process controller 802 communicating with a credit processing subcontroller 804 to receive incoming credit data 808. The process controller 802 uses the incoming credit data to transfer 810 credits onto one or more player credit meters associated with one or more players of the outcome selector interactive wagering system, thus transferring credits into the outcome selector interactive wagering system and on to the one or more player credit meters.

During an interactive wagering process 812, an interactive controller 800 detects 813 one or more players performing one or more player interactions in an application interface of an interactive application provided by the interactive controller 800. The interactive controller 800 communicates application telemetry data 814 to the process controller 802. The application telemetry data 814 includes, but is not limited to, data of the one or more player interactions detected by the interactive controller 800.

The process controller 802 receives the application telemetry data 814. Upon determination by the process controller 802 that the one or more player interactions indicates a wagering event in accordance with the interactive wagering process 812, the process controller 802 updates the one or more credit meters associated with the one or more players as a commitment of an amount of credit to the wager.

In some embodiments, the process controller 802 generates 820 one or more interactive objectives of the interactive wagering process 812 and communicates data of the one or more interactive objectives 822 to the interactive controller 800.

In many embodiments, the process controller 802 generates 816 one or more random components and uses the one or more random components to generate the one or more interactive objectives of the interactive wagering process.

In various embodiments, the process controller 802 generates 818 one or more chance-based outcomes and uses the one or more chance-based outcomes to generate the one or more interactive objectives of the interactive wagering process.

The interactive controller 800 receives the interactive objective data 822 from the process controller 824 and uses the interactive objective data 822 to generate and present 818 to the one or more players one or more interactive objectives of the interactive wagering process within the context of an interactive application as described herein. The presentation of the one or more interactive objectives is presented to the one or more players in a user interface of the interactive application of the interactive controller 800. The interactive controller 800 detects 826 one or more player interactions of the one or more players with the presentation of the one or more interactive objectives and detects 828 one or more interactive objective achievements for the one or more interactive objectives based on the detected player interactions and the interactive objective data 816. The one or more interactive objective achievements indicate whether or not a player has been able to achieve one or more of the one or more interactive objectives. The interactive controller 800 communicates data of the one or more interactive objective achievements 830 to the process controller 802.

The process controller 802 receives the interactive objective achievement data 830 and resolves an interactive wagering proposition of the interactive wagering process using the data of the one or more interactive objective achievements of the one or more interactive objectives and generates a wager outcome for the interactive wagering proposition. The process controller updates 832 the one or more player credit meters associated with the one or more players based on the wager outcome for the interactive wagering proposition, such as by incrementing an amount of credit to, or decrementing an amount of credit from, the one or more player credit meters.

The process controller 802 generates 834 wagering telemetry data 836 using the interactive objective achievement data 824 and data of the updated one or more credit meters. The process controller 802 communicates the wagering telemetry data 836 to the interactive controller 800. The interactive controller 800 receives the wagering telemetry data 836 and the interactive controller 800 updates 838 a wagering user interface on a partial basis of the wagering telemetry data 836.

In many embodiments, upon determining that a wagering session is completed, such as by receiving a cashout communication from one or more players of the outcome selector interactive wagering system, the process controller 802 transfers credits off of the one or more player credit meters, generates outgoing credit data 840 on the basis of the credits transferred off of the one or more player credit meters, and communicates the outgoing credit data 840 to the credit processing subcontroller 804. The credit processing subcontroller 804 receives the outgoing credit data 840 and generates 842 a credit output as described herein, thus transferring credits off of the one or more player credit meters and out of the outcome selector interactive wagering system.

In various embodiments, a process controller provides one or more random components to an interactive controller. The interactive controller receives the random components and uses the random components to generate one or more interactive objectives of an interactive wagering process as described herein.

In many embodiments, one or more random components are used to generate one or more chance-based outcomes that are included in one or more interactive objectives. The one or more chance-based outcomes are awarded to a player for achieving the one or more interactive objectives.

In some embodiments, at a beginning of the wagering session, the process includes an application credit input to the outcome selector interactive wagering system with the process controller 802 communicating with the credit processing subcontroller 803 to receive incoming application credit data. The process controller 802 uses the incoming application credit data to transfer application credits onto one or more application credit meters associated with one or more players of the outcome selector interactive wagering system, thus transferring application credits into the outcome selector interactive wagering system and on to the one or more application credit meters. The process controller 802 uses the interactive objective achievement data 830 to generate an amount of application credit to award to a player based on the player's achievement of one or more interactive objectives. Upon determining that the wagering session is completed, such as by receiving a cashout communication from one or more players of the outcome selector interactive wagering system, the process controller 802 transfers application credits off of the one or more application credit meters, generates outgoing application credit data on the basis of the application credits transferred off of the one or more application credit meters, and communicates the outgoing application credit data to the credit processing subcontroller 803. The credit processing subcontroller receives the outgoing application credit data and generates an application credit output as described herein, thus transferring application credits off of the one or more application credit meters and out of the outcome selector interactive wagering system.

In an example embodiment, an interactive puzzle is provided as an interactive application by an outcome selector interactive wagering system. The interactive puzzle has multiple intermediate states that that define multiple possible solution paths. Some of the intermediate states are defined to be base interactive subobjectives of a base interactive objective of an interactive wagering process of an interactive wagering proposition. In one such embodiment, the interactive puzzle is a physics puzzle wherein a player is tasked with guiding a virtual cookie into a virtual character's mouth. The virtual cookie is suspended from one or more virtual ropes that are virtually cut by the player in a specific order to guide the virtual cookie into the virtual character's mouth. Virtually cutting the virtual ropes in an order other than the specified order may or may not lead to the virtual cookie being guided into the virtual player's mouth. Virtually cutting the virtual ropes in the specific order will guide the virtual cookie into the virtual character's mouth. In addition, virtually cutting the virtual ropes in the specific order will ensure that the virtual cookie virtually collides with three separate virtual stars each representing achievement of an interactive subobjective. That is, virtually cutting the virtual ropes in the specific order results in the player achieving one or more interactive subobjectives as the virtual cookie virtually collides with one or more of the three virtual stars. When all of the virtual ropes have been virtually cut and the player has either successfully guided the virtual cookie into the virtual characters mouth or not, the player will have earned from zero to three virtual stars representing from zero to three interactive subobjective achievements. Each interactive subobjective achievement is associated with a chance-based outcome that is an award of an amount of credits with each amount of credits being different and ordered such that a lowest amount of credits are associated with the player having achieved zero interactive subobjectives, and a highest amount of credits of a random component associated with the player having achieved three interactive subobjectives. In other words, an ordered set of chance-based outcomes are associated with an ordered set of interactive subobjective achievements. If the player has not achieved any interactive subobjectives, that is the number of interactive subobjective achievements for the player is zero, then the player is simply awarded a lowest value chance-based outcome as an award for committing a wager. However, if the player has at least interactive subobjective achievement, two or more of the chance-based outcomes are associated with a respective two or more selector interactive objectives in the form of virtual chests. The two are more chance-based outcomes are revealed to the player such that the player can see an amount of credits associated with two or more chance-based outcomes and associated with the virtual chests and then the two or more chance-based outcomes are obscured. The two or more selector interactive objectives are randomized such that the player can no longer determine which chance-based outcome is associated with which selector interactive objective, that is the virtual chests virtually shuffled and then presented to the player. The player selects at least one of the chests to reveal the virtual chests associated chance-based outcome, thus achieving at least one of the selector interactive objectives. An interactive wagering proposition outcome is then determined from the revealed at least one random component and awarded to the player as an amount of credits.

Figure 9A:
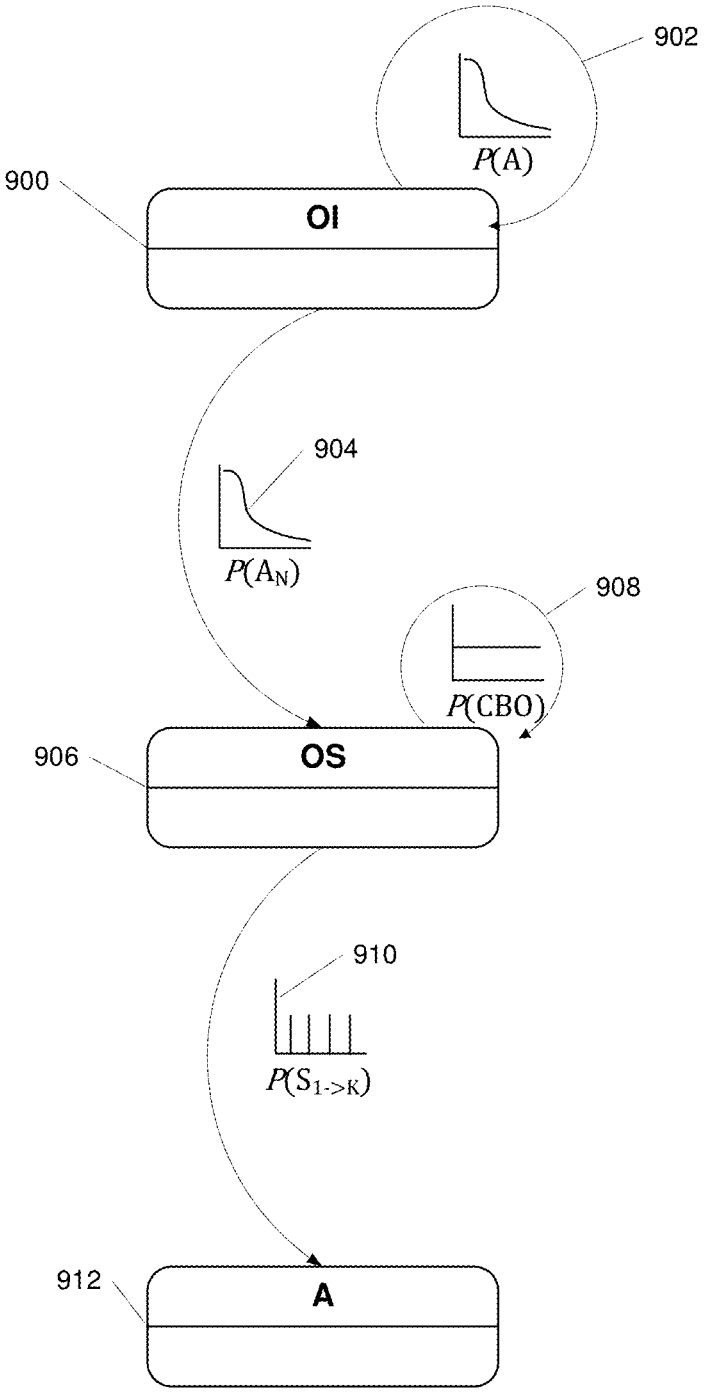
FIGS. 9A to 9C are state diagrams of an interactive wagering process of an outcome selector interactive wagering system in accordance with various embodiments of the invention.

FIG. 9A is a state diagram of an interactive wagering process of an outcome selector interactive wagering system in accordance with various embodiments of the invention. In an initial state OI 900, the outcome selector interactive wagering system presents one or more initial interactive objectives and detects 902 a player's achievement of the one or more initial interactive objectives as indicated by a skill-based transition. Upon achievement of a specified initial interactive objective, the outcome selector interactive wagering system transitions 904 to a selector state Os 906 in which the outcome selector interactive wagering system generates an ordered set of two or more chance-based outcomes of potential awards of credits as indicated by random-based transition and probability P(CBO) 908. The set of two or more chance-based outcomes are associated with two or more selector interactive objectives and randomized. The outcome selector interactive wagering system presents the randomized selector interactive objectives to the player and transitions 910 from the selector state OS 906 to an award state A 912 upon detecting a selection of at least one of the selector interactive objectives by the player. In state A the outcome selector interactive wagering system determines an award of credits to award to the player based on the chance-based outcome associated with the detected player selection of at least on of the two or more selector interactive objectives.

Figure 9B:
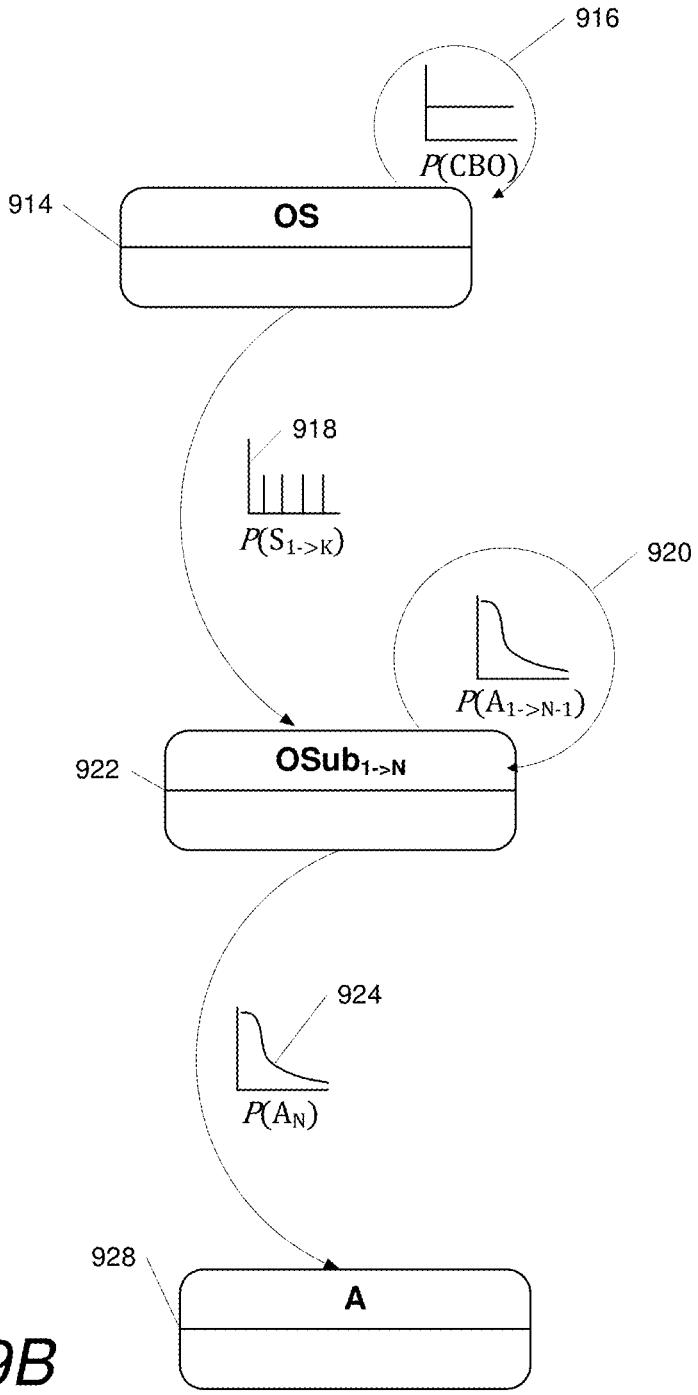

FIG. 9B is another state diagram of an interactive wagering process of an outcome selector interactive wagering system in accordance with various embodiments of the invention. In an initial state OS 914, the outcome selector interactive wagering system generates 916 an ordered set of two or more chance-based outcomes of potential awards of credits as indicated by random-based transition and probability P(CBO). The set of two or more chance-based outcomes are associated with two or more selector interactive objectives and randomized. The outcome selector interactive wagering system presents the randomized selector interactive objectives to the player and transitions 918 from the selector state OS 914 to a subsequent objective state OSub 922. In the OSub state, the outcome selector interactive wagering system generates and presents one or more subsequent interactive objectives to the player and detects the player's achievement of the one or more subsequent interactive objectives as indicated by a skill-based transition 920 and by probability of P(A1->N−1). Upon detecting achievement of a specified initial interactive objective, the outcome selector interactive wagering system transitions to an achievement state A 928, as indicated by a skill-based transition and probability P(AN) 924.

In achievement state A, the outcome selector interactive wagering system determines an award of credits to award to the player based on the chance-based outcome associated with the detected player selection of at least one of the two or more selector interactive objectives and the detected achievement of the subsequent interactive objectives.

Figure 9C:
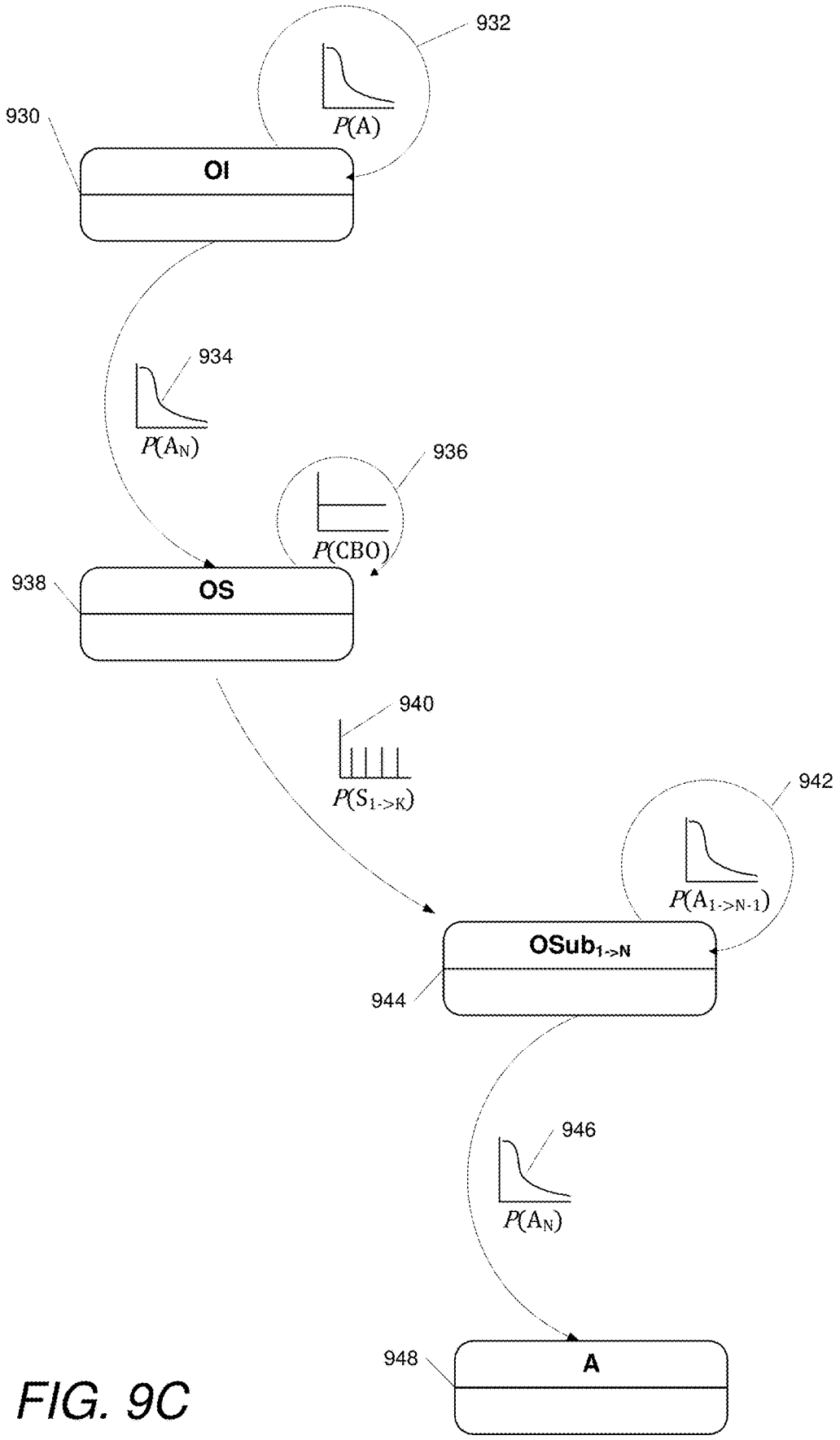

FIG. 9C is another state diagram of an interactive wagering process of a outcome selector interactive wagering system in accordance with various embodiments of the invention. In an initial state OI 930, the outcome selector interactive wagering system presents one or more initial interactive objectives and detects a player's achievement of the one or more initial interactive objectives as indicated by skill-based transition 932. Upon achievement of a specified initial interactive objective, the outcome selector interactive wagering system transitions 934 to a selector state Os 938 in which the outcome selector interactive wagering system generates an ordered set of two or more chance-based outcomes as indicated by random-based transition 936 and probability P(CBO). The set of two or more chance-based outcomes are associated with two or more selector interactive objectives and randomized. The outcome selector interactive wagering system presents the randomized selector interactive objectives to the player and transitions 940 from the selector state OS 938 to a subsequent objective state OSub 944. In the OSub state, the outcome selector interactive wagering system generates and presents one or more subsequent interactive objectives to the player and detects the player's achievement of the one or more subsequent interactive objectives as indicated by a skill-based transition 942 and by probability of P(A1->N−1). Upon detecting achievement of a specified interactive objective, the outcome selector interactive wagering system transitions to an achievement state A 948, as indicated by a skill-based transition 946 and probability P(AN).

In achievement state A, the outcome selector interactive wagering system determines an award of credits to award to the player based on the chance-based outcome associated with the detected player selection of at least one of the two or more selector interactive objectives and the detected achievement of the subsequent interactive objectives.

Figure 10A:
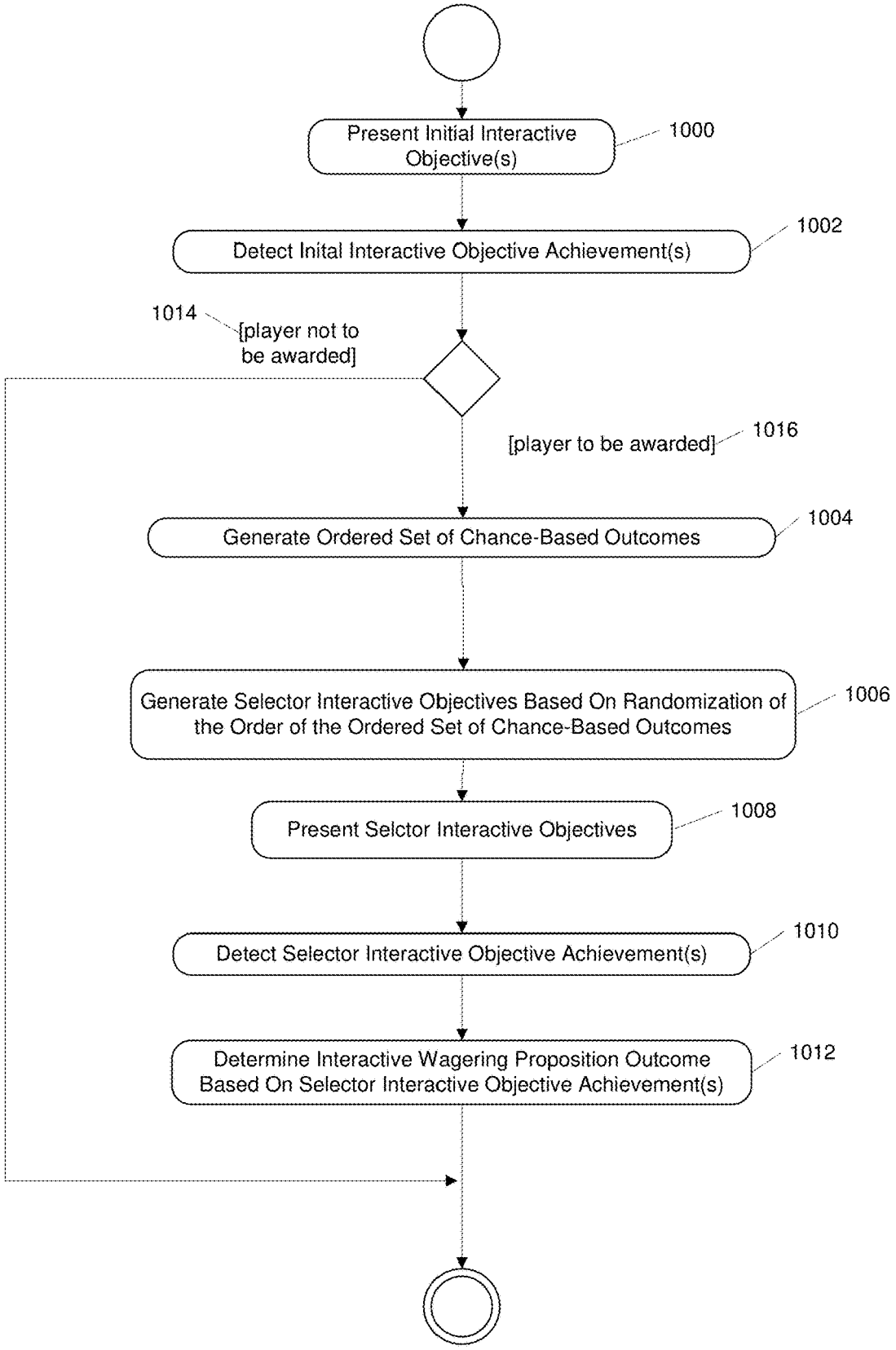
FIGS. 10A to 10C are activity diagrams of an interactive wagering process of an outcome selector interactive wagering system in accordance with various embodiments of the invention.

FIG. 10A is an activity diagram of an interactive wagering process of an outcome selector interactive wagering system in accordance with various embodiments of the invention. The outcome selector interactive wagering system generates one or more initial interactive objectives and presents 1000 the interactive objectives to a player as described herein. The outcome selector interactive wagering system detects 1002 achievement of the one or more initial interactive objectives and determines whether or not the player will be awarded a chance-based outcome. If the player is not be awarded 1014, no chance-based outcomes are presented to the player. If the player is to be awarded 1016, the outcome selector interactive wagering system generates 1004 an ordered set of two or more chance-based outcomes as described herein. The outcome selector interactive wagering system generates

1006 two or more selector interactive objectives, associates respective chance-based outcomes of the ordered set of two or more chance-based outcomes with the selector interactive objectives, and randomizes an order of the selector interactive objectives. The outcome selector interactive wagering system presents 1008 the randomized selector interactive objectives to the player. The outcome selector interactive wagering system detects 1010 a player selection of at least one of the selector interactive objectives as an achievement of the selector interactive objectives. The outcome selector interactive wagering system determines 1012 an interactive wagering proposition outcome based on the detected achievement of the at least one selector interactive objective.

In some embodiments, the ordered set of chance-based outcomes is displayed to the player before the ordered set of chance-based outcomes is randomized and hidden.

Figure 10B:
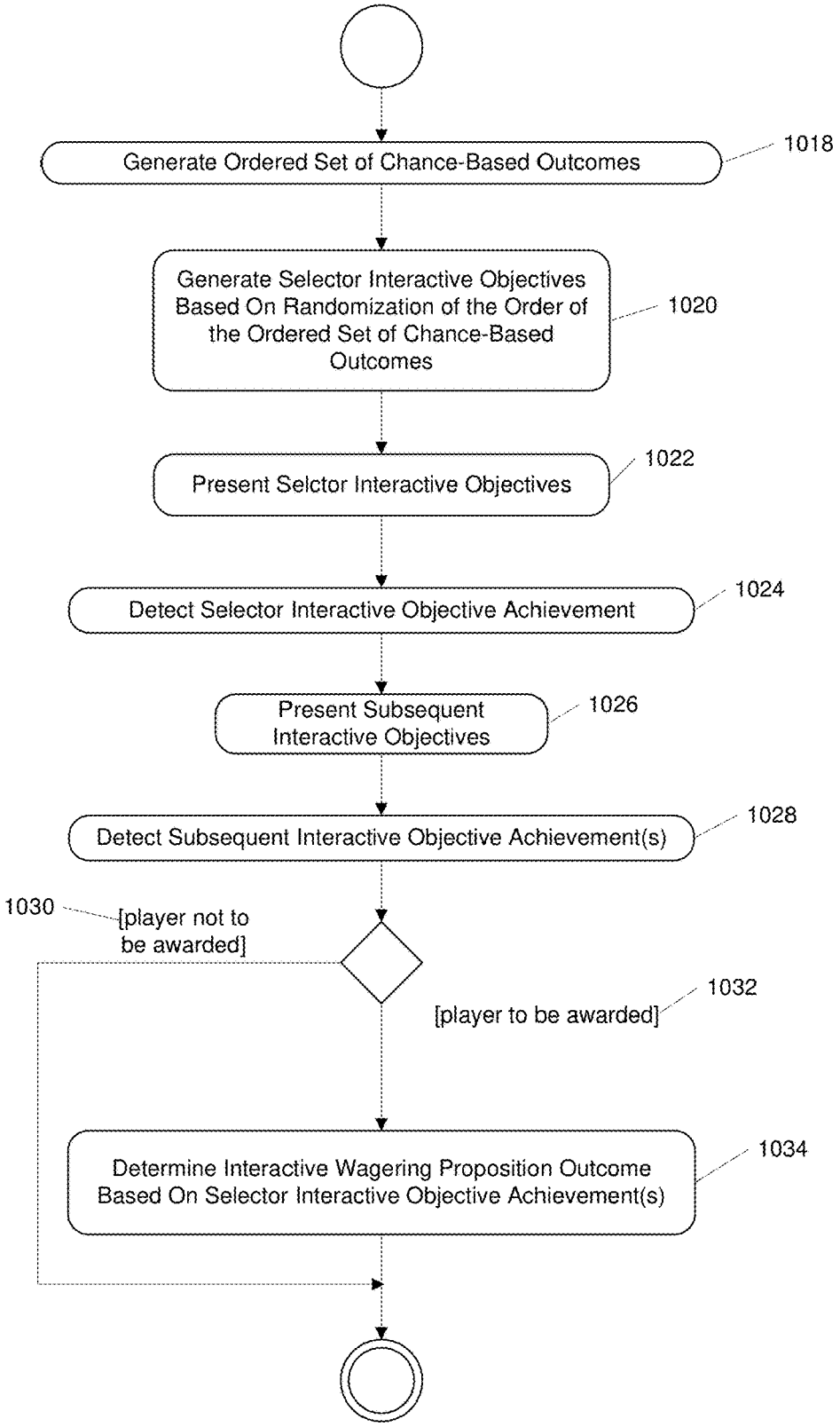

FIG. 10B is another activity diagram of an interactive wagering process of an outcome selector interactive wagering system in accordance with various embodiments of the invention. The outcome selector interactive wagering system generates 1018 an ordered set of two or more chance-based outcomes as described herein. The outcome selector interactive wagering system generates 1020 two or more selector interactive objectives, associates respective chance-based outcomes of the ordered set of two or more chance-based outcomes with the selector interactive objectives, and randomizes an order of the selector interactive objectives. The outcome selector interactive wagering system presents 1022 the randomized selector interactive objectives to the player. The outcome selector interactive wagering system detects 1024 a player selection of at least one of the selector interactive objectives as an achievement of the selector interactive objectives. The outcome selector interactive wagering system generates one or more subsequent interactive objectives and presents 1026 the subsequent interactive objectives to a player as described herein. The outcome selector interactive wagering system detects 1028 achievement of the one or more subsequent interactive objectives and determines whether or not the player will be awarded a chance-based outcome based on the achievement of the subsequent interactive objectives. If the player is not to be awarded 1030, no interactive wagering proposition outcome is awarded to the player. If the player is to be awarded 1032, the outcome selector interactive wagering system determines 1034 an interactive wagering proposition outcome based on the detected achievement of the at least one selector interactive objective and the detected achievement of the one or more subsequent interactive objectives.

Figure 10C:
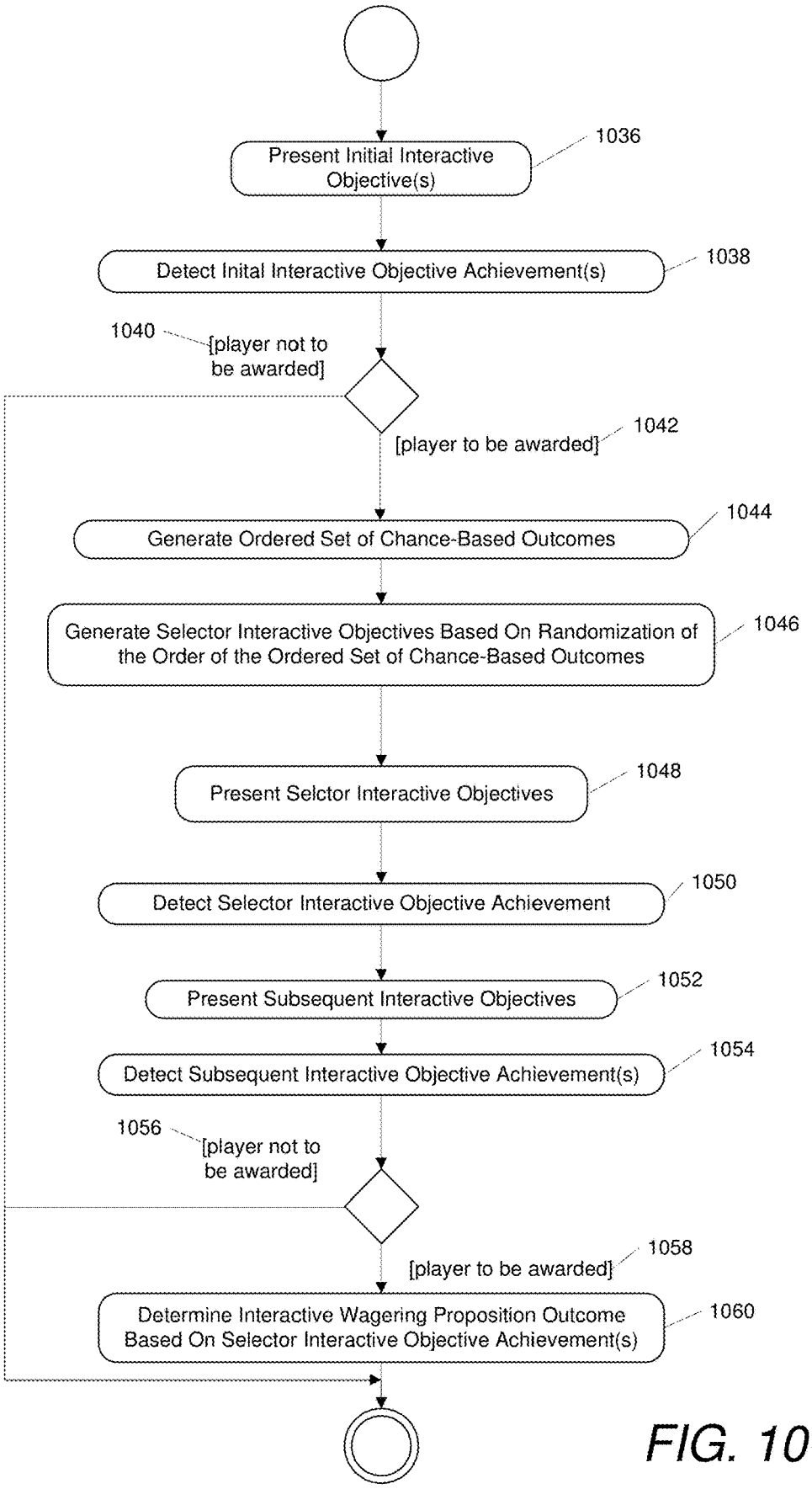

FIG. 10C is an activity diagram of an interactive wagering process of an outcome selector interactive wagering system in accordance with various embodiments of the invention. The outcome selector interactive wagering system generates one or more initial interactive objectives and presents 1036 the interactive objectives to a player as described herein. The outcome selector interactive wagering system detects 1038 achievement of the one or more initial interactive objectives and determines whether or not the player will be awarded a chance-based outcome. If the player is not to be awarded 1040, no chance-based outcomes are presented to the player. If the player is to be awarded 1042, the outcome selector interactive wagering system generates 1044 an ordered set of two or more chance-based outcomes as described herein. The outcome selector interactive wagering system generates 1046 two or more selector interactive objectives, associates respective chance-based outcomes of the ordered set of two or more chance-based outcomes with the selector interactive objectives, and randomizes an order of the selector interactive objectives. The outcome selector interactive wagering system presents 1048 the randomized selector interactive objectives to the player. The outcome selector interactive wagering system detects 1050 a player selection of at least one of the selector interactive objectives as an achievement of the selector interactive objectives.

The outcome selector interactive wagering system generates one or more subsequent interactive objectives and presents 1052 the subsequent interactive objectives to a player as described herein. The outcome selector interactive wagering system detects 1054 achievement of the one or more subsequent interactive objectives and determines whether or not the player will be awarded a chance-based outcome based on the achievement of the subsequent interactive objectives. If the player is not to be awarded 1056, no interactive wagering proposition outcome is awarded to the player. If the player is to be awarded 1058, the outcome selector interactive wagering system determines 1060 an interactive wagering proposition outcome based on the detected achievement of the at least one selector interactive objective and the detected achievement of the one or more subsequent interactive objectives.

Figure 11:
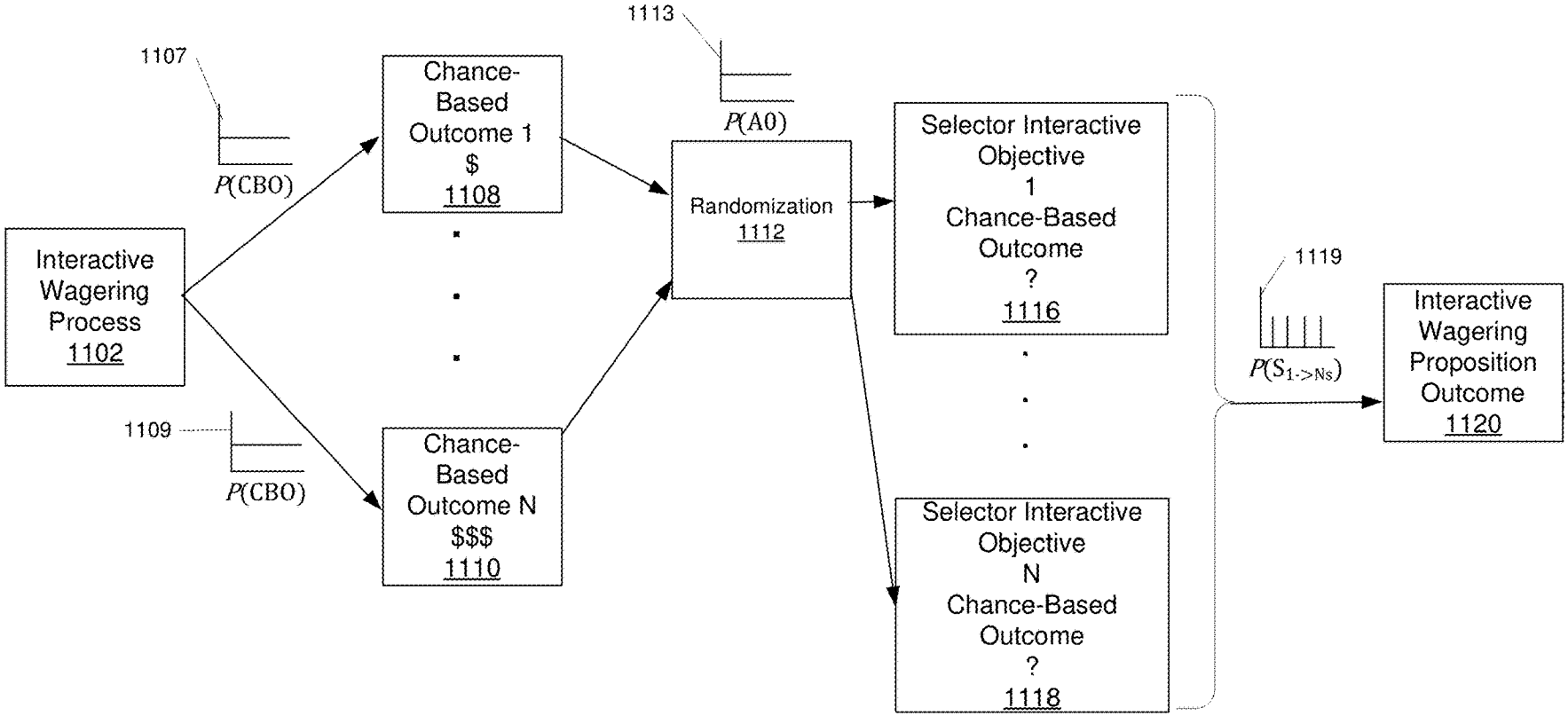
FIG. 11 is a data flow diagram of an interactive wagering process of an outcome selector interactive wagering system in accordance with various embodiments of the invention.

FIG. 11 is a data flow diagram of an interactive wagering process of an outcome selector interactive wagering system in accordance with various embodiments of the invention. As illustrated, during an interactive wagering process 1102, an ordered set of two or more chance-based outcomes, as illustrated by chance-based outcome 1 1108 and chance-based outcome N 1110, are generated as indicated by random-based transitions and probabilities P(CBO) 1107 and 1109 and associated with two or more selector interactive objectives, such as selector interactive objectives 1116 and 1118. An order of the chance-based outcomes associated with the selector interactive objectives are randomized 1112 as indicated by a random-based transition and probability P(O) 1113. The two or more selector interactive objectives are generated and associated with respective randomized chance-based outcomes.

The selector interactive objectives are presented to the player and the player then selects at least one of the selector interactive objectives, as indicated by a player selection transition and probability P(S1-Ns) 1119. The chance-based outcome associated with the selected at least one selector interactive objective is awarded to the player as an interactive wagering proposition outcome 1120 of the interactive wagering process.

In example embodiments, selector interactive objectives can be presented at various events of an interactive application, such as but not limited to at the onset of a game implemented by the interactive application, throughout a game implemented by the interactive application (i.e. in stages, or in full), or at the completion of a game implemented by the interactive application. In many embodiments, selector interactive objectives span multiple game sessions. In various embodiments, selector interactive objectives span multiple games implemented by separate interactive applications, and/or multiple game titles implemented by a single interactive application. In an example embodiment, one form of a selector interactive objective might include a field of hundreds of hidden chance-based outcomes, that are selected by one or multiple players, serially, or in joint-session (not quite simultaneously).

In another embodiment, a plurality of selector interactive objectives fields are populated with chance-based outcomes. The chance-based outcomes are hidden from the player behind one or more graphical interactive elements of an interactive application. In some embodiments, these graphical interactive elements are not distinct from a background image of a user interface of the interactive application (i.e. the selector interactive objectives may approximate a form of geometric wall paper). In some embodiments, these graphical interactive elements are distinct from a background image of a user interface of an interactive application.

In various embodiments, chance-based outcomes are allocated on a basis of a random component at the onset of a game implemented by an interactive application, or immediately prior to presentation of the selector interactive objectives to the player. The random component may be based on player interactions.

In accordance with various embodiments, there are a number of ways in which achievement of interactive objectives (e.g. achieving a certain score, possessing a specific in-game object, etc.) and/or skill can affect the contents and/or access to/interaction with the selector interactive objectives. These achievements of interactive objectives and/or skill can span the current and/or multiple game sessions.

In some embodiments, other variables are used to affect generation of selector interactive objectives and chance-based outcomes, including but not limited to, a status of a player in a player club of an operator, whether or not the game is in tournament mode, the number of players participating in a 1-to-N player v. player game, etc. In various embodiments, a number of chance-based outcomes available are affected by a variable. In an example embodiment, an additional chance-based outcome and associated selector interactive objective are presented to a player who belongs to a player's club. In another example embodiment, a player v. player interactive application is provided to a plurality of players. As a number of players increases, additional chance-based outcomes and associated selector interactive objectives are presented to a player. In other embodiments, a number of chance-based outcomes that are revealed to the player (and still selectable) prior to selection are affected. In some embodiments, a number of chance-based outcomes that are revealed to the player (and are no longer selectable) prior to selection may be affected. In many embodiments, a number of selections that the player can make is affected by a variable. In some embodiments, an amount of time the player has to make selections is affected by a variable. In many embodiments, whether the player can "double down" or otherwise opt to make a payment to gain additional hidden chance-based outcomes from which to choose, and/or the ability to make additional choices, and/or to eliminate high and/or low chance-based outcomes is affected by a variable. In many embodiments, whether the player can pay for information (e.g. hints) about the chance-based outcome field in advance of making a selection or selections is affected by a variable.

In an embodiment, selector interactive objectives are provided to two or more players within the context of a single player versus computer game implemented by an interactive application. The player makes their selection of selector interactive objectives associated with chance-based outcomes while a computer generated opponent attempts to block access, or pre-emptively eliminate, selector interactive objectives. In an example embodiment, in a variant of the popular Snake game construct, the player maneuvers their snake to encompass the selector interactive objectives associated with chance-based outcomes that the player wants to choose, while a computer-generated snake (oblivious to the value of any of the chance-based outcome values) does the same, thereby potentially precluding certain choices.

In another embodiment, a player versus player game is implemented by an interactive application. A player makes their choice of a set of selector interactive objectives associated with chance-based outcomes while a human opponent attempts to block access, or pre-emptively select their own set of selector interactive objectives associated with the chance-based outcomes. In an example embodiment, in a variant of the popular Snake game construct, each player maneuvers are respective snake to encompass a set of selector interactive objectives associated with the chance-based outcomes that each player wants to choose, while another player's respective snake (oblivious to the value of any of the chance-based outcome values) does the same. At the end of a prescribed period of time, or when the snakes collide, each player is awarded the chance-based outcomes associated with selector interactive objectives that the player has achieved.

In some embodiments, a subset of a set of chance-based outcomes associated with selector interactive objectives may include other types of awards rather than an amount of credits redeemable in a real currency. In example embodiments, one or more chance-based outcomes include, but are not limited to, in-casino benefits, free-play credits, in-game objects, application credits, credits in a virtual currency, etc. In some embodiments, in-game objects and other game impacts are negative in affect, such as, but not limited to a curse. In some embodiments, in-game objects and other game impacts are neutral in affect, such as, but not limited to a costume for the player's avatar associated with a selector interactive objective as a chance-based. In many embodiments, in-game objects and other game impacts are positive in affect, such as, but not limited to, an extra life.

In some embodiments, a layer is presented with an option of doubling down, or otherwise staking the chance-based outcome they just won for the potential to win another (potentially better, but could also be worse) chance-based outcome. This "doubling down" could take place in the context of a single selector interactive objective, or could roll the opportunity into a subsequent chance-based outcome selection event at the conclusion (or in the flow of, more generally speaking) the next game play session.

In various embodiments, a player accumulates selections in each game, and elect when and if the player is presented a set of selector interactive objectives. In an example embodiment, a player might win, over three games, 2,1,3, for a total of 6 selections, and then elect to be presented with the selector interactive objectives at this point, making six chance-based outcome selections in the field. The value of chance-based outcomes within the field may or may not represent the aggregation of results across separate random components, or a single random component, and may or may not correlate directly with an amount of wagers committed across the three games played.

In some embodiments, in a stage of a presentation of selector interactive objectives to a player, all available chance-based outcomes are shown to the player. In a subsequent stage, the chance-based outcomes are obscured in some manner and then randomized in a manner as to make their location in a matrix of interactive elements associated with selector interactive objectives impossible to determine. The outcome selector interactive wagering system detects a player selecting an interactive element of a selector interactive objective associated with a chance-based outcome within the matrix, reveals the chance-based outcome associated with the achieved selector interactive objective, and reveals the other chance-based outcomes associated with the selector interactive objectives that were not selected.

In various embodiments, a player is presented with a choice of whether to keep the chance-based outcome selected or trade it for either a fixed value, another selection or some other choice where the first selected chance-based outcome is forfeit and the new selected chance-based outcome is now given to the player In many embodiments, one or more chance-based outcomes include, but are not limited to, non-monetary chance-based outcomes allowing a player to advance in a game, versus being eliminated with or without a monetary chance-based outcome which was selected as part of the selection (i.e. the player either advances, or gets a chance-based outcome and is eliminated from advancing in the game/tournament).

In some embodiments, a set of random components and/or chance-based outcomes may be pre-generated and stored and a readback of the pre-stored set of a set of random components and/or chance-based outcomes are associated with the selector interactive objectives. In example embodiments, random components include, but are not limited to, storing an encrypted file of decks of shuffled cards, dice rolls, bingo balls, etc. and revealing those values to the game OS which in turn translate to chance-based outcomes selected for use in the selector interactive objectives.

Figure 12:
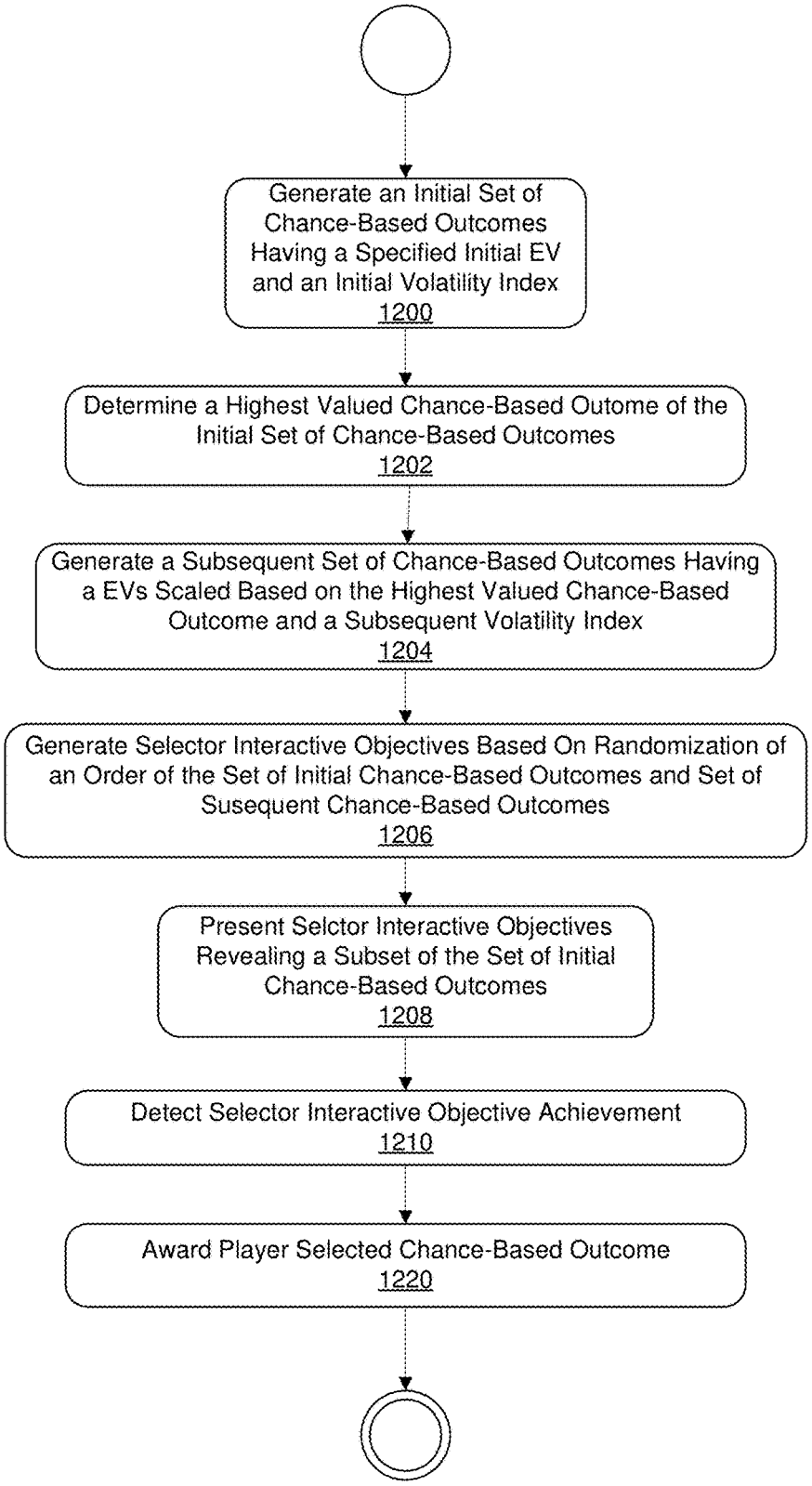
FIG. 12 is an activity diagram of a process for generating an outcome selector of an outcome selector interactive wagering system having multiple volatility indexes in accordance with various embodiments of the invention.
Figure 13A:
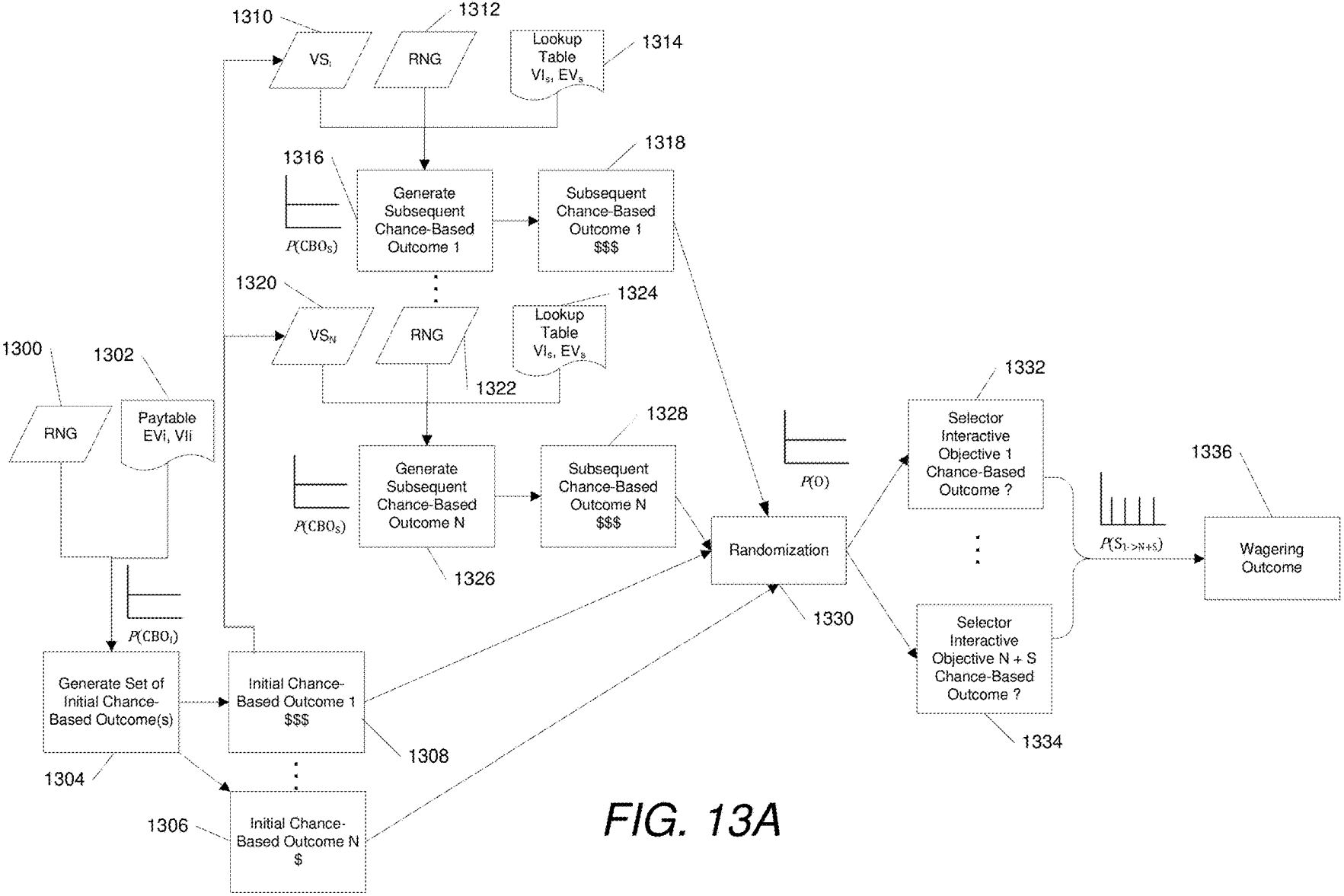
FIGS. 13A to 13C are data flow diagrams of an interactive wagering process of an outcome selector interactive wagering system in accordance with various embodiments of the invention.
Figure 13B:
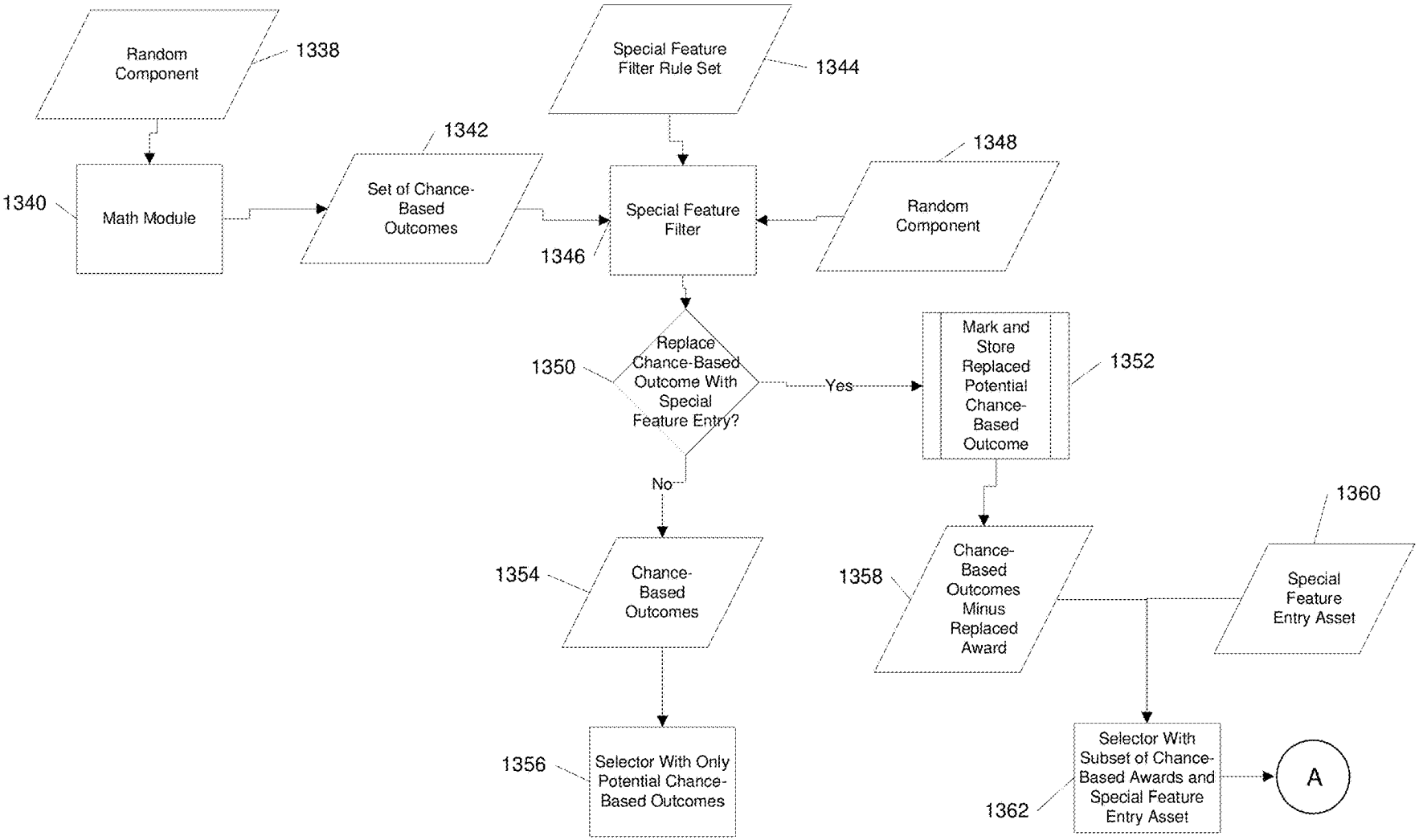
Figure 13C:
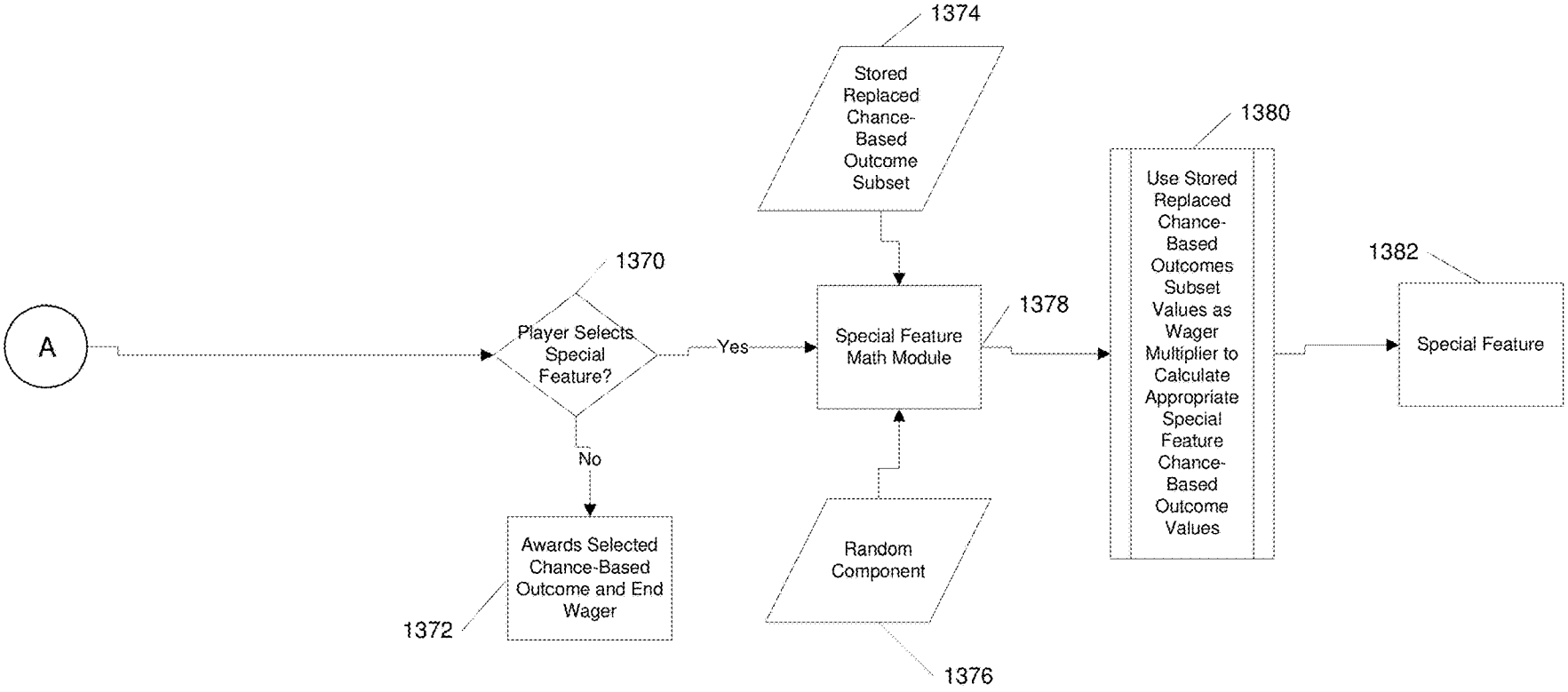

FIG. 12 is an activity diagram of a process for generating an outcome selector of an outcome selector interactive wagering system having multiple volatility indexes and FIGS. 13A to 13B are data flow diagrams of a process in accordance with various embodiments of the invention.

A volatility index for a set of chance-based outcomes generated by a interactive wagering system is a measure of how the chance-based outcomes vary as a sequence of chance-based outcomes are generated. A set of chance-based outcomes having low volatility index does not have a large variance in chance-based outcomes, while a set of chance-based outcomes with a high volatility index has large variances in chance-based outcomes. A volatility index is analogous to a confidence interval for set of data.

Chance-based outcomes can be generated using a lookup table of chance-based outcomes and a random component as an index into the lookup table as described herein. A volatility index for a set of chance-based outcomes generated using a lookup table can be calculated by:

$$Vi=C*\sqrt{\Sigma_{i=1}^{N}P_i(O_i-EV)^2}$$

Where:

Vi=Volatility index in units of wager value.

C=critical value of the confidence interval.

N=number of unique chance-based outcomes in the lookup table.

Oi=value of the ith unique chance-based outcome in units of wager value.

Pi=probability that chance-based Oi will be generated.

EV=expected value of set of chance-based outcomes generated using the lookup table in units of wager value.

Referring now to both FIG. 12 and FIG. 13A, during a process for generating an outcome selector of an outcome selector interactive wagering system, an outcome selector interactive wagering system generates, 1200 and 1304, an initial set of chance-based outcomes, as exemplified by initial chance-based outcomes 1306 and 1308. The initial set of chance-based outcomes are generated using an output of a random number generator 1300 and a lookup table 1302 that defines a set of chance-based outcomes that have a specified initial expected value and an initial volatility index. The system determines 1202 a highest valued chance-based outcome of the initial set of chance-based outcomes. The system generates, 1204, 1316, and 1326, one or more subsequent sets of chance-based outcomes, such as subsequent set of chance-based outcomes 1318 and 1328, having expected values 1310 and 1320, based on the highest valued chance-based outcome of the initial set of chance-based outcomes and a subsequent volatility index, using an output of a random number generator, 1312 and 1322, and lookup tables, 1314 and 1324. The system uses the initial set of chance-based outcomes and the one or more or subsequent sets of chance-based outcomes to generate 1206 two or more selector interactive objectives, such as selector interactive objectives 1332 and 1334, based on a randomization 1330 of an order of the initial set of chance-based outcomes and the one or more subsequent sets of chance-based outcomes. The selector interactive objectives are presented 1208 to a player with the value of the chance-based outcomes hidden from the player. The system detects 1210 the player's selection of one of the chance-based outcomes of the selector interactive objective and the system awards 1220 to the player the selected chance-based outcome as a wagering outcome 1336.

In some embodiments, the selector interactive objective is presented to the player with the highest valued chance-based outcome of the initial set of chance-based outcomes revealed.

In various embodiments, the volatility index of the initial set of chance-based outcomes is lower than the volatility index of the one or more subsequent sets of chance-based outcomes.

In some embodiments, the volatility index of the initial set of chance-based outcomes is higher than the volatility index of the one or more subsequent sets of chance-based outcomes.

In many embodiments, the volatility index of the initial set of chance-based outcomes is the same as the volatility index of the one or more subsequent sets of chance-based outcomes.

In some embodiments, a highest valued chance-based outcome of the initial set of chance-based outcomes is used to determine a set of scaling values that are used to scale the one or more subsequent sets of chance-based outcomes. In an example embodiment, an initial lookup table is used in conjunction with a random component as an index into the lookup table to generate an initial chance-based outcome. The initial lookup table is designed to provide a specified expected value for a specified wager value. In other words, the initial lookup table has a specified initial return to player. The initial chance-based outcome is then used in conjunction with another lookup table to determine a set of scaling values. The set of scaling values are used in conjunction with a subsequent lookup table having a specified expected value that is a fraction of the expected value of the initial lookup table. The size of the set of scaling values is determined based on a number of subsequent chance-based outcomes to be generated for an outcome selector and the values of the scaling values is specified such that an average of the scaling values multiplied by the subsequent lookup table's expected value equals the initial chance-based outcome's value as expressed in the following equation:

$$CBO_i = \frac{\sum_{i=1}^{N} VS_i}{N} EV_s$$

Where:

$CBO_i$=initial chance-based outcome

N=number of scaling values in set of scaling values $VS_i$=ith scaling value $EV_s$=expected value of subsequent lookup table.

In an example embodiment, the expected value of an initial lookup table is 100 credits for 100 credits wagered. A member of a set of possible chance-based outcomes generated using the initial look up table is 300 credits. An expected value of a subsequent lookup table is 25 credits for a 100 credit wager. The size of the set of subsequent chance-based outcomes is 6. In such an example embodiment, a set of scaling values for the chance-based outcome of 300 of the initial lookup table is [3,3,36,6,12,12]. In operation, an initial random component and the initial lookup table are used to generate an initial chance-based outcome. The initial chance-based outcome is used to determine a set of scaling values. For each scaling value, a subsequent random component is generated and used with a subsequent lookup table to generate a chance-based component that is multiplied by the scaling value to determine a subsequent chance-based outcome of the set of subsequent chance-based outcomes. The initial chance-based outcome and the subsequent set of chance-based outcomes are combined through a randomization process to create an outcome selector as described herein.

In some embodiments, the initial chance-based outcome is approximately equal to the average of the scaling values multiplied by the expected value of the subsequent lookup table.

FIG. 13B is a process flow diagram of another process of an outcome selector interactive wagering system in accordance with various embodiments of the invention. In the process, the outcome selector interactive wagering system generates an selector objective in the form of a chance-based special feature or bonus that awards to a player a chance-based award during the playing of an interactive or chance-based base game.

The outcome selector interactive wagering system generates a set of chance-based outcomes 1342 using a random component 1338 and a math module 1340. The system uses a special feature filter rule set 1344 and a random component 1348 to determine a special feature filter 1346. The system uses the filter to determine 1350 whether or not to replace one or more chance-based outcomes of the set of chance-based outcomes with an entry or portal into a special feature. If the system determines not to provide the entry, then the system presents 1354 the set of chance-based outcomes to a player in a chance-based outcome selector 1356 with the set of chance-based outcomes hidden from the player where the player selects one of more chance-based outcomes of the set of chance-based outcomes as an award of credits.

If the system does determine to offer the entry, the system marks 1352 and stores the value of a marked subset of one or more chance-based outcomes of the set of chance-based outcomes resulting in an unmarked subset of the set of chance-based outcomes. The system generates a chance-based selector 1362 using the unmarked subset 1358 of the set of chance-based outcomes and the system replaces the marked subset of one or more chance-based outcomes with a special feature asset 1360 that when selected by the player indicates to the player that they have selected an entry into the special feature.

Turning now to FIG. 13B, the system detects 1370 if the player has selected the special feature asset from the chance-based outcome selector. If the player has not selected the special feature asset and instead selected a chance-based outcome, the system awards 1372 the selected chance-based outcome to the player. If the system detects that the player has selected the special feature asset, the system uses a special feature math module 1378, the stored marked subset of the set chance-based outcomes 1374, and a random component 1376 to generate a special feature set of chance-based outcomes 1380 for a special feature 1382 that is presented to the player.

In many embodiments, the special feature is an interactive game played by a player to determine a bonus award to be awarded to the player.

In some embodiments, the special feature is a chance-based game played by the player to determine a bonus award to be awarded to the player.

In some embodiments, the system makes a random determination to replace a chance-based outcome with entry into the special feature if: there are multiple wins generated for the outcome selector; the chance-based outcome to be replaced is not the largest chance-based outcome available; and the chance-based outcome to be replaced is greater than or equal to 2× the wager.

In many embodiments, the return to player (RTP) with the special feature filter is the same as RTP without the special feature filter.

In some embodiments, within ~3-5 plays on average, player experiences small special feature. Small special feature may allude to larger special features down the road for the player to stay on the machine. The player experiences variation in gameplay or wagering every ~3-5 plays with a large prize every ~100 or so plays.

In many embodiments, variation in gameplay piques player's interest and leads to longer session time and/or increased repeat play In several embodiments, the special feature filter allows for the arbitrary delivery of bonus-like events without having to build the special feature into the base math of a game or sacrificing base math functionality.

In various embodiments, the special feature may be a mini-game, a special gambling instance, a dynamic boss battle, etc.

In some embodiments, allows for preservation of level-map various gaming regulations.

In many embodiments, allows for injection of special feature functionality into legacy titles with minimal impact.

In several embodiments, allows for special feature delivery in arbitrary frequencies.

In many embodiments, allows for special feature delivery of arbitrary value.

In several embodiments, allows for special feature injection while maintaining RTP without altering math.

In an embodiment, allows for a multitude of special features with varying expectancies, win potential, etc.

In an embodiment, creates easily obtainable feature to whet a player's appetite with small wins and expectancy while still preserving a more desirable special feature down the road.

Figure 14A:
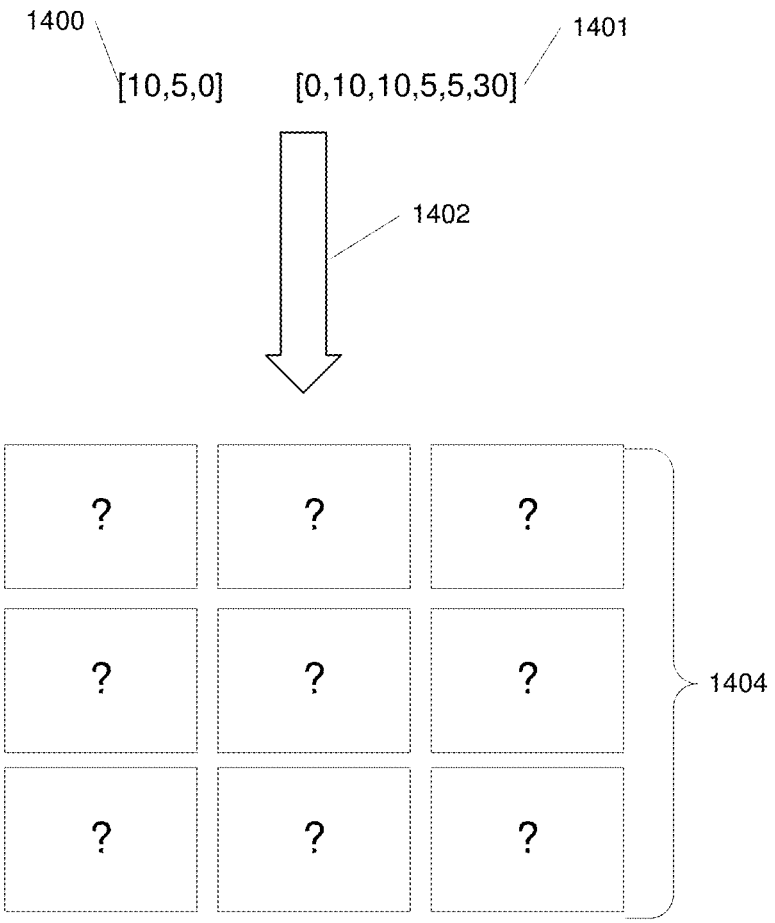

FIGS. 14A to 14D illustrate a user interface of an outcome selector of an outcome selector interactive wagering system having multiple volatility indexes in accordance with various embodiments of the invention. Referring now to FIG. 14A, in an example embodiment, a size of the initial set of chance-based outcomes 1400 is 3 1400 and a size of the one or more subsequent sets of initial chance-based outcomes 1401 is 6. The number or selections, or the size, of the resulting selector interactive objective is 9. In the example embodiments, an initial set of chance-based outcomes has the values of 10, 5, and 0. That is, the initial set of chance-based outcomes are generated and a player could be awarded either 10 credits, 5 credits or 0 credits for a 1 credit wager. It can be seen by simple inspection that the expected value of the initial set of chance-based outcomes is (10+5+0)/3 or 5 credits with highest valued chance-based outcome being 10 credits. In addition, a subsequent set of chance-based outcomes is illustrated is having the values of 0, 10, 10, 5, 5, and 30. The expected value of the set is 10 credits or (0+10+10+5+5+30)/6=10. Accordingly, the expected value of the one or more subsequent sets of chance-based outcomes is the same as the highest valued outcome of the initial set of chance-based outcomes.

The two sets of chance-based outcomes are to be used to generate 1402 selector interactive objective 1404 having 9 positions in a 3×3 grid. The order of the chance-based outcomes is randomized and then each chance-based outcome is assigned to a location in the 3×3 grid. A value of a chance-based outcome associated with a location of the 3×3 grid may or may not be revealed or may or may not be hidden.

Referring now to FIGS. 14B, 14C and 14D, the initial set of chance-based outcomes are revealed within the 3×3 grid and the grid is presented 1406 to a player while the values of the subsequent set of chance-based outcomes are hidden. The player may make a selection 1408 of the highest valued chance-based outcome of the initial set of chance-based outcomes, or the player may select one of the locations of the 3×3 grid where the chance-based outcome associated with that location is hidden. In the example grid, the player has chosen the hidden chance-based outcome 1409 that turns out to be the highest chance-based outcome, namely 30. In other words, the player is presented with an option of selecting the known highest valued chance-based outcome of the initial set of chance-based outcomes having a first volatility index or discarding the highest valued chance-based outcome of the initial set of chance-based outcomes and take a chance at selecting a higher valued chance-based outcome from the hidden subsequent set of chance-based outcomes.

At the end of the selection process, all of the chance-based outcomes are revealed 1410 to the player.

Figure 15:
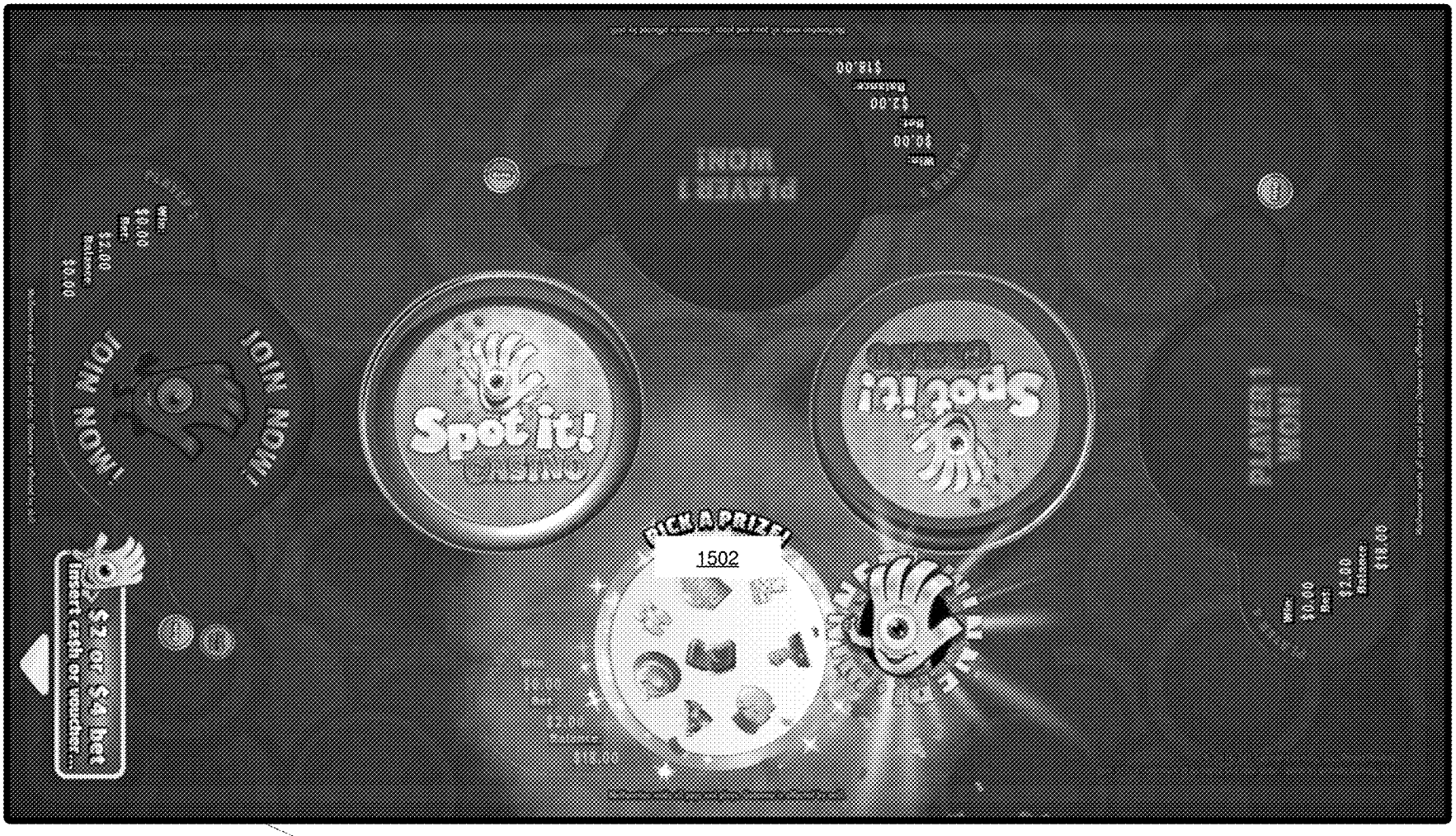
FIG. 15 is an illustration of another user interface of an outcome selector of an outcome selector interactive wagering system in accordance with various embodiments of the invention.

FIG. 15 is an illustration of another user interface of an outcome selector of an outcome selector interactive wagering system in accordance with various embodiments of the invention. In the illustrated user interface 1500, the outcome selector 1502 is circular and has 8 displayed icons, each icon corresponding to an associated chance-based outcome that is selectable by a player.

Figure 16A:
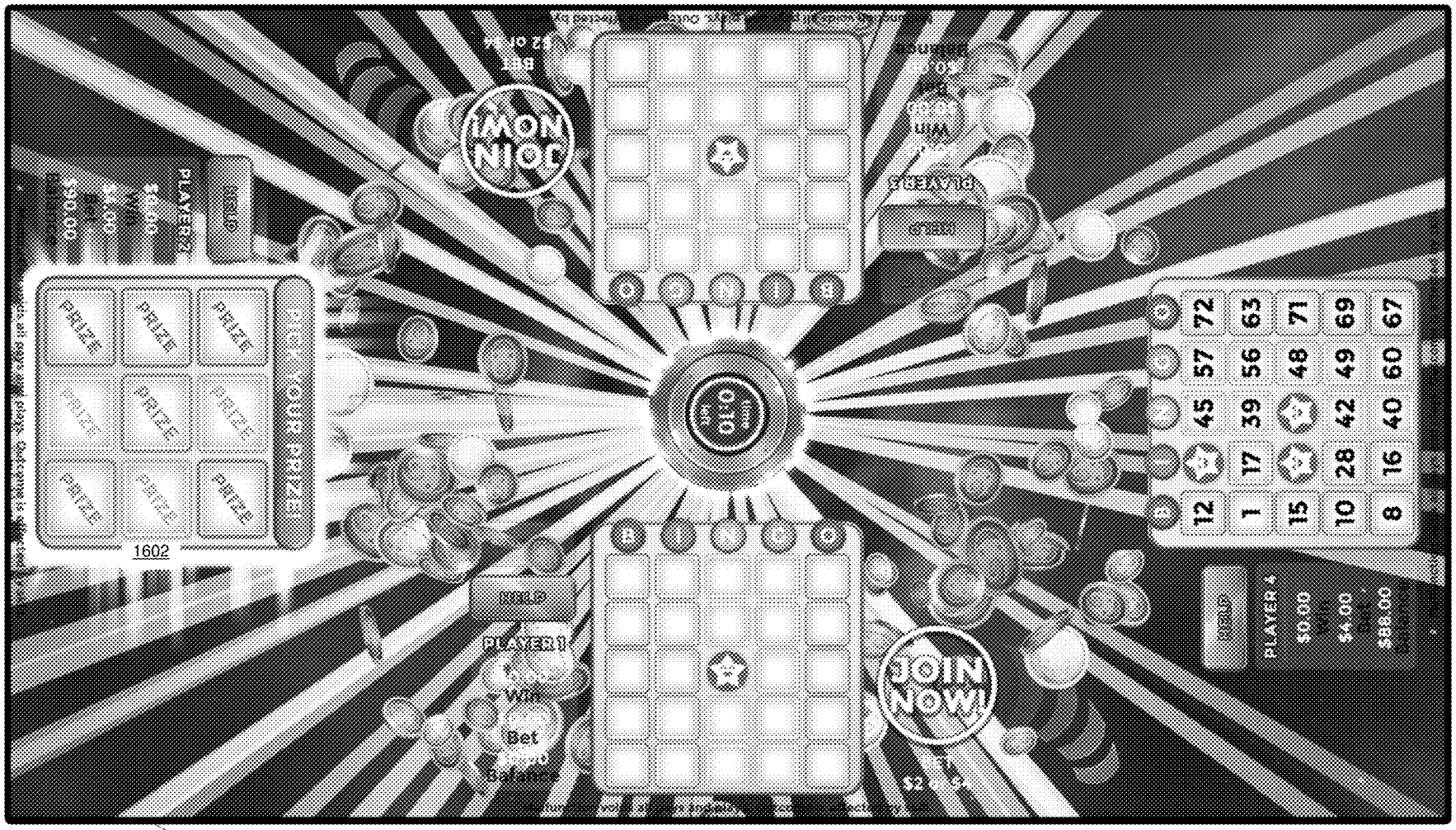
FIGS. 16A and 16B are illustrations of another user interface of an outcome selector of an outcome selector interactive wagering system in accordance with various embodiments of the invention.
Figure 16B:
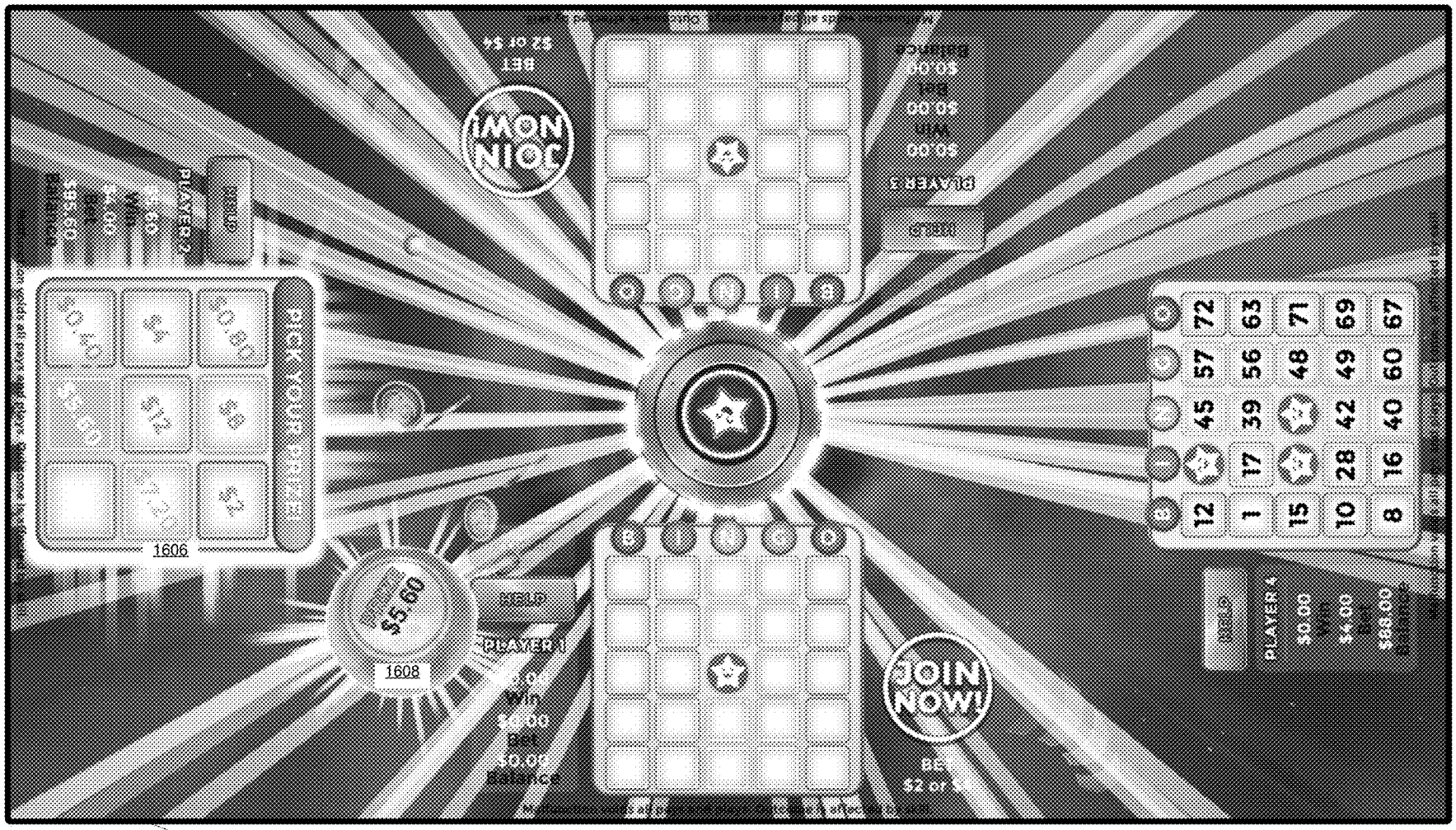

FIGS. 16A and 16B are illustrations of another user interface 1600 of an outcome selector of an outcome selector interactive wagering system in accordance with various embodiments of the invention. A 3×3 outcome selector 1602 is included in the user interface where the chance-based outcome associated with a location of the outcome selector is hidden. As illustrated in user interface 1604, when a player chooses a location of the outcome selector 1606, the player is awarded 1608 a value of the chance-based outcome associated with the selected location. In addition, all other chance-based outcome values are also displayed to the player.

Figure 17A:
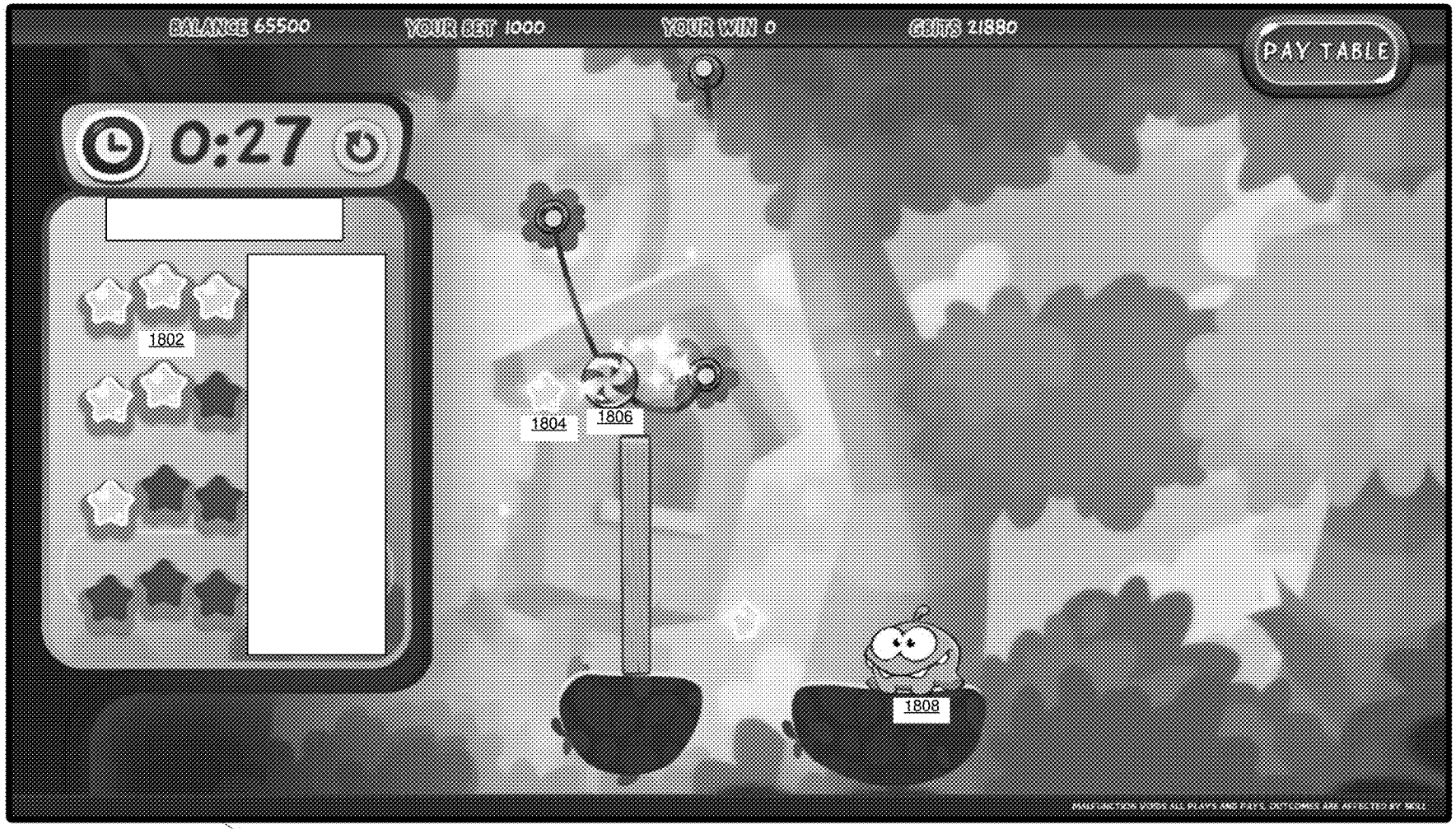
FIGS. 17A to 17B are illustrations of another user interface of an outcome selector of an outcome selector interactive wagering system in accordance with various embodiments of the invention.
Figure 17B:
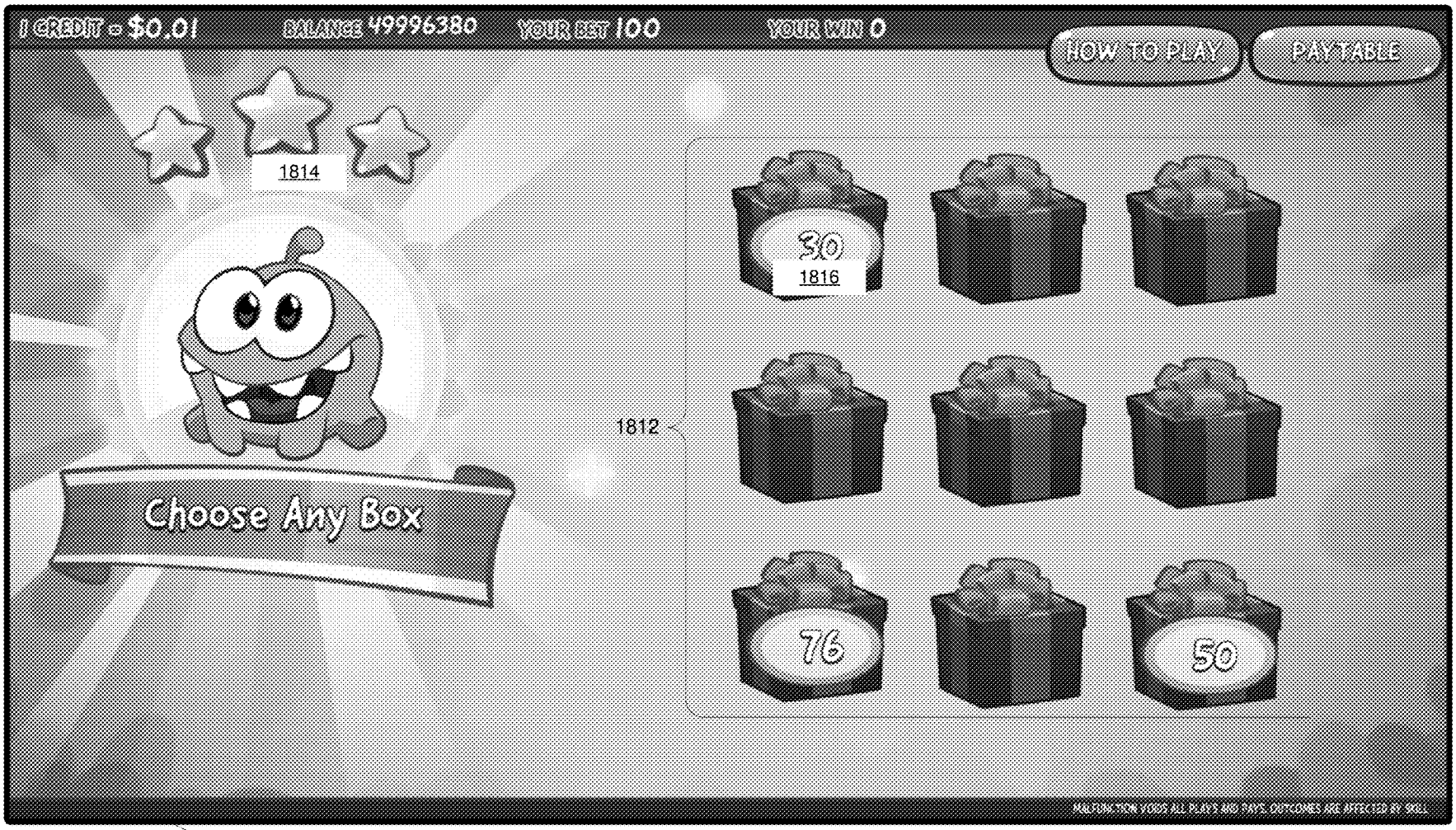

FIGS. 17A and 17B are illustrations of another user interface of an outcome selector of an outcome selector interactive wagering system in accordance with various embodiments of the invention. Referring now to FIG. 17A, in an example embodiment, an interactive puzzle 1800 is provided as an interactive application by an outcome selector interactive wagering system. The interactive puzzle has multiple intermediate states that define multiple possible solution paths. Some of the intermediate states are defined to be interactive subobjectives of a base interactive objective of an interactive wagering process of an interactive wagering proposition. In one such embodiment, the interactive puzzle is a physics puzzle wherein a player is tasked with guiding a virtual cookie 1806 into a virtual character's mouth (a base interactive objective) 1808. The virtual cookie is suspended from one or more virtual ropes that are virtually cut by the player in a specific order to guide the virtual cookie into the virtual character's mouth. Virtually cutting the virtual ropes in an order other than the specified order may or may not lead to the virtual cookie being guided into the virtual player's mouth. Virtually cutting the virtual ropes in the specific order will guide the virtual cookie into the virtual character's mouth. In addition, virtually cutting the virtual ropes in the specific order will ensure that the virtual cookie virtually collides with three separate virtual stars, such as virtual star 1804, each representing achievement of an interactive subobjective of one or more interactive subobjectives. That is, virtually cutting the virtual ropes in the specific order results in the player achieving one or more interactive subobjectives as the virtual cookie virtually collides with one or more of the three virtual stars. When all of the virtual ropes have been virtually cut and the player has either successfully guided the virtual cookie into the virtual characters mouth or not (a base interactive objective achievement), the player will have earned from zero to three virtual stars representing from zero to three interactive subobjective achievements (one or more interactive subobjective achievements) 1802. Each interactive subobjective achievement is associated with a reveal of a chance based outcome to the player during an outcome selection process.

Referring now to FIG. 17B, in an example embodiment, an additional user interface 1810 of a chance-based outcome selector is presented to the player. As illustrated, the player has earned 3 virtual stars 1814, and accordingly, 3 chance-based outcomes 1816, 1818, and 1820, are revealed of 9 possible chance-based outcomes within the outcome selector 1812. The player may choose one of the 3 revealed chance-based outcomes, or the player may choose one of the 6 hidden chance-based outcomes to earn a prize.

In another embodiment, if the player has at least one interactive subobjective achievement, two or more of the chance-based outcomes are associated with a respective two or more selector interactive objectives in the form of virtual chests. The two are more chance-based outcomes are revealed to the player such that the player can see an amount of credits associated with two or more chance-based outcomes and associated with the virtual chests and then the two or more chance-based outcomes are obscured. The two or more selector interactive objectives are randomized such that the player can no longer determine which chance-based outcome is associated with which selector interactive objective, that is the virtual chests virtually shuffled and then presented to the player. The player selects at least one of the chests to reveal the virtual chest's associated chance-based outcome, thus achieving at least one of the selector interactive objectives. A wagering outcome is then determined from the revealed at least one chance-based outcome and awarded to the player as an amount of credits.

While the above description may include many specific embodiments of the invention, these should not be construed as limitations on the scope of the invention, but rather as examples of embodiments thereof. It is therefore to be understood that the invention can be practiced otherwise than specifically described, without departing from the scope and spirit of the invention. Thus, embodiments of the invention described herein should be considered in all respects as illustrative and not restrictive.

What is claimed:

1. An outcome selector wagering electronic gaming machine, comprising:

an interactive controller constructed to:

receive from a process controller, two or more selector interactive objectives wherein each of the two or more selector interactive objectives has an associated chance-based outcome;

present to a player the two or more selector interactive objectives;

detect the player's selection of one of the chance-based outcomes of the selector interactive objectives; and communicate to the process controller, the player's selection of one of the chance-based outcomes; and the process controller operably connected to the interactive controller, wherein the process controller is constructed to:

generate an initial set of chance-based outcomes having a specified initial expected value and an initial volatility index;

determine a highest valued chance-based outcome of the initial set of chance-based outcomes;

generate a subsequent set of chance-based outcomes having expected values based on the highest valued chance-based outcome of the initial set of chance-based outcomes and a subsequent volatility index;

generate the two or more selector interactive objectives based on a randomization of an order of the initial set of chance-based outcomes and the subsequent set of chance-based outcomes;

communicate the two or more selector interactive objectives to the interactive controller;

receive from the interactive controller the player's selection of one of the chance-based outcomes; and award to the player the selected chance-based outcome as a wagering outcome.

2. The outcome selector wagering electronic gaming machine of claim 1, wherein the interactive controller and the process controller are constructed from the same device.

3. The outcome selector wagering electronic gaming machine of claim 1, wherein the process controller is operatively connected to the interactive controller using a communication link.

4. The outcome selector wagering electronic gaming machine of claim 1, wherein a credit processing subcontroller and the process controller are constructed from the same device.

5. The outcome selector wagering electronic gaming machine of claim 1, wherein a credit processing subcontroller, the interactive controller, and the process controller are constructed from the same device.

6. The outcome selector wagering electronic gaming machine of claim 1, further comprising:

a credit processing subcontroller; and an enclosure constructed to mount:

a user input device operatively connected to the interactive controller;

a user output device operatively connected to the interactive controller;

a credit input device operatively connected to the credit processing subcontroller; and a credit output device operatively connected to the credit processing subcontroller.

7. The outcome selector wagering electronic gaming machine of claim 6, wherein the process controller is further constructed to:

communicate with the credit input device to receive a credit input;

credit a credit meter with credits based on the incoming credit data;

update the credit meter based on the interactive wagering proposition outcome; and communicate with the credit output device to generate a credit output based on credits transferred off of the credit meter.

8. An outcome selector wagering electronic gaming machine, comprising:

an enclosure constructed to mount:

a user input device;

a user output device;

a credit input device; and a credit output device;

at least one processor operatively connected to the user input device, the user output device, the credit input device, and the credit output device; and a memory operatively connected to the at least one processor, the memory storing processor executable instructions that when executed by the processor cause the processor to:

generate an initial set of chance-based outcomes having a specified initial expected value and an initial volatility index;

determine a highest valued chance-based outcome of the initial set of chance-based outcomes;

generate a subsequent set of chance-based outcomes having expected values based on the highest valued chance-based outcome of the initial set of chance-based outcomes and a subsequent volatility index;

generate two or more selector interactive objectives based on a randomization of an order of the initial set of chance-based outcomes and the subsequent set of chance-based outcomes;

present to a player the two or more selector interactive objectives;

detect the player's selection of one of the chance-based outcomes of the two or more selector interactive objectives;

determine an interactive wagering outcome using the player's selection of one of the chance-based outcomes of the two or more selector interactive objectives;

update the credit meter based on the interactive wagering proposition outcome; and communicate with the credit output device to generate a credit output based on credits transferred off of the credit meter.

* * * * *